US006195019B1

(12) United States Patent
Nagura

(10) Patent No.: US 6,195,019 B1
(45) Date of Patent: Feb. 27, 2001

(54) VEHICLE CLASSIFYING APPARATUS AND A TOLL SYSTEM

(75) Inventor: Michinaga Nagura, Kariya (JP)

(73) Assignee: Denso Corporation, Aichi-ken (JP)

( * ) Notice: Subject to any disclaimer, the term of this patent is extended or adjusted under 35 U.S.C. 154(b) by 0 days.

(21) Appl. No.: 09/233,471

(22) Filed: Jan. 20, 1999

(51) Int. Cl.[7] ..... G08G 1/00

(52) U.S. Cl. ..... 340/928; 340/933; 340/937; 235/384; 356/376; 356/398; 701/117

(58) Field of Search ..... 340/928, 933, 340/937, 942, 825.31; 235/384, 375; 356/376, 4.01, 398; 701/117, 13, 32

(56) References Cited

U.S. PATENT DOCUMENTS

| | | | | |
|---|---|---|---|---|
| 5,451,758 | * | 9/1995 | Jesadanont | 325/384 |
| 5,546,188 | * | 8/1996 | Wangler et al. | 356/376 |
| 5,757,472 | * | 5/1998 | Wangler et al. | 356/4.01 |
| 5,793,491 | * | 8/1998 | Wangler et al. | 356/376 |
| 5,839,085 | * | 11/1998 | Yshikawa et al. | 701/117 |
| 5,963,149 | * | 10/1999 | Nagura et al. | 340/933 |

FOREIGN PATENT DOCUMENTS

| | | |
|---|---|---|
| 53-41249 | 4/1978 | (JP) . |
| 8-30893 | 2/1996 | (JP) . |
| 8-293080 | 11/1996 | (JP) . |
| 9-241469 | 9/1997 | (JP) . |

* cited by examiner

*Primary Examiner*—Edward Lefkowitz
*Assistant Examiner*—Davetta W. Goins
(74) *Attorney, Agent, or Firm*—Pillsbury Madison & Sutro LLP

(57) ABSTRACT

A class of a vehicle (VHC) is judged from distance data obtained by scanning on a lane with at least a laser beam in the longitudinal direction LD of the lane, wherein the scanning line may be inclined. Distance data may be further obtained in the width direction to provide more accurate judgement. The LD measurement unit may be swinged with the VHC position in the width direction. The outline of the VHC is detected by obtaining characteristic points from the distance data. The number of axles may be detected by slantwise scanning from an upper right or left position above the lane. Successive partial distance images with offsets can be combined to provide combined outline of the VHC to detect the class. A communication (COMM) unit may be provided to receive ID data, class data of VHC, owner data from the removable VHC COMM unit mounted on the VHC. Correspondence between the VHC COMM unit and the VHC is judged when the start timing of COMM with the COMM unit agrees with a timing predicted from the front shield glass position from the detected shape of the VHC and the speed. Unrighteous travelling is judged when the judged class disagrees with the class data from the COMM unit. A toll system for requesting the toll determined according to the determined class is also disclosed.

38 Claims, 45 Drawing Sheets

VARIATION OF CHR POINT
IN LONGITUDINAL DIR MEASURMENT

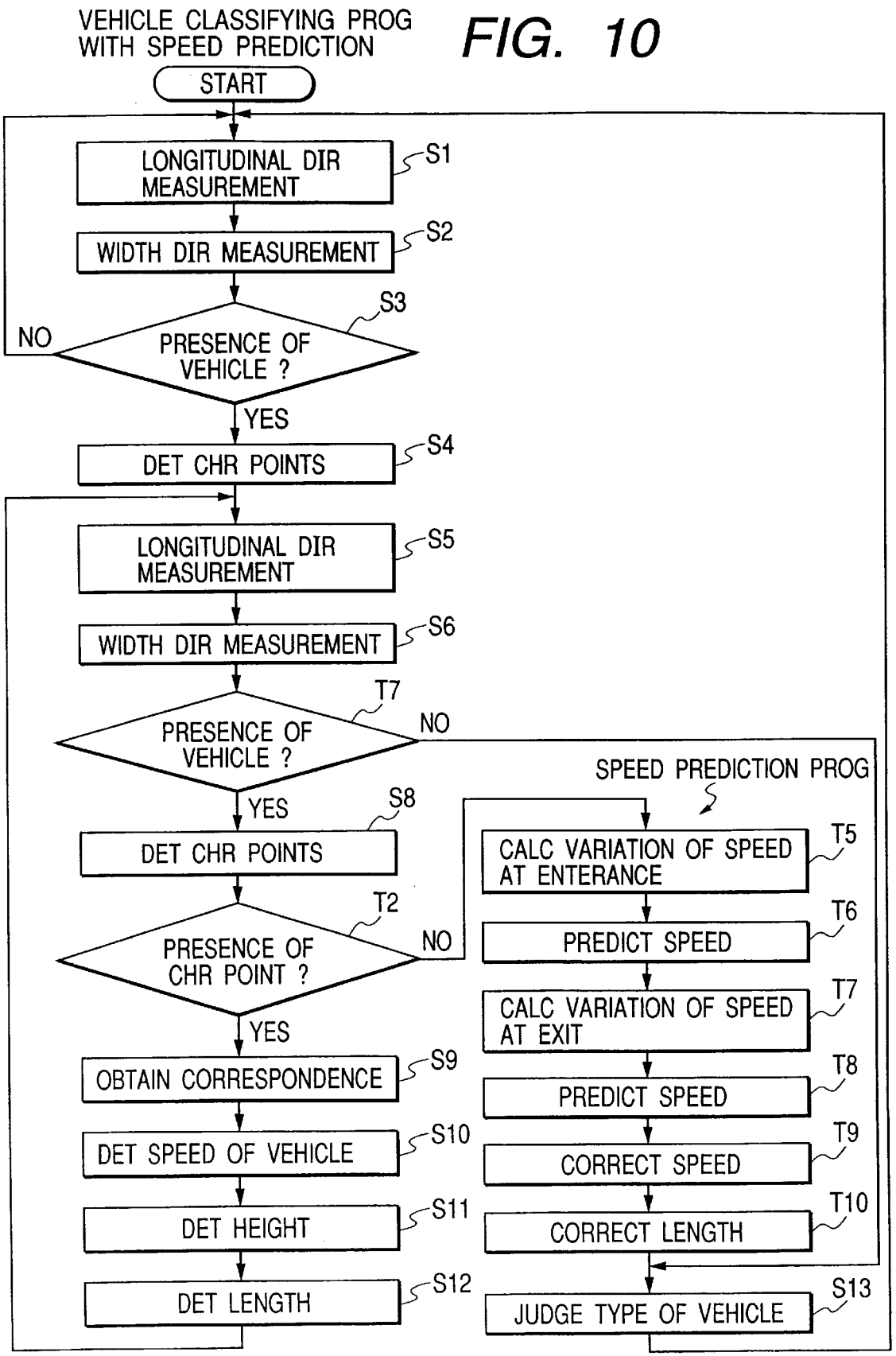
VEHICLE CLASSIFYING PROG WITH SPEED PREDICTION
FIG. 10
START
LONGITUDINAL DIR MEASUREMENT
S1
WIDTH DIR MEASUREMENT
S2
PRESENCE OF VEHICLE ?
S3
NO
YES
DET CHR POINTS
S4
LONGITUDINAL DIR MEASUREMENT
S5
WIDTH DIR MEASUREMENT
S6
PRESENCE OF VEHICLE ?
T7
NO
YES
DET CHR POINTS
S8
PRESENCE OF CHR POINT ?
T2
NO
YES
OBTAIN CORRESPONDENCE
S9
DET SPEED OF VEHICLE
S10
DET HEIGHT
S11
DET LENGTH
S12
SPEED PREDICTION PROG
CALC VARIATION OF SPEED AT ENTERANCE
T5
PREDICT SPEED
T6
CALC VARIATION OF SPEED AT EXIT
T7
PREDICT SPEED
T8
CORRECT SPEED
T9
CORRECT LENGTH
T10
JUDGE TYPE OF VEHICLE
S13

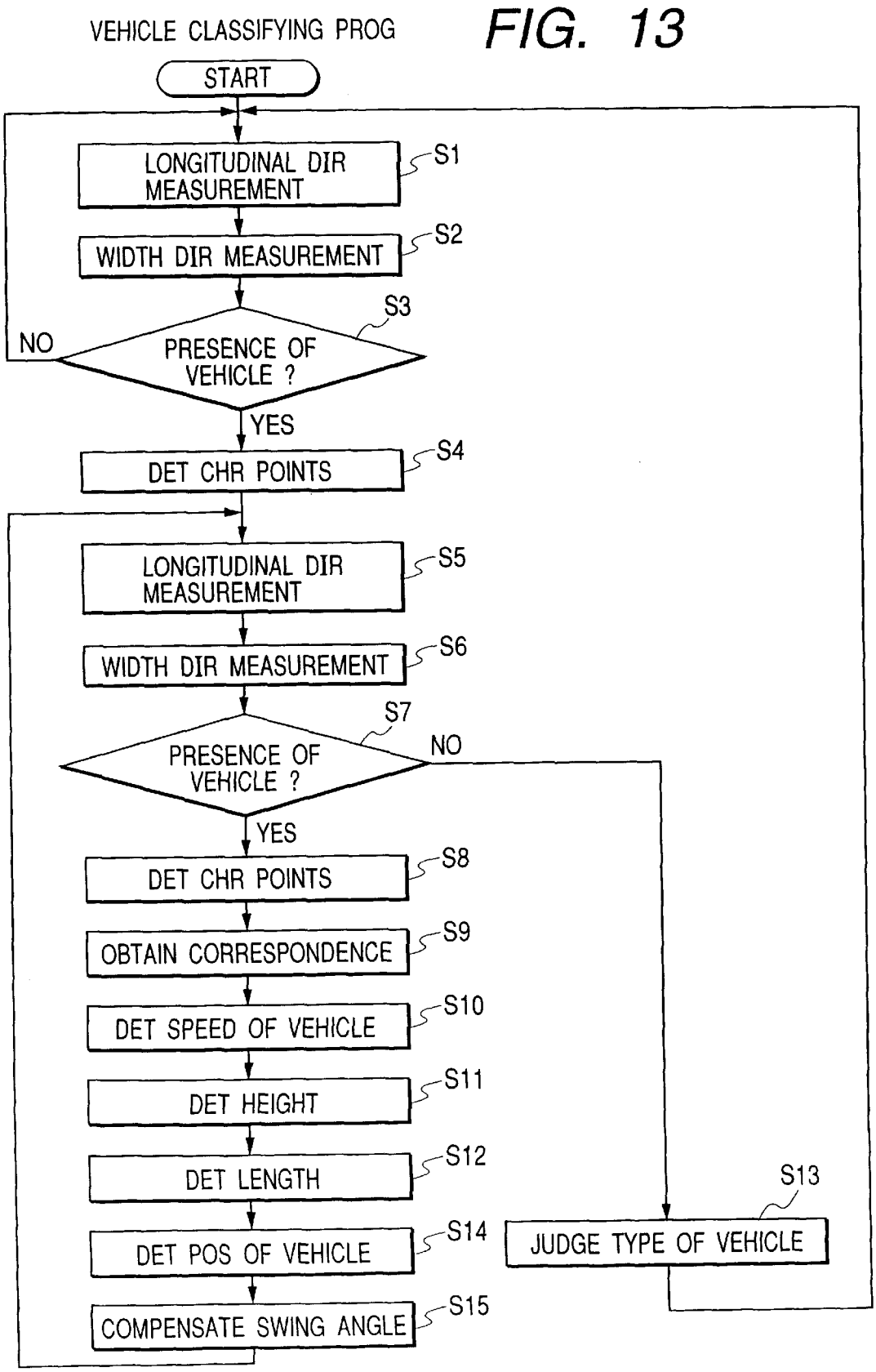
VEHICLE CLASSIFYING PROG
FIG. 13
START
LONGITUDINAL DIR MEASUREMENT
S1
WIDTH DIR MEASUREMENT
S2
S3
NO
PRESENCE OF VEHICLE ?
YES
DET CHR POINTS
S4
LONGITUDINAL DIR MEASUREMENT
S5
WIDTH DIR MEASUREMENT
S6
S7
PRESENCE OF VEHICLE ?
NO
YES
DET CHR POINTS
S8
OBTAIN CORRESPONDENCE
S9
DET SPEED OF VEHICLE
S10
DET HEIGHT
S11
DET LENGTH
S12
S13
DET POS OF VEHICLE
S14
JUDGE TYPE OF VEHICLE
COMPENSATE SWING ANGLE
S15

DATA COMBINING PROC

RESULT OF COMBINING

VEHICLE CLASSIFYING APPARATUS AND A TOLL SYSTEM

BACKGROUND OF THE INVENTION

1. Field of the Invention

This invention relates to a vehicle classifying apparatus for classifying a vehicle passing therethrough and a toll system including the same for requesting a toll in accordance the class.

2. Description of the Prior Art

A vehicle classifying apparatus for classifying the vehicle passing the sensor with the velocity and three dimensional profile determined with pulsed laser beam is known.

The vehicle classifying apparatus is provided to on a highway at a toll gate to automatically issue a note representing the class of the vehicle or the like. Moreover, in the automatically tolling system, the class (type) of the vehicle is detected. Such a vehicle classifying apparatus is disclosed in U.S. Pat. No 5,546,188.

FIG. 49 is a perspective view of such a prior art vehicle classifying apparatus. A vehicle classifying unit 10 is provided to a beam of gantry 13 for each lane at a highway toll gate. The vehicle classifying unit 10 confronts the lane 11 and emits laser beams Xa and Xb in width direction of the lane 11 with a predetermined interval to provide scanning lines La and Lb.

The laser beams Xa and Xb are emitted as pulses. Delay between the emitting timing and the receiving timing is detected to measure a distance. When an object having a height passes therethrough, the detected distance varies, so that the vehicle passing therethrough can be detected. The speed of the vehicle 14 is detected from the detected time interval that a portion of the vehicle 14 passing through a distance 5. The length of the vehicle 14 is predicted from the detected time interval necessary for passage of the top to the end of the vehicle 14 and the detected speed.

SUMMARY OF THE INVENTION

The aim of the present invention is to provide an improved vehicle classifying apparatus and an improved toll system.

According to the present invention a first vehicle classifying apparatus is provided which comprises: a beam signal generation unit for generating a beam signal; a scanning unit, arranged at a predetermined position above a detection zone on a lane on which a vehicle to be classified travels, for emitting the beam signal with the beam signal scanned toward the detection zone along a scanning line inclined by a predetermined angle to a longitudinal direction of the lane; a receiving unit for receiving the beam signal reflected by the vehicle at the detection zone through the scanning unit; a distance detection circuit, including a memory, for detecting a delay time between the emission of the beam signal and reception of the beam signal, determining a distance between the scanning unit and the vehicle within the detection zone in accordance with the detected delay time, and outputting distance data indicative of the distance; and a classifying function responsive to the distance detection circuit for classifying the vehicle in accordance with the distance data and outputting the classified result.

In the first vehicle classifying apparatus, the predetermined angel may be zero. The first vehicle classifying apparatus may further includes: a characteristic point detection function for detecting characteristic points of an outline of the vehicle from the distance data; a correspondence detection function for detecting correspondence between previously detected first characteristic points and presently detected second characteristic points including a part of the first characteristic points; a characteristic point combining function for combining the first characteristic points with the second characteristic points in accordance with the detected correspondence.

In the first vehicle classifying apparatus, the angle may be an intermediate angle between the longitudinal direction and a width direction of the lane.

In the first vehicle classifying apparatus, the classifying function may detect a shape of an outline of the vehicle in the longitudinal direction.

The first vehicle classifying apparatus may further includes: a characteristic point detection function for detecting characteristic points of an outline of the vehicle from the distance data; a vehicle speed detection function responsive to the characteristic point detection function for detecting movement of the characteristic points, determining an instantaneous speed of the vehicle in accordance the detected movement, and outputting data of the instantaneous speed.

In this case, the vehicle speed variation detection function may detect a travelling speed of the vehicle within the detection zone in accordance with the detected movement.

Moreover, a vehicle speed variation detection function may be further provided which detects movement speed of the characteristic points, detects a variation of the travelling speed within the detection zone in accordance with the detected movement, and outputs data of the variation. In this case, the vehicle classifying function detects a shape of an outline of the vehicle in the longitudinal direction, the vehicle speed detection function detects an interval for which the movement of the characteristic points cannot be continuously detected; the vehicle classifying apparatus further comprising speed estimation function for estimating the travelling speed of the vehicle in accordance with the travelling speed and the variation detected before the interval and in accordance with the travelling speed and the variation after the interval.

Moreover, the classifying function may detect a shape of an outline of the vehicle in the longitudinal direction, the vehicle speed detection function detects an interval for which the movement of the characteristic point cannot be continuously detected, wherein the vehicle classifying apparatus may further include a speed estimation function for estimating the travelling speed of the vehicle in accordance with the travelling speed and the variation detected before the interval and in accordance with the travelling speed and the variation after the interval with assumption that the travelling speed varies successively.

The first vehicle classifying apparatus may further include an orthogonal component detection function for detecting characteristic points in a width direction perpendicular to the lane and width detection function for detecting a width of the vehicle from the detected characteristic points in the width direction.

The first vehicle classifying apparatus may further include, as second vehicle classifying apparatus; a second beam signal generation unit for generating a second beam signal; a second scanning unit, arranged at a second predetermined position above the detection zone on the lane, for emitting the second beam signal with the second beam signal scanned toward the detection zone along a second scanning line inclined to the longitudinal direction; a second receiving unit for receiving the second beam signal reflected by the vehicle through the second scanning unit; and a second distance detection circuit including a second memory for detecting a second delay time between a third timing when the second beam signal is emitted and a fourth timing when the second beam signal is received and determining a second distance between the second scanning unit and the vehicle in accordance with the detected second delay time and outputting second distance data indicative of the second distance, wherein the vehicle classifying function classifies the vehicle in accordance with the distance data and the second distance data.

In the second vehicle classifying apparatus, the direction of the second scanning line is different from the direction of the scanning line.

In the second vehicle classifying apparatus, the second scanning line may be perpendicular to the longitudinal direction.

In the second vehicle classifying apparatus, the second scanning line is perpendicular to the longitudinal direction and the predetermined angle may be zero. In this case, the vehicle classifying apparatus may further include a vehicle position judging function responsive to the second distance detection circuit for judging a position of the vehicle along the second scanning line, a case for supporting the beam signal generation unit, a scanning unit, and a receiving unit, and a swing unit for swing the case in accordance with the detected position to positions said scanning line at the detected position.

The first vehicle classifying apparatus may further include, as a third vehicle classifying apparatus, a second beam signal generation unit for generating a second beam signal, a second scanning unit, arranged at a second predetermined position above the detection zone on the lane, for emitting the second beam signal such that a side of the vehicle is scanned with the second beam signal on a second scanning line perpendicular to the longitudinal direction, a second receiving unit arranged adjacent to the second scanning unit for receiving the second beam signal reflected by the vehicle through the second scanning unit; a second distance detection circuit including a memory for detecting a second delay time between a third timing when the second beam signal is emitted and a fourth timing when the second beam signal is received and determining a second distance between the second scanning unit and the vehicle in accordance with the detected second delay time, and a tire detection function for detecting a tire of the vehicle in accordance with the second data. In this case, the number of axle detection function for detecting the number of axles of the vehicle in accordance with the result of the tire detection function may be further provided.

According to the present invention, a fourth vehicle classifying apparatus is provided which comprises: a communication circuit for communicating with a vehicle communication unit to be mounted on a vehicle travelling on a lane and receiving data of the communication unit within a communication zone, the data including identification data; a timing detection circuit for detecting a first timing when the vehicle communication unit starts communicating with the communication circuit; a distance data image detection circuit for detecting distance data image on the lane within detection zone substantially agreeing with the communication zone to detect distance data image of the vehicle in time base and detecting a speed of the vehicle; a position judging circuit for judging a position of the communication unit to be positioned at the vehicle from the detected the distance data image of the vehicle; a timing operation circuit for operating a second timing when the communication circuit is to be communicated with the communication unit from the speed of the vehicle and the position; and a judging circuit for judging whether the vehicle communication unit corresponds to the vehicle in accordance with the first and second timings and outputting the judging result.

In the fourth vehicle classifying apparatus, the judging circuit comprises a difference operating circuit for operating a difference between the first and second timings and a comparing circuit for comparing the difference with a reference and judges that the vehicle communication unit corresponds to the vehicles as that the vehicle communication unit is mounted on the vehicle in accordance with the comparing result.

The fourth vehicle classifying may further comprise a reference varying circuit for varying the reference in inverse proportion to the speed.

In the fourth vehicle classifying apparatus, the communication circuit communicates with the vehicle with a microwave signal within the communication zone, the distance data image detection circuit optically detects the distance data image on the lane within the detection zone, and the communication zone three-dimensionally agrees with the detection zone.

In the fourth vehicle classifying apparatus, the distance data detection circuit comprises a laser scanning unit for emitting a laser beam for scanning and receiving the reflected laser light, and obtaining distance data image from the delay of emitting the laser beam and receiving the reflected laser light.

The fourth vehicle classifying apparatus may further comprise historic data storing circuit for storing data of the first timing as historic data of the vehicle communication unit and the judging circuit judges that the vehicle communication unit corresponds to the vehicle in accordance with the first timing and the historic data as the second timing.

The vehicle classifying apparatus may further comprise an unrighteous judging circuit for judging unrighteous travelling of the vehicle on the lane in accordance with the judging result of the judging circuit when the vehicle communication unit does not correspond to the vehicle and outputting the unrighteous judging result.

The fourth vehicle classifying apparatus may further comprise a vehicle classifying circuit for classifying the vehicle from the distance data image, wherein the data further includes class data which is to be correspondent to the class of the vehicle and the unrighteous judging circuit further judges the unrighteous when the class of the vehicle classified by the vehicle classifying circuit disagrees with the class data from the communication circuit.

In the fourth vehicle classifying apparatus, the position judging circuit judges a front shield position of the vehicle from the detected distance data image and a;judges the position of the communication unit adjacent to the front shield position.

According to the present invention, a toll system is provided, which comprises: a vehicle classifying apparatus circuit including: a communication circuit for communicating with a vehicle communication unit to be mounted on a vehicle travelling on a lane and receiving data of the communication unit within a communication zone, the data including identification data; a timing detection circuit for detecting a first timing when the vehicle communication unit starts communicating with the communication circuit; a distance data image detection circuit for detecting distance data image on the lane within detection zone substantially agreeing with the communication zone to detect distance data image of the vehicle in time base and detecting a speed of the vehicle; a position judging circuit for judging a position of the communication unit to be positioned at the vehicle from the detected the distance data image of the vehicle; a timing operation circuit for operating a second timing when the communication circuit is to be communicated with the communication unit from the speed of the vehicle and the position; and a judging circuit for judging whether the vehicle communication unit corresponds to the vehicle in accordance with the first and second timings and outputting the judging result; a determining circuit for determining a toll of the vehicle; and a demanding circuit for demanding payment of the toll from a person.

BRIEF DESCRIPTION OF THE DRAWINGS

The object and features of the present invention will become more readily apparent from the following detailed description taken in conjunction with the accompanying drawings in which:

FIG. 10 depicts a flow chart of the first embodiment showing a speed prediction program together with the vehicle classifying program shown in FIG. 5;

FIG. 13 depicts a flow chart of the second embodiment showing the vehicle classifying operation;

FIGS. 43B and 43C are timing charts of the seventh embodiment showing vehicle detection in the second example;

FIG. 43D is a timing chart of the seventh embodiment showing a communication timing in the second example;

The same or corresponding elements or parts are designated with like references throughout the drawings.

DETAILED DESCRIPTION OF THE INVENTION

First Embodiment

A first embodiment will be described with reference to FIGS. 1 to 11.

Figure 1:
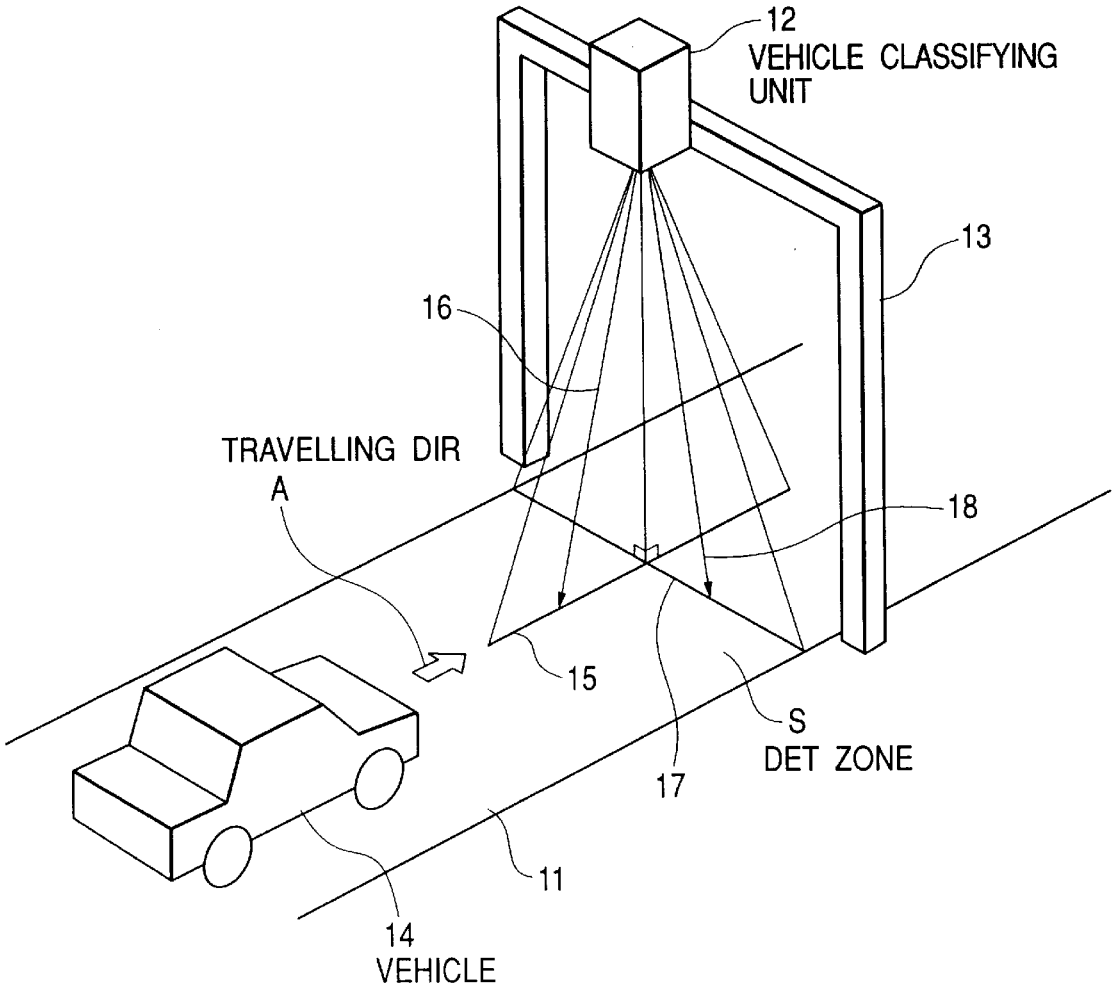
FIG. 1 is a perspective view of a vehicle classifying apparatus of a first embodiment.

FIG. 1 is a perspective view of the vehicle classifying apparatus of the first embodiment. The vehicle classifying unit 12 supported by a gantry 13 is provided on a lane 11 of the highway as the vehicle classifying apparatus for a toll gate system. The vehicle classifying unit 12 is arranged above the lane 11 by the gantry 13 such that laser beams 16 and 18 are directed to the lane 11 to provide a detection zone S. It is assumed that a vehicle 14 to be detected travels on the lane 11 in a travelling direction A. The lane 11 has a width to allow only one vehicle having at least four wheels to pass therethrough except a motorcycle.

The vehicle classifying unit 12 scans the laser beam 16 on the detection zone S along a scanning line 15 in the travelling direction A and scans the laser beam 18 on the detection zone S along a scanning line 17 perpendicular to the travelling direction A, i.e., in the width direction. The laser beams 16 and 18 alternately scan the detection zone S every scanning cycle and each of laser beams 16 and 18 is periodically emitted as a pulse every predetermined repetition interval every scanning cycle.

Figure 2:
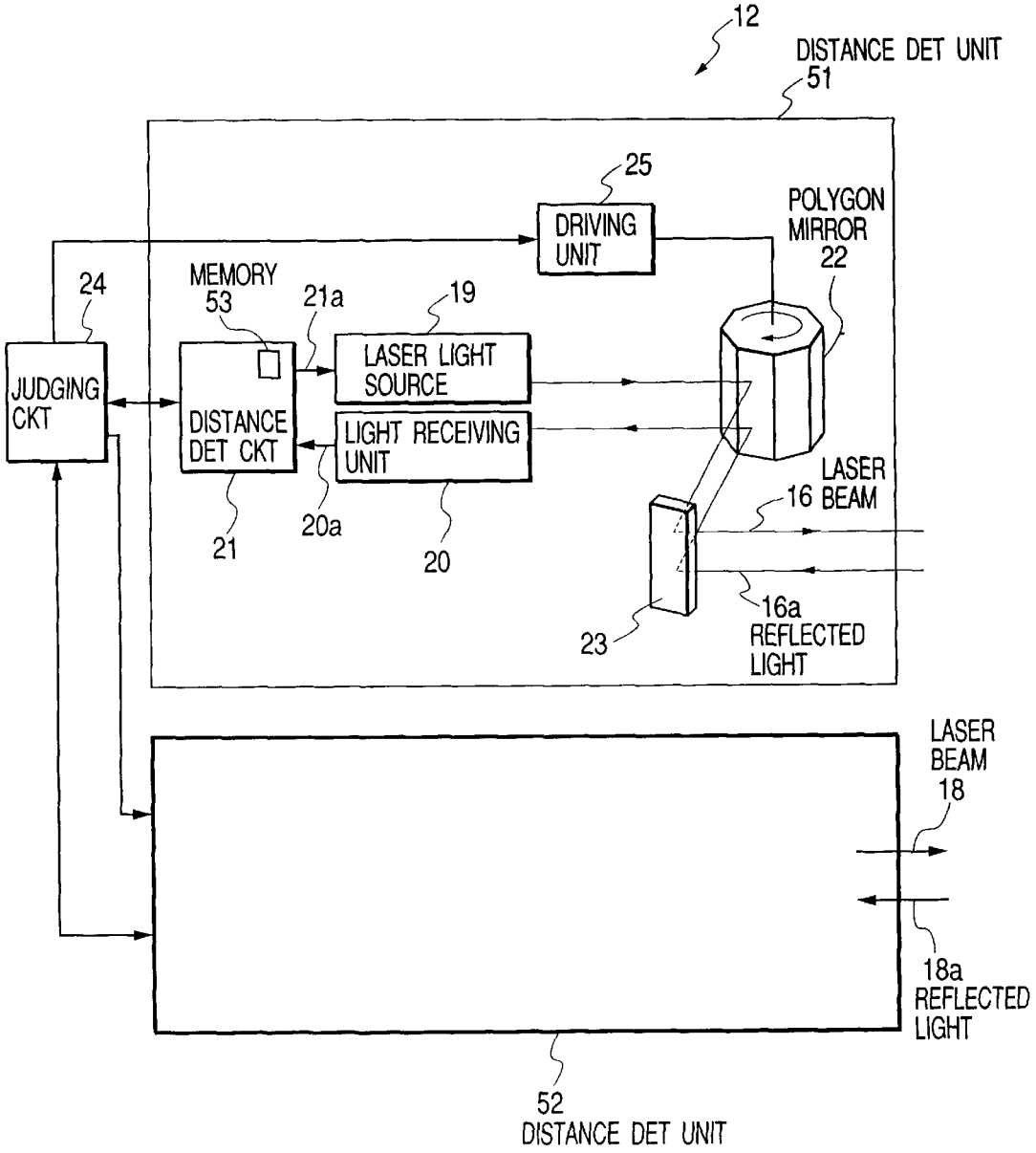
FIG. 2 is a block diagram of vehicle classifying unit of the first embodiment.

FIG. 2 is a block diagram of vehicle classifying unit 12 of the first embodiment.

The vehicle classifying unit 12 includes a control circuit 24, a first distance detection unit 51 for emitting the laser beam 16 and receives reflected light 16*a* to detect a distance to the lane 11 and the vehicle 14, and a second distance detection unit 52 for emitting the laser beam 18 and receives the reflected light 18*a* to detect a distance to the lane 11 and the vehicle 14.

Each of the distance detection units 51 and 52 includes a distance detection circuit 21, a laser light source 19 for emitting the laser beam 16 as a pulsed laser beam, a polygon mirror unit 22 having a plurality of mirrors circumferentially arranged for reflecting the laser beam with deflecting the laser beam 16 (18) and a mirror 23 for reflecting and directing the laser beam 16 (18) toward the detection zone S and reflecting the reflected light 16*a* (18*a*) from the detection zone S and directing the reflected light 16*a* to the polygon mirror 22, a light receiving unit 20 for receiving the reflected light 16*a* (18*a*) from the mirror 23 via the polygon mirror 22 and supplying a reception signal 20*a* to the distance detection circuit 21, and a driving unit 25 for rotating the polygon mirror unit 22 at a predetermined rotating speed.

The laser light source 19 emits the laser beam 16 (18) as a pulsed laser beam every predetermined duration every scanning cycle in response to a driving pulse from the distance detection circuit 21. The light receiving unit 20 receives the laser light reflected by the lane 11 or the vehicle 14. The distance detection circuit 21 detects the distance from the vehicle classifying unit 12 to the lane 11 or the vehicle 14 from a delay time td between the timing when the light beam 16 is emitted and the timing when the reflected light 16*a* is received. The distance detection circuit 21 further includes a memory 53 for storing data of the detected distance, i.e., distance data in the scanning lines 15 and 17 to provide distance data image of the vehicle 14 on the lane 11 in time base.

The control circuit 24 controls the driving unit 25 and the distance detection circuit 21 in each of the distance detection units 51 and 52 for synchronously scanning and classifies the vehicle, i.e., judges the type of the vehicle 14, in accordance with the distance data or distance data image from the distance detection circuit 21 of each of the distance detection units 51 and 52.

In the toll system using this vehicle classifying unit 12, there is a fixed communication unit (not shown in FIG. 1), arranged adjacent to the distance detection units 51 and 52, for communicating with a vehicle communication unit (not shown in FIG. 1) mounted on the vehicle 14 to receive an identification code (data) registered for the vehicle 14 or the vehicle communication unit, class data, and various data for collecting the toll of the highway. The vehicle classifying unit 12 is provided to confirm whether the class data of the vehicle agrees with the actual class (type) of the vehicle 14.

FIGS. 3A to 3D are timing charts showing the operation of the vehicle classifying unit 12.

Figure 3A:
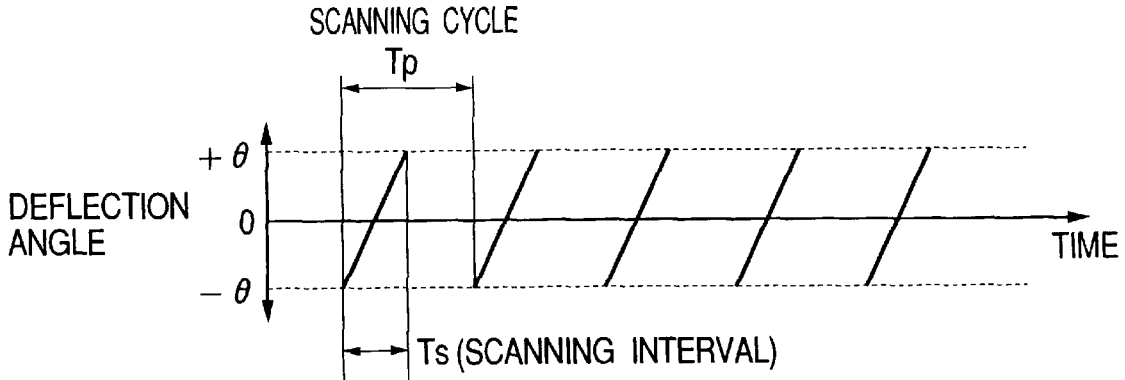
FIGS. 3A to 3D are timing charts of the first embodiment showing the operation of the vehicle classifying unit.
Figure 3B:
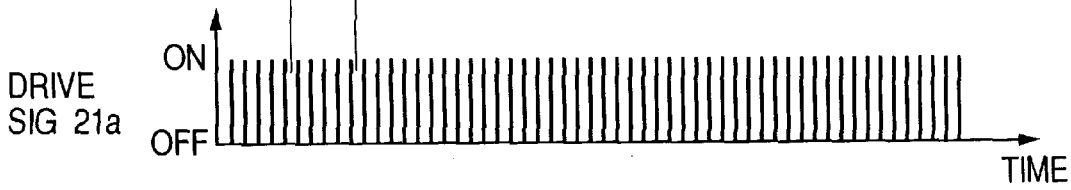

FIG. 3A shows the deflection angle of mirrors of the polygon mirror unit 22 in time base and FIG. 3B shows the driving signal 21*a* for the laser light source 19 to generate the laser beam 16 or 18 as the pulsed laser beam, wherein FIGS. 3A and 3B are shown in the same time base.

Figure 3C:
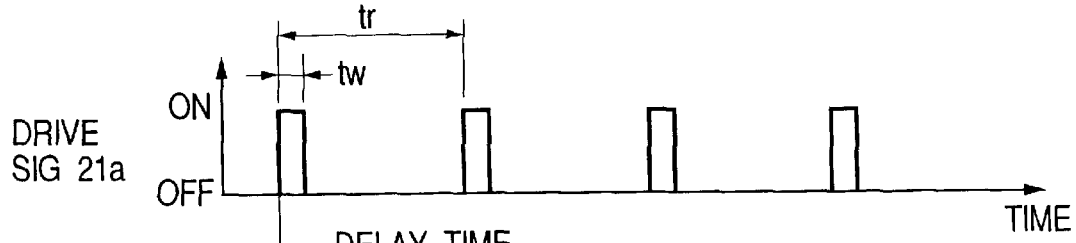
Figure 3D:
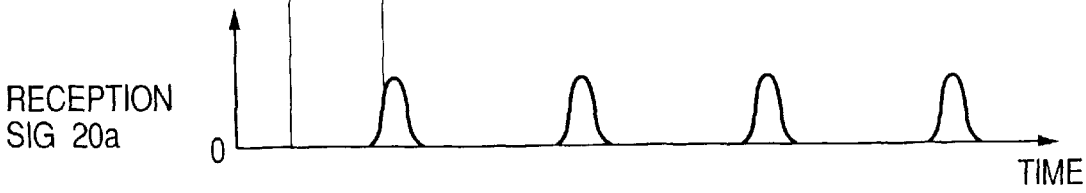

FIG. 3C also shows the drive signal with the time base enlarged. FIG. 3D shows the reception signal 20*a* from the light receiving unit 20 with the time base enlarged similarly.

The laser light source 19 emits the laser beam 16 or 18 in response to the drive signal 21*a* with the repetition interval tr with a pulse width tw. The reception signal 20*a* shows a delay time td from the timing when the drive signal 21*a* is supplied.

The distance detection circuit 21 detects the distance d between the vehicle classifying unit 12 to a target (the distance zone S or the vehicle 14) when twice the distance d agrees with the distance of loci of the laser beam 16 or 18 from the vehicle classifying unit 12 to the target and from the target to the vehicle classifying unit 12. Distanced d is given by the product of the delay time td with the velocity of light c ($=3\times10^8$ m/sec). That is, the distance $d=(c\times td)/2$.

As mentioned above, the detection zone S is scanned with the laser beams 16 and 18 in the scanning line 15 along the lane 11 and the scanning line 17 perpendicular to the scanning line 15. The target reflects the laser beams 16 and 18 and the light receiving units 20 receive the reflected light 16*a* and 18*a* and successively supply the reception signals 20*a* to the distance detection circuits 21. The scanning cycle Tp of the laser beams 16 and 18 and the scanning interval Ts is determined by the rotating speed of the polygon mirror 22 and the number of the mirrors on the polygon mirror, so that the resolution is determined by the repetition interval tr and the scanning interval Ts.

Figure 4A:
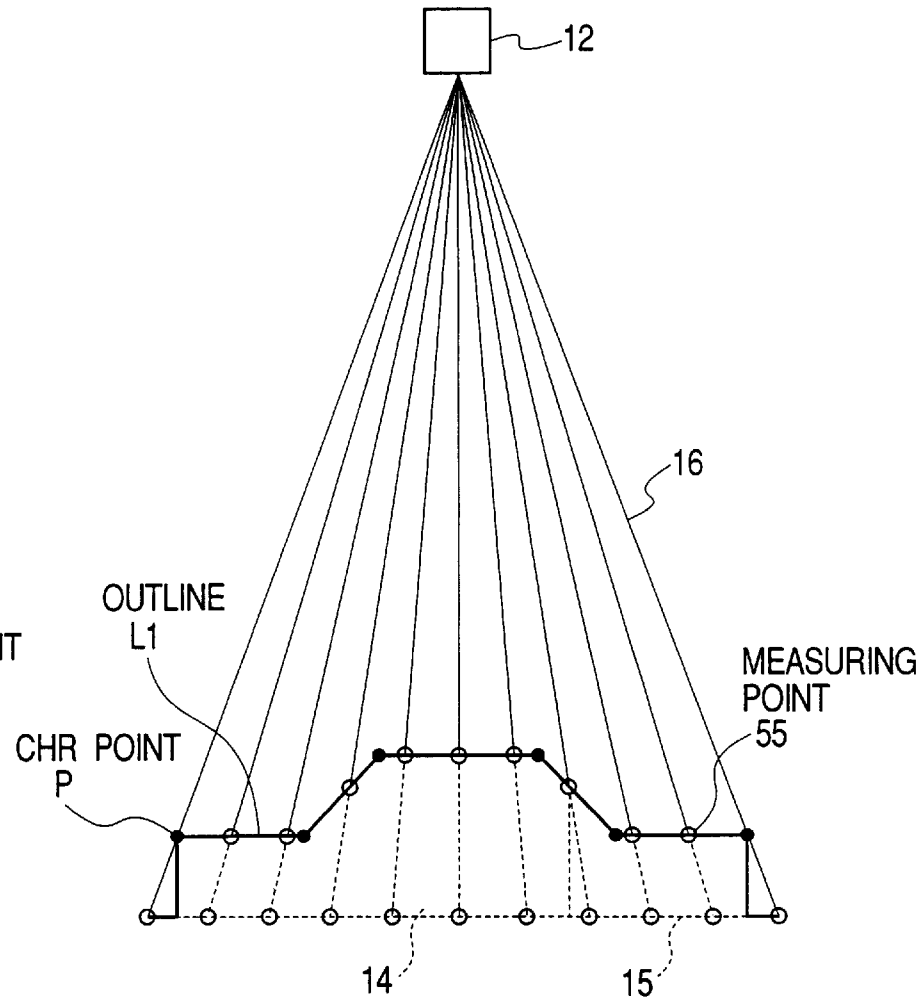
FIG. 4A is an illustration of the first embodiment showing the scanning operation along the lane.
Figure 4B:
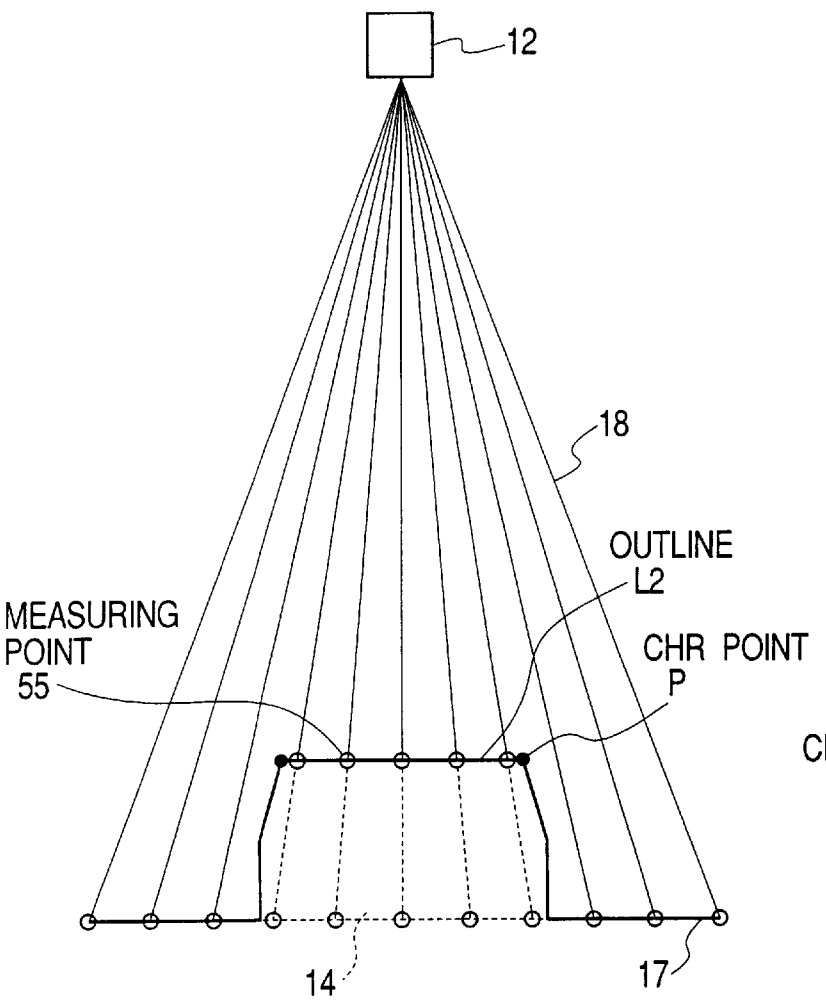
FIG. 4B is an illustration of the first embodiment showing the scanning operation along the scanning line perpendicular to the lane.

FIG. 4A is an illustration of the first embodiment showing the scanning operation along the lane 11 and FIG. 4B is an illustration of the first embodiment showing the scanning operation along the scanning line 17 perpendicular to the lane 11.

As shown in FIG. 4A, the distance detection circuit 21 of the first distance detection unit 51 obtains data of distance d with the laser beam 16 at respective measuring points 55 with the repetition interval tr along the scanning line 15 every scanning cycle Tp, which is referred to as "longitudinal direction measurement". Similarly, as shown in FIG. 4B, the distance detection circuit 21 of the second distance detection unit 52 obtains data of distance d at respective measuring points 55 with the laser beam 18 with the repetition interval tr along the scanning line 17 every scanning cycle Tp, which is referred to as "width direction measurement".

In this embodiment, in the width direction measurement, it is possible to obtain the data of distance d in the width direction along the longitudinal direction of the vehicle 14 every scanning cycle Tp. On the other hand, in the longitudinal direction measurement, only the portion of the vehicle moving above the center line of the lane 11 within the detection zone S can be detected.

Figure 5:
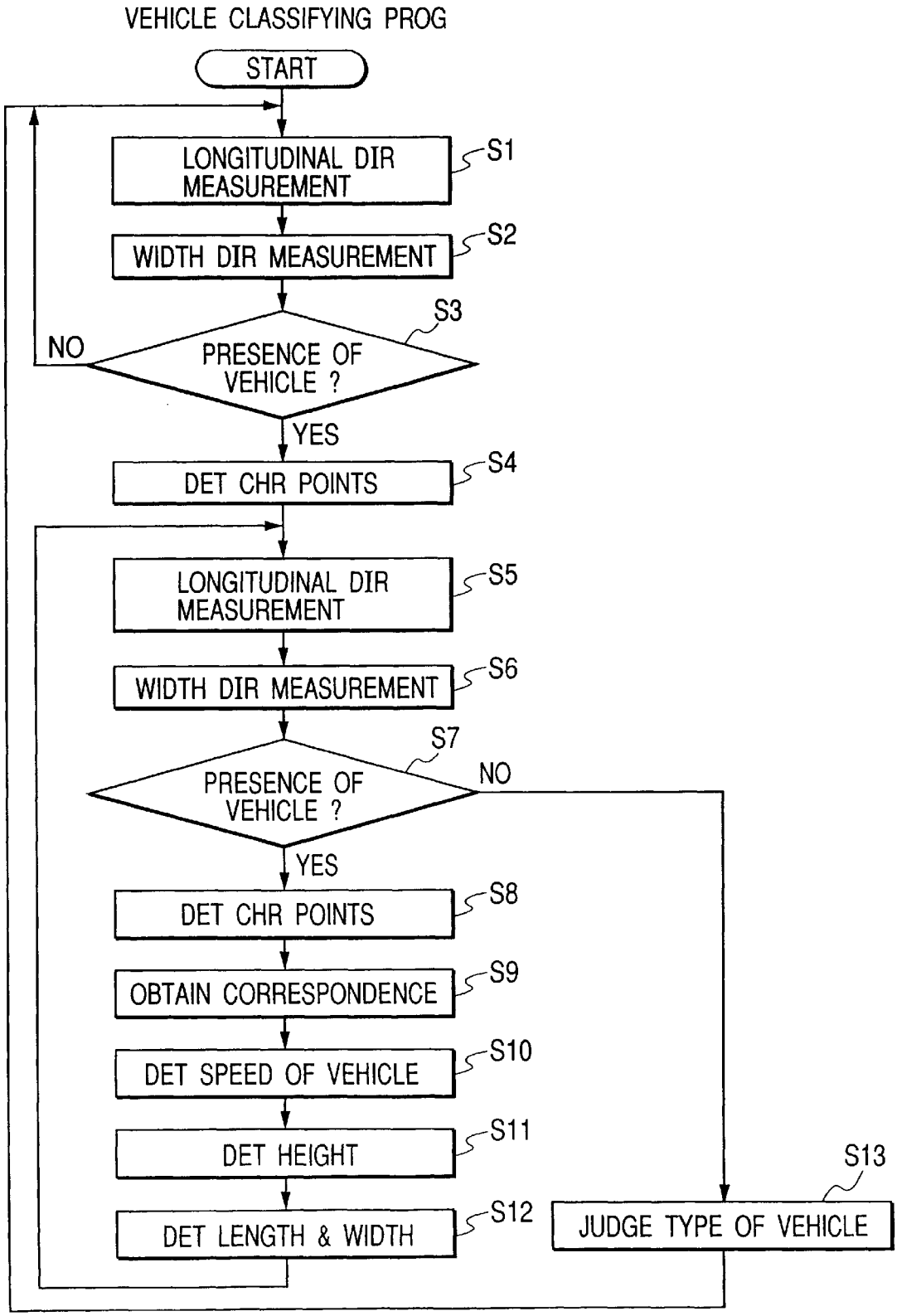
FIG. 5 depicts a flow chart of the first embodiment showing the vehicle classifying operation.

FIG. 5 depicts a flow chart of the first embodiment showing the vehicle classifying operation.

The control circuit 24 executes the vehicle classifying program as shown in FIG. 5.

At first, the control circuit 24 effects the longitudinal direction measurement in step S1. The control circuit 24 effects the width direction measurement in the following step S2 and judges whether the vehicle 14 to be detected is present in step S3 within the detection zone S. In the absence of the vehicle 14, processing loops around steps S1 to S3 until the vehicle 14 is detected. In the presence of the vehicle 14 in step S3, the control circuit 24 obtains an outline L1 along the scanning direction 15 and an outline shape L2 along the scanning direction 17 and obtains characteristic points P on the outline shapes L1 and L2 from the distance data from the longitudinal direction measurement and the width direction measurement in step S4. The characteristic point P is a singular point. Positions of the characteristic points P are also obtained from the outlines L1 and L2 as shown in FIGS. 4A and 4B (shown by solid dots in the drawing). In FIGS. 4A and 4B, it appears that it is difficult to detect the characteristic points P because intervals between the measuring points 55 is relatively long. In fact, the interval between the measuring points 55 is determined to be short to the extent that the characteristic points P can be surely detected.

Then, the control circuit 24 effects the longitudinal (travelling) direction measurement in step S5 and the width direction measurement in step S6 again. The control circuit 24 detects whether the vehicle 14 is present in step S7. In the presence of the vehicle 14, the control circuit 24 obtains characteristic points P and their position in the detection zone S in step S8. In the following step S9, the control circuit 24 obtains correspondence between the characteristic points P and the characteristic points P obtained in the previous longitudinal direction measurement and width direction measurement. The control circuit 24 obtains a travelling distance TD from the characteristic points P and the characteristic points P obtained in the previous longitudinal direction measurement and width direction measurement and calculates a speed of vehicle 14 in step S10. Then, the control circuit 24 obtains a height of the vehicle in step S11, a length and a width of the vehicle 14 in step S12 from the data of the outlines L1 and L2.

Figure 8:
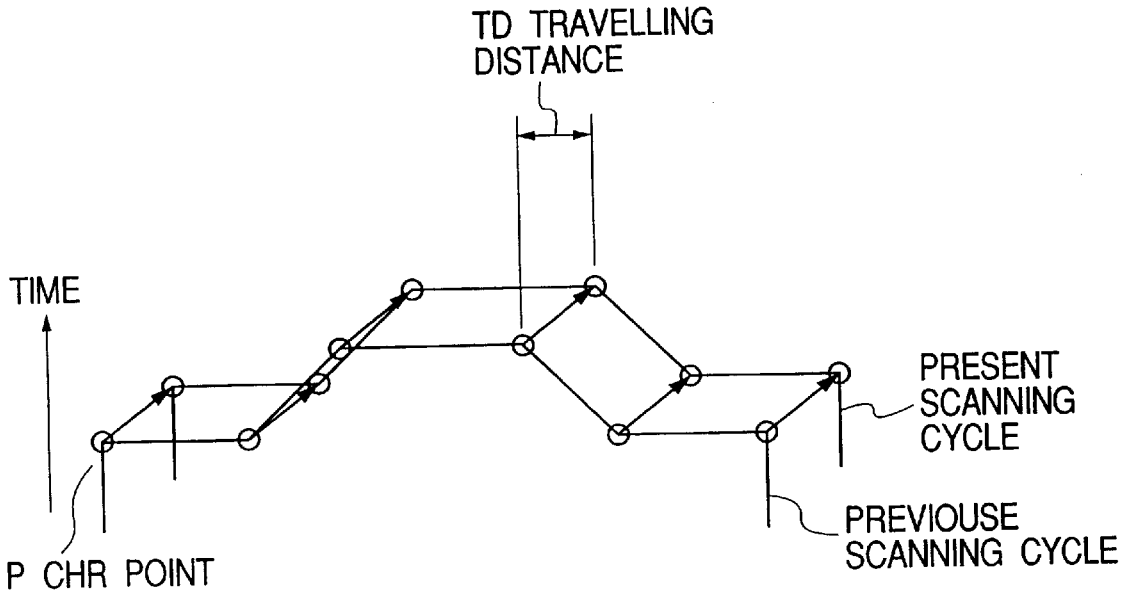
FIG. 8 is an illustration of the first embodiment showing the operation of obtaining the correspondence and the travelling distance.

FIG. 8 is an illustration of the first embodiment showing the operation of obtaining the correspondence and the travelling distance TD, i.e., the movement of characteristic points.

In obtaining the length of the vehicle 14, there is a possibility that the whole length of the vehicle 14 cannot be obtained from the measurement of only one scanning cycle. However, it is possible to combine characteristic points Pn of the present scanning cycle with characteristic point Pn−1 of the previous scanning cycle to obtain all of the outlines L1 because portions of the characteristic points Pn and Pn−1 have the correspondence which have been obtained in step S9.

Processing from the steps S5 to S12 is repeated until the control circuit 24 detects the absence of the vehicle 14 in step S7.

In the absence of the vehicle 14 in step S7, the control circuit 24 judges the type of (classifies) the vehicle 14 in accordance with the data obtained in this vehicle classifying program and reference data regarding classifying in step S13 and then, processing returns to step S1.

In classifying the vehicle 14, the length of the vehicle 14 can be obtained. However, if a trailer trailed by a trailer track with a coupler enters and if only the longitudinal direction is effected, there is a possibility that the control circuit 24 erroneously judges that there are two vehicle because the coupler may not be detected. However, in this embodiment, both the longitudinal direction measurement and the width direction measurement are effected, so that it is possible to detect the coupler and to judge that there are the trailing track and the trailer.

Figure 6A:
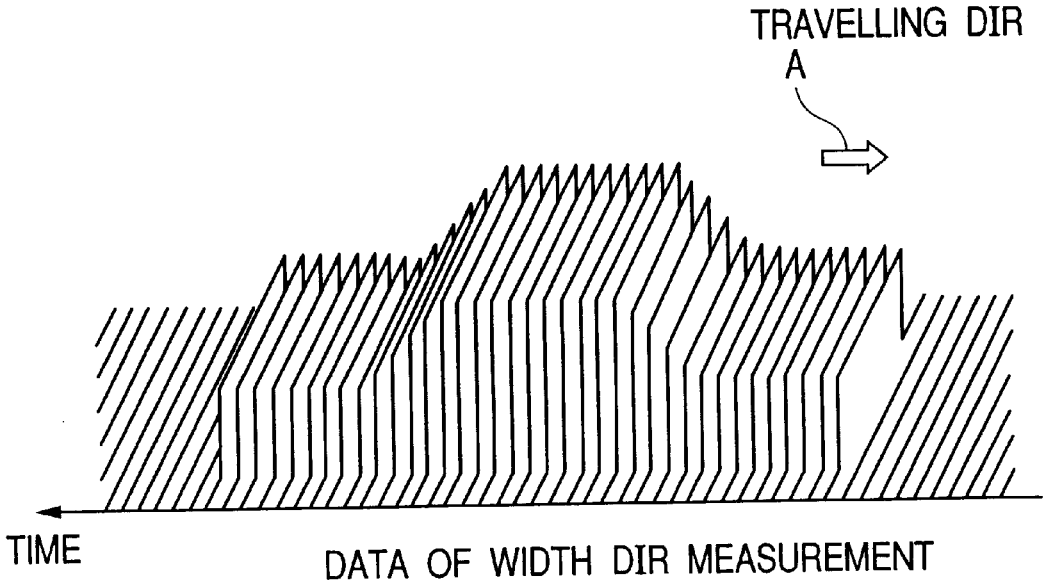
FIGS. 6A and 6B are graphical drawings of the first embodiment respectively showing the data of distance of the width direction measurement and that of the longitudinal direction measurement.
Figure 6B:
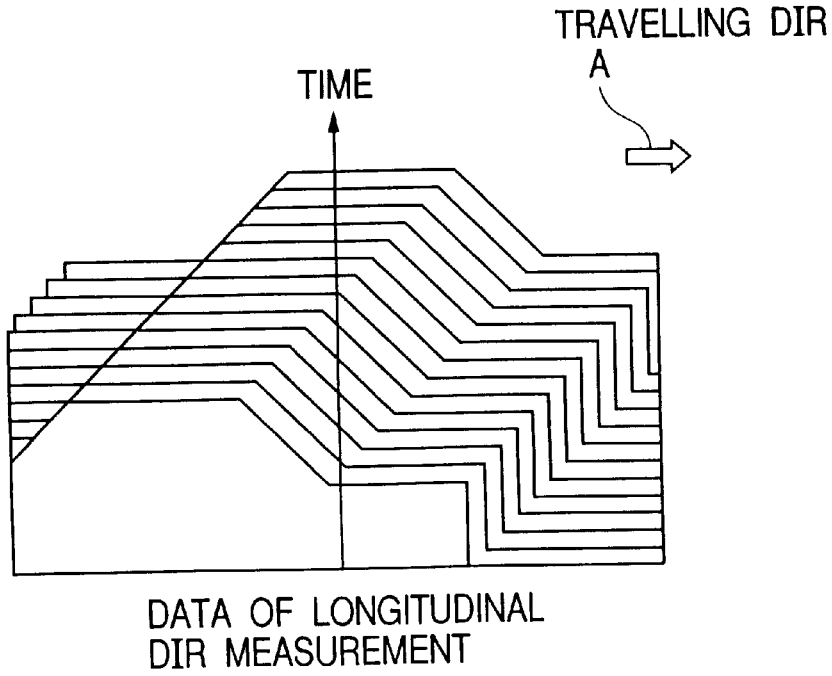

FIGS. 6A and 6B are graphical drawings of the first embodiment respectively showing the distance data of the width direction measurement and that of the longitudinal direction measurement.

Figure 7A:
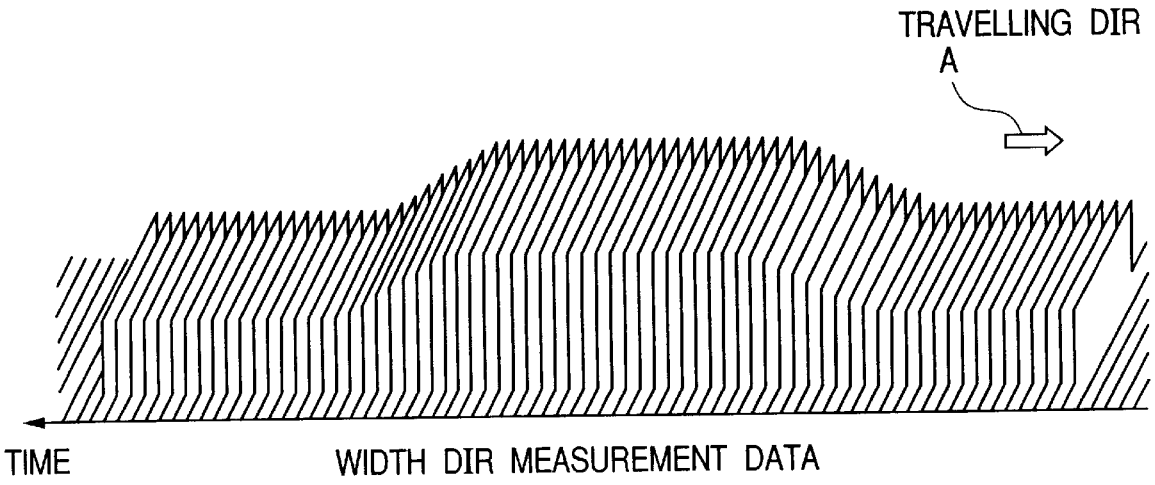
FIGS. 7A and 7B are graphical drawings of the first embodiment respectively showing the data of distance of the width direction measurement and that of the longitudinal direction measurement.
Figure 7B:
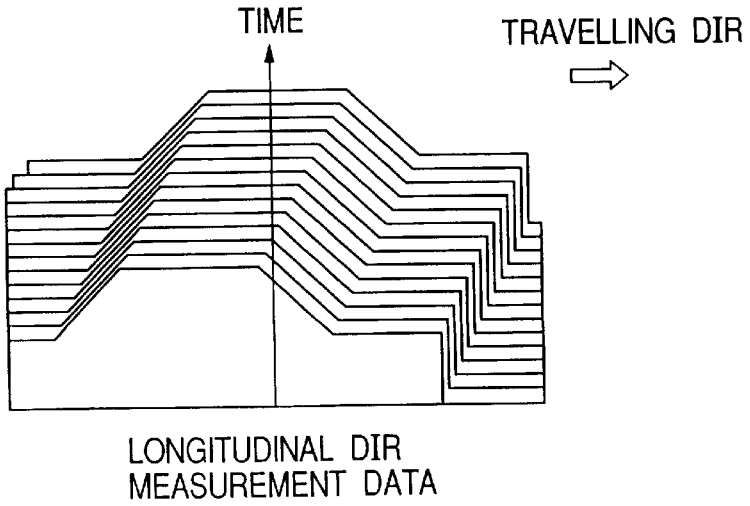

FIGS. 7A and 7B are also graphical drawings of the first embodiment respectively showing the distance data of the width direction measurement and that of the longitudinal direction measurement in time base, wherein the speed of the vehicle 14 in the case of FIGS. 6A and 6B is higher than that in the case of FIGS. 7A and 7B. In other words, when the vehicle 14 passes through the detection zone S at a certain speed, both the width direction measurement and the longitudinal direction measurement respectively provide data combined as distance data images as shown in FIGS. 6A and 6B with the passage of time. The distance data from the width direction measurement provides variation of the width in the outline L2 of the vehicle 14 with the passage of time and the longitudinal direction measurement provides variation of the length of the vehicle 14 with the passage of time.

On the other hand, the case that the vehicle 14 passes through the detection zone S at the speed lower than that in the case shown in FIGS. 6A and 6B, the distance data by the width direction measurement in FIG. 6B gives the impression that the length of the vehicle 14 is relatively longer because the travelling distance per one scanning cycle is low. On the other hand, the data from the longitudinal direction measurement in FIG. 7B provides the impression that the distance over which the vehicle moves for a predetermined interval. Therefore, the length of the vehicle 14 is determined from the data by the longitudinal direction measurement and the width of the vehicle 14 is determined from the data by the width direction measurement, so that accurate vehicle classifying can be provided.

Figure 9A:
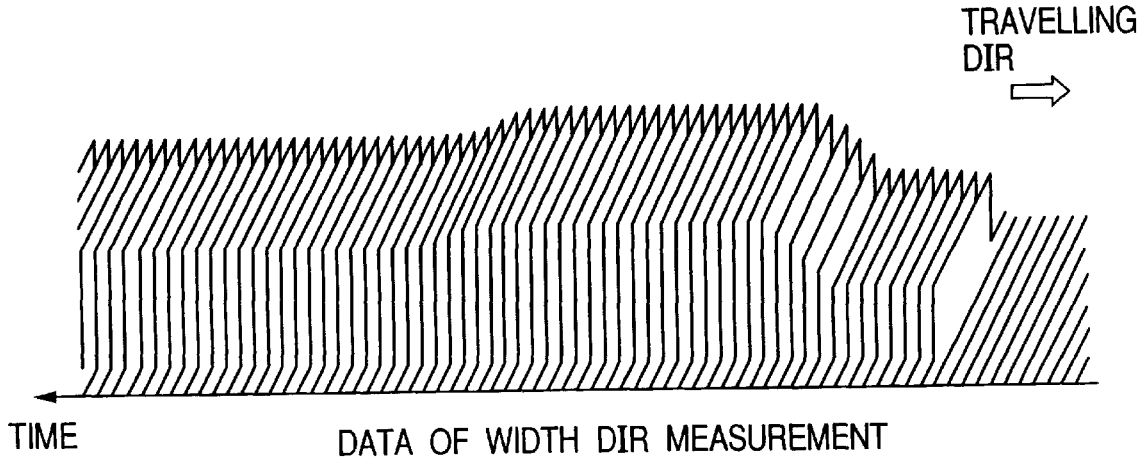
FIGS. 9A and 9B are graphical drawings of the first embodiment respectively showing the data of distance of the width direction measurement and that of the longitudinal direction measurement.
Figure 9B:
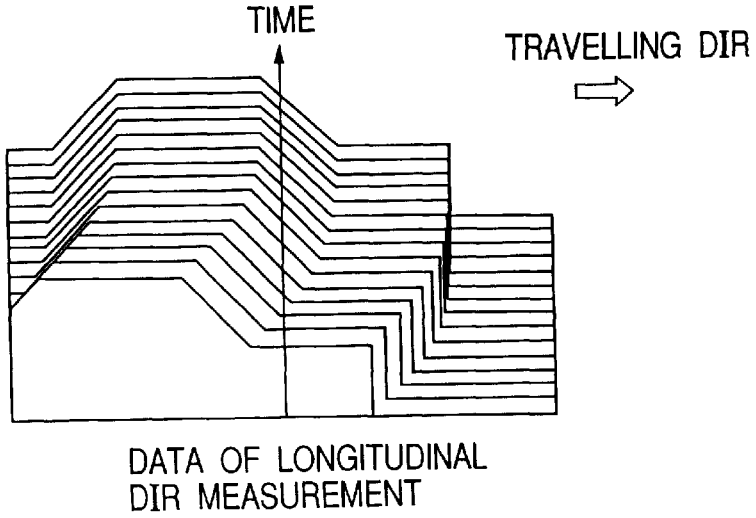

FIGS. 9A and 9B are graphical drawings of the first embodiment respectively showing the distance data image of the width direction measurement and that of the longitudinal direction measurement, wherein the speed of the vehicle 14 varies, that is, the driver operates the brake on the detection zone S.

In the cases shown in FIGS. 6A, 6B, 7A, and 7B, the speeds of the vehicle 14 passing through the detection zone S are assumed to be constant. However, there is the case that the speed of the vehicle 14 varies due to a traffic snarl. For example, if the driver operates the brake during passing the detection zone S, the data from the width direction measurement does not show variation when the vehicle 14 stops as shown in FIG. 9A. On the other hand, as shown in FIG. 9B, the distance data from the longitudinal direction measurement shows stopping of the vehicle, so that the type of the vehicle can be judged accurately.

Figure 11A:
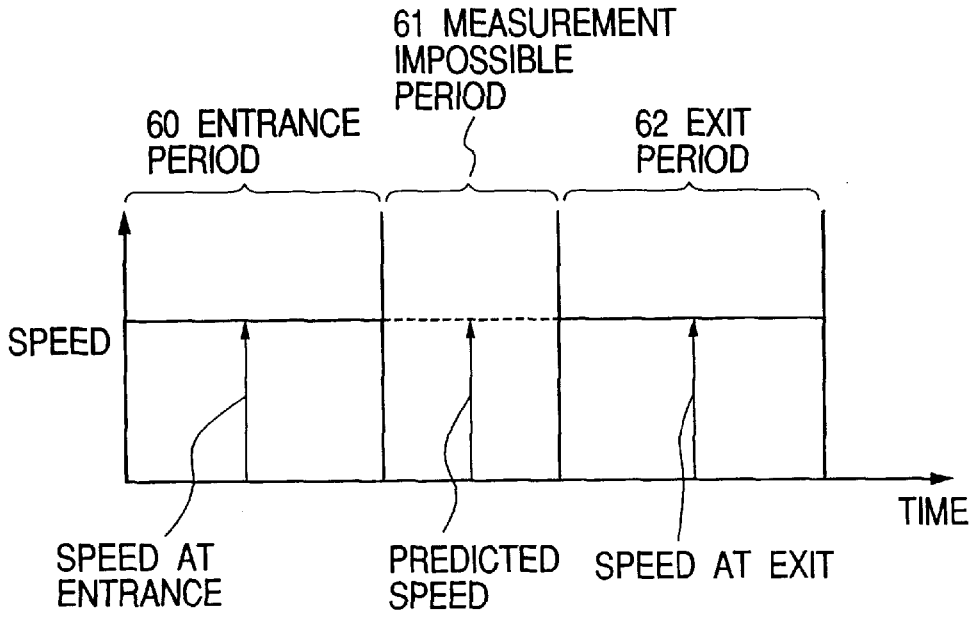
FIGS. 11A and 11B are graphical drawings of the first embodiment showing speed variation when the speed is constant and varied.
Figure 11B:
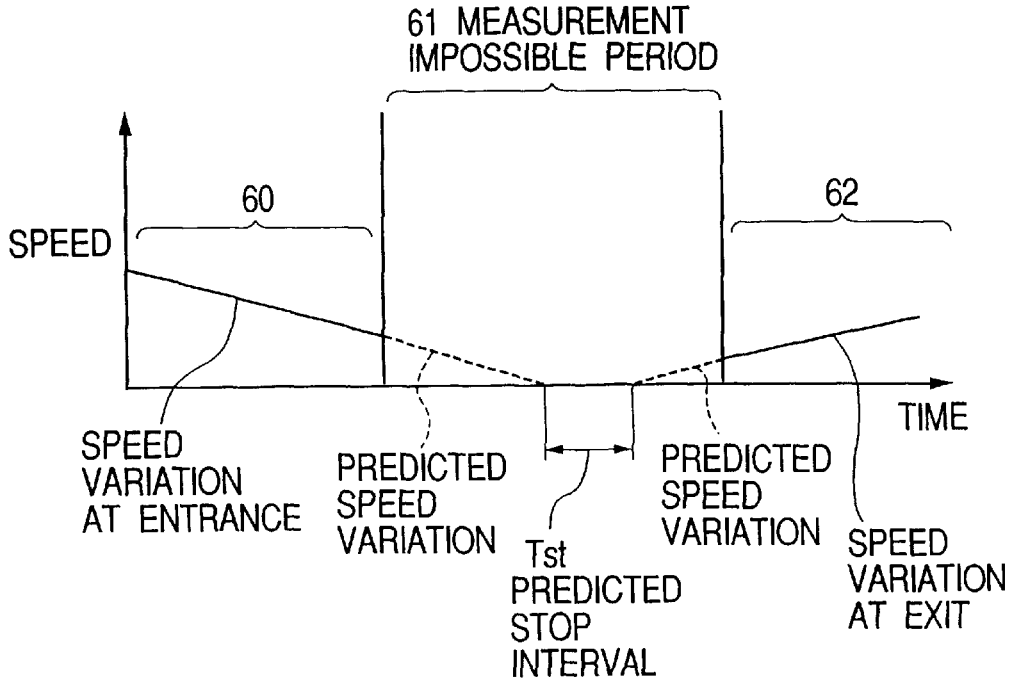

FIG. 10 depicts a flow chart of the first embodiment showing a speed prediction program together with the vehicle classifying program shown in FIG. 5. FIGS. 11A and 11B are graphical drawings of the first embodiment showing speed variation when the speed is constant and varied.

In the case that the length of the vehicle 14 is larger than the size of the detection zone S in the longitudinal direction and there is no characteristic point detected at the middle portion of the body of the vehicle, that is, a bus having a rectangular parallelepiped body. The speed prediction program shown in FIG. 10 is provided for classifying the vehicle 14 of which length is longer than the size of the detection zone S in the longitudinal direction and there is no characteristic points at the middle portion of its body.

The speed prediction program shown in FIG. 10 predicts the speed of the vehicle 14 while the middle portion passes through the detection zone S to correct the detected length.

In the step T2 following to step S8, the control circuit 24 judges whether there is characteristic point in the longitudinal direction measurement of the present scanning cycle. If there is a characteristic point, processing proceeds to step S9 and processing is executed as mentioned above. If there is no characteristic point in step T2, processing proceeds to step T5 to execute the speed prediction program.

In step T5, the control circuit 24 calculates a variation of the speed when the vehicle 14 enters the detection zone S to detect acceleration of the vehicle 14 at the entrance from the data obtained previous scanning cycle. The control circuit 24 predicts the speed of the vehicle 14 for the measurement impossible period 61 with assumption made such that the acceleration does not rapidly change during the measurement impossible period 61 in step T6.

Then, the control circuit 24 calculates variation of the speed (at exit) when the vehicle 14 leaves the detection zone S in step T7. That is, if the control circuit 24 detects the presence of characteristic points P again, the control circuit 24 calculates variation of the speed when the vehicle 14 leaves the detection zone S in step T7. Then, the control circuit 24 predicts the speed of the vehicle 14 for the measurement impossible period 61 with assumption made such that the acceleration does not rapidly change during the measurement impossible period 61 in step T8. That is, as shown in FIG. 11A, if there is no acceleration, the speed of the vehicle is simply obtained. If there is the same value and the same polarity of acceleration, the speed linearly changing can be simply predicted. If the values of the acceleration are different between the entrance and the exit, that is, it is judged that there is a discontinuous point in the measurement impossible period 61, a smoothing processing for smoothing the variation of the speed of the vehicle 14 is effected with assumption such that the speed varies continuously.

If the polarities of acceleration between the entrance and the exit are different each other, it is predicted that there is a stop interval as shown in FIG. 11B. The speed at the former part of the measurement impossible period 61 is predicted from the speed variation at the entrance and the speed at the later part of the measurement impossible period 61 is predicted from the speed variation at the exit as shown.

In step T9, the control circuit 24 corrects the speed obtained in step S10. Then, the control circuit 24 corrects the length of the vehicle 14 obtained in step S12. Finally, the control circuit 24, judges the type of the vehicle 14 from the corrected length of the vehicle and the width in step S13.

As mentioned, FIGS. 11A and 11B show two cases, namely, the first case is that the speed at entrance substantially agrees with that at the exit and they are constant. In this case, it is possible to predict the speed from the measurement impossible period 61 agrees with the speed at the entrance and the speed at the exit.

The second case is that the vehicle 14 decreases its speed at the entrance period 60, stops at the detection zone S for a moment, and starts again. In this case, because the variation of the speed at the entrance period 60 decreases at a constant rate, so that the acceleration can be assumed to be constant. Then, the speed becomes zero, so that stopping of the vehicle at the detection zone S can be predicted.

On the other hand, at the exit period 62, the variation of the speed is constant, so that the acceleration is assumed to be constant. Therefore, the speed variation at the measurement impossible period 61, the speed variation at the exit period 62 can be predicted and the timing when the vehicle started and the stop interval Tst can be predicted as shown. Accordingly, the travelling distance at the measurement impossible period 61 can be predicted in accordance with the predicted stopping interval Tst and the predicted speed.

Then, the scanning cycle Tp, the size of the detection zone S, and the repetition interval (sampling interval) tr will be described will be described in consideration of various cases.

At first, it is assumed that the upper limit of the speed of the vehicle is 200 km/h and the resolution in the travelling direction A, that is, the scanning cycle Tp is determined such that one scanning is effected every travelling distance of 10 cm at least. Then, the scanning cycle Tp is given by:

$$Tp=10\ (cm)/200\ (km/h)=1.8\ (msec)$$

Therefore, the frequency of scanning is 555 per second because it is given by an inverse of the scanning cycle Tp.

On the other hand, the scanning cycle Tp is also determined in consideration of the size of the detection zone S and the number of times of measuring within the detection zone S. As mentioned above, it is assumed that the upper limit of the speed of the vehicle is 200 km/h and the size of the detection zone S in the travelling direction A is 5 m and the number of times of measuring is twenty at least. Then, the scanning cycle Tp is given by $$Tp=5\ (m)/200\ (km/h)/20\ (times)=4.5\ (m\ sec)$$

Therefore, the frequency of scanning is 222 per second because it is given by an inverse of the scanning cycle Tp.

The sampling cycle tr is determined in accordance with the scanning interval Ts and an angular resolution. For example, it is assumed that the resolution is 10 cm in consideration of judging the shape of the outline L1 or L2 and the size of the detection zone S in the travelling direction A is 3 m. Then, thirty times of sampling is necessary for one scanning. As shown in FIG. 3A, the scanning interval Ts is shorter then the scanning cycle Tp and it is assumed to be a half of the scanning cycle Tp. Then, the sampling cycle tr is given by:

$$tr=1.8\ (msec)/30\ (times)/2=30\ (\mu sec)$$

Then, the sampling cycle tr is determined as 30$\mu$ sec.

Moreover, it is assumed that the resolution in the travelling direction A is 5 cm and the size of the detection zone S in the travelling direction A is 5 m. The sampling times is hundred per one scanning. Then, the sampling cycle tr is given by:

$$tr=4.5\ (msec)/100\ (times)/2=22.5\ (\mu sec)$$

The size of the detection zone S is determined to be approximately 5 m to 10 m in consideration of the speed of the vehicle 14, the size of the vehicle 14, and the resolution to the vehicle 14. The width of the detection zone S is determined in accordance with the width of the lane 11 of which width is determined to allow only one vehicle 14 passes therethrough at the same time.

The size of the detection zone S in the travelling direction A is also limited by the height of the vehicle classifying unit 26 in consideration of the structure of the toll gate. Then, the size of the detection zone S in the travelling direction A is determined to be about 10 m maximally because if the size of the detection zone S in the travelling direction is too large, a dead angle occurs in accordance with the height of the vehicle 14.

In the above-mentioned embodiment, the resolution is assumed to be about 10 cm. This value is actually sufficient and is determined in consideration of time necessary for processing and the cost of this system.

As mentioned above, in the vehicle classifying apparatus of the first embodiment, at first, the length of the vehicle can be detected accurately because the outline L1 or L2 is directly obtained by scanning the laser beam 16 along the scanning line 15 in the travelling direction A, so that the type of the vehicle 14 can be judged accurately.

Second, the scanning line 15 is provided in the travelling direction A, so that the processing is made simple.

Third, the acceleration and the speed of the vehicle 14 travelling over the detection zone S can be detected, because the movement of the characteristic points P can be detected because the characteristic points are obtained every scanning cycle in the travelling direction A.

Fourth, because the acceleration and the speed can be detected, so that in the case that a middle portion of the vehicle has no characteristic portion such as a bus, the speed can be predicted at the measurement impossible period 61 from the data obtained at the entrance period 60 and the exit period 62. Therefore, for example, if the vehicle 14 stops within the detection zone S due to traffic snarl, the speed at the measurement impossible period 61 can be predicted, so that the detection of the length of the vehicle 14 can be detected accurately. Therefore, the type of the vehicle 14 can be detected accurately.

Fifth, in addition to the measurement in the travelling direction, the measurement in the width direction is effected. Therefore, in the case that the measurement in the travelling direction at the center of the lane 11 is insufficient, the measurement in the width direction provides surer judgment of the type of the vehicle 14. That is, if a trailer track and a trailer coupled to the trailer track with a coupler passes the detection zone S with that the coupler dose not move on the scanning line 15, or if a motor bicycle passes trough the detection zone S in parallel to the vehicle 14, the vehicle classifying unit 12 can detect it and provides a surer judgement of the vehicle 14.

Second Embodiment

Figure 12:
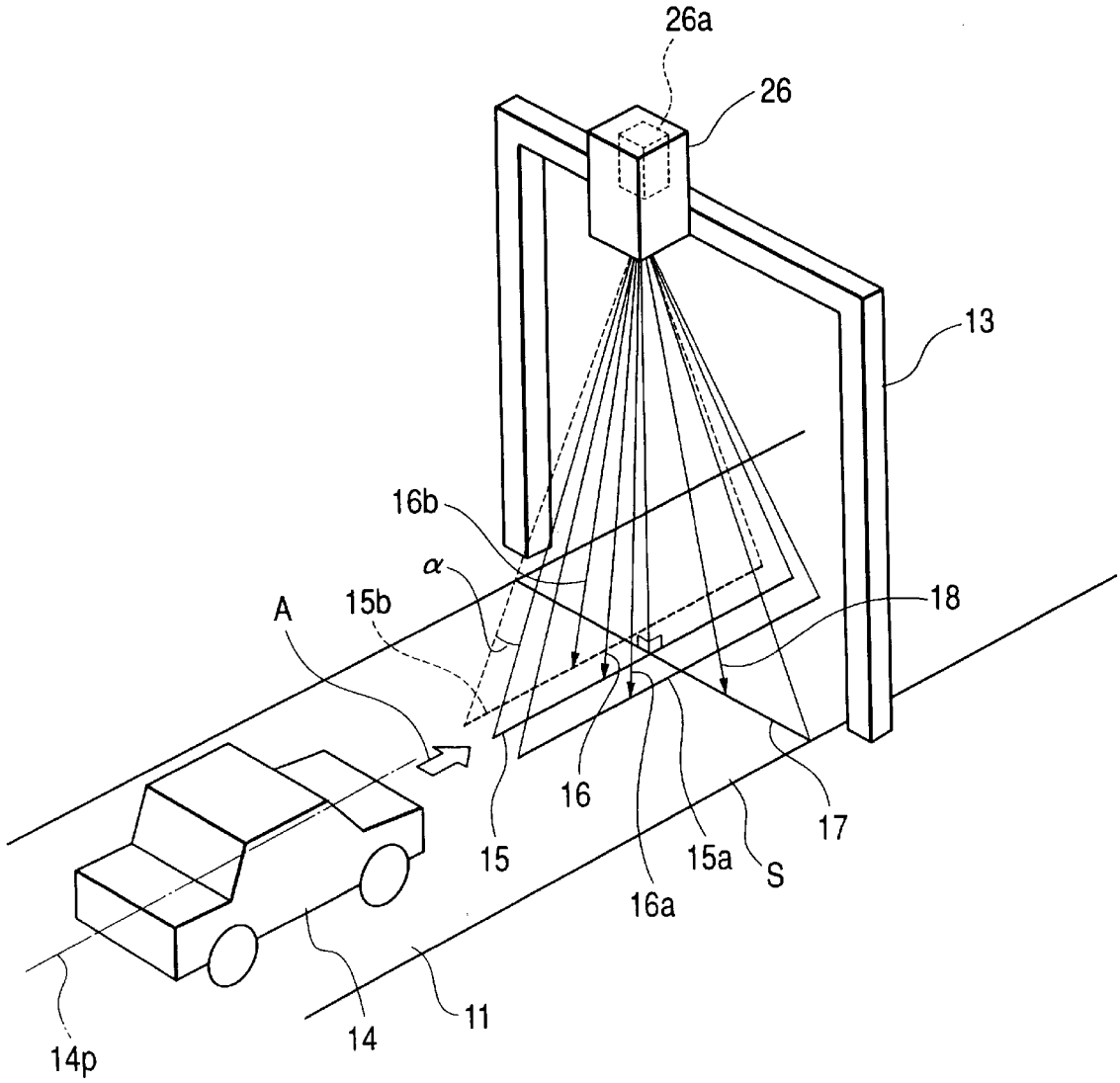
FIG. 12 is a perspective view of the vehicle classifying apparatus of a second embodiment.

FIG. 12 is a perspective view of the vehicle classifying apparatus of a second embodiment. FIG. 13 depicts a flow chart of the second embodiment showing the vehicle classifying operation.

The structure of the vehicle classifying unit 26 is substantially the same as that of the first embodiment. The difference is that a swing mechanism 26*a* is further provided and that step S14 and S15 are added to the flow chart shown in FIG. 5 to detect the position of the vehicle 14 in the width direction and to compensate the swing angle $\alpha$ in accordance with the position of the vehicle in the width direction to direct the scanning line 15 to the center line 14*p* of the vehicle 14 in the travelling direction.

The swing mechanism 26*a* is provided by inclining the axis of the polygon mirror 22 shown in FIG. 2 or by inclining the mirror 23 in the distance detection unit 51. Moreover, it is also possible to incline the whole of the optical system in the distance detection unit 51 by a driving mechanism, such as a motor (not shown).

If the vehicle 14 travels with the center line 14*p* of the vehicle 14 deviates from the center of the lane 11, the measurement in the travelling direction may not be obtained because the width of the lane 11 is considerably larger than the width of the vehicle 14, or a motor bicycle runs as the vehicle 14.

As similar to the first embodiment, the control circuit 24 judges the presence of the vehicle 14 in step S3, then, the control circuit 24 effects the longitudinal direction measurement in step S5 and the width direction measurement in step S6 as similar to the first embodiment. Then, the characteristic points are obtained in step S8, and the speed, the height, and the length of the vehicle 14 are detected in steps S10 to S12. In addition, the position of the vehicle 14 within the lane 11 in the width direction is determined in accordance with the distance data image obtained from the width direction measurement in step S14 and the swing angle $\alpha$ is changed in accordance with the detected position (center line position) of the vehicle 14 to change the position of the scanning line 15 to positions 15*a* or 15*b*.

As mentioned, the position of the scanning line 15 is changed in accordance with the detected position of the vehicle 14 in the width direction, so that the type of the vehicle 14 is surely judged.

Third Embodiment

Figure 14A:
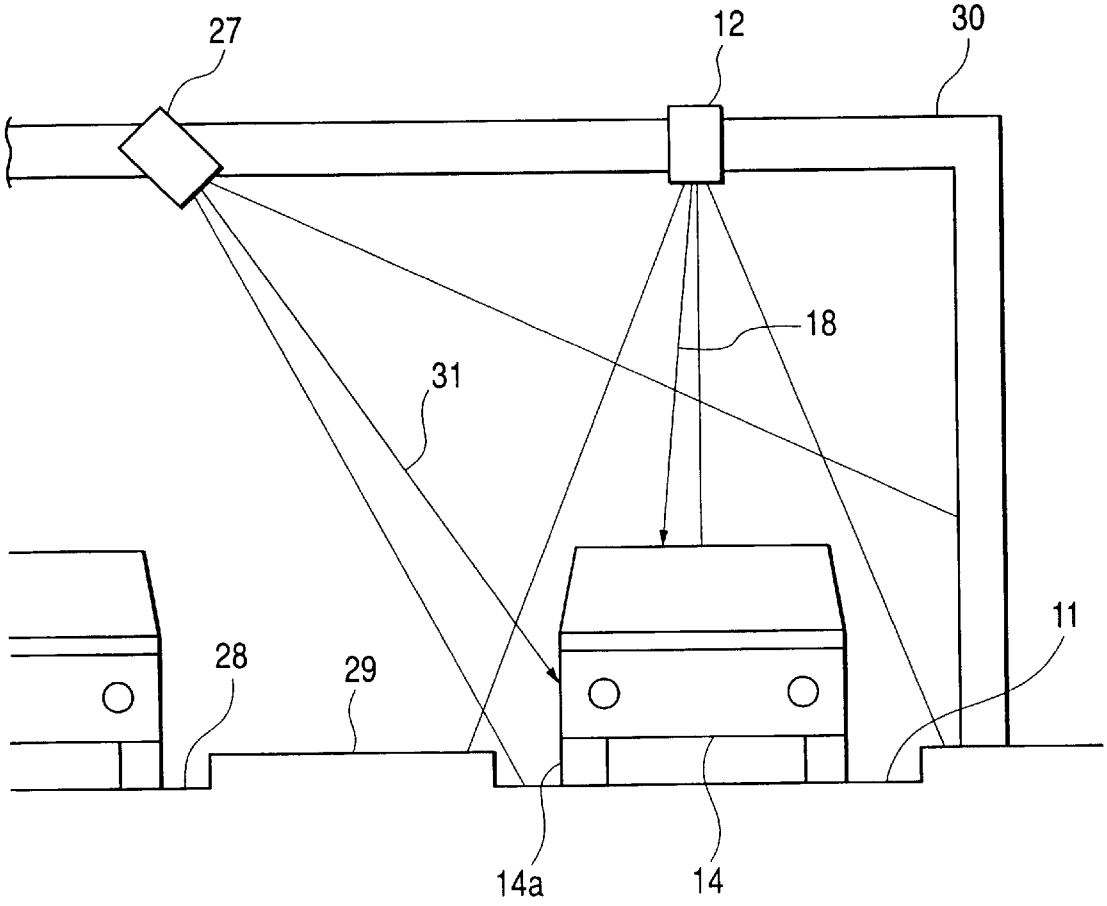
FIG. 14A is a front view of a vehicle classifying apparatus of a third embodiment.
Figure 14B:
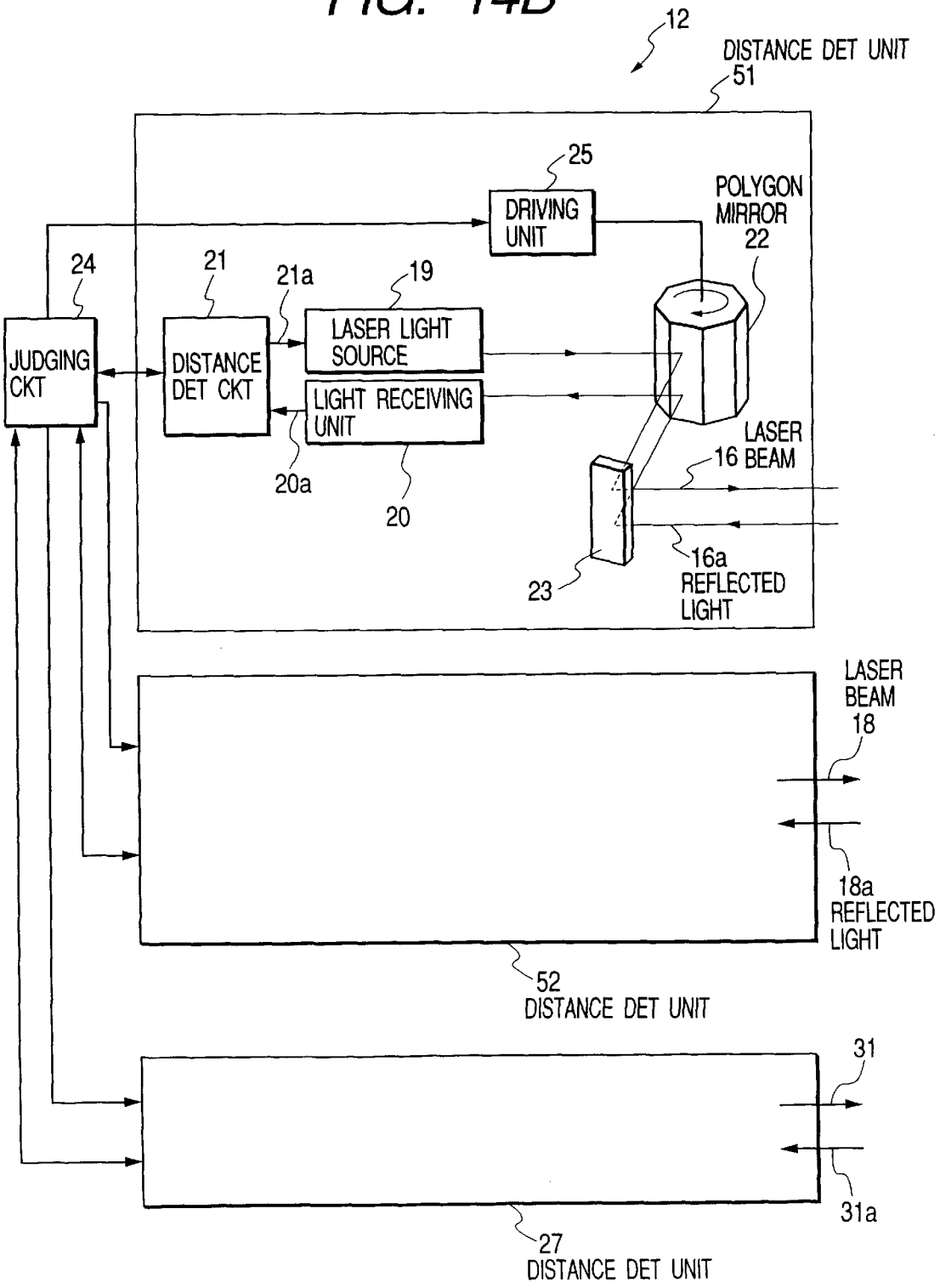
FIG. 14B is a block diagram of the vehicle classifying apparatus of the third embodiment.
Figure 15:
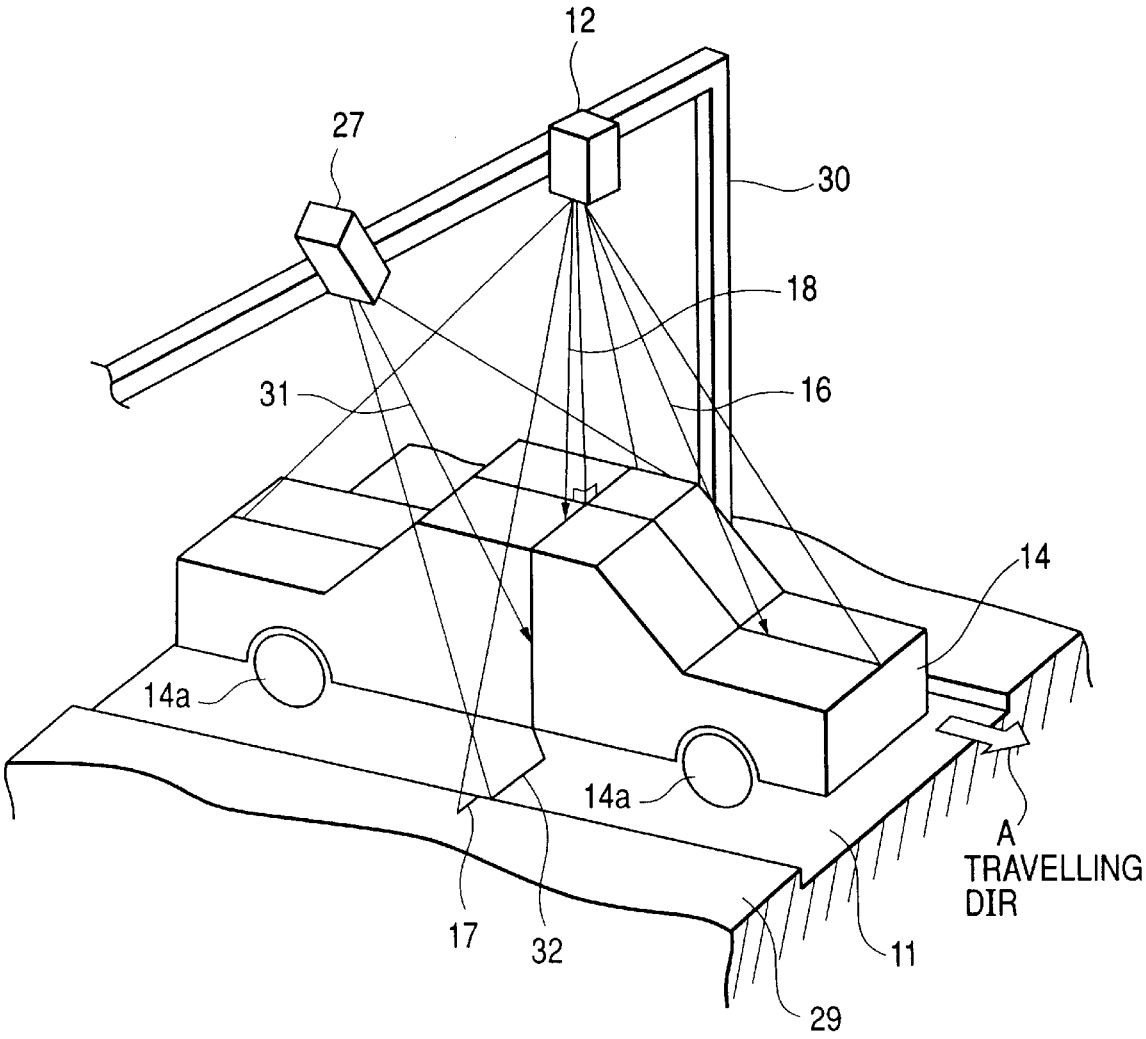
FIG. 15 is a perspective view of the vehicle classifying apparatus of the third embodiment.
Figure 16:
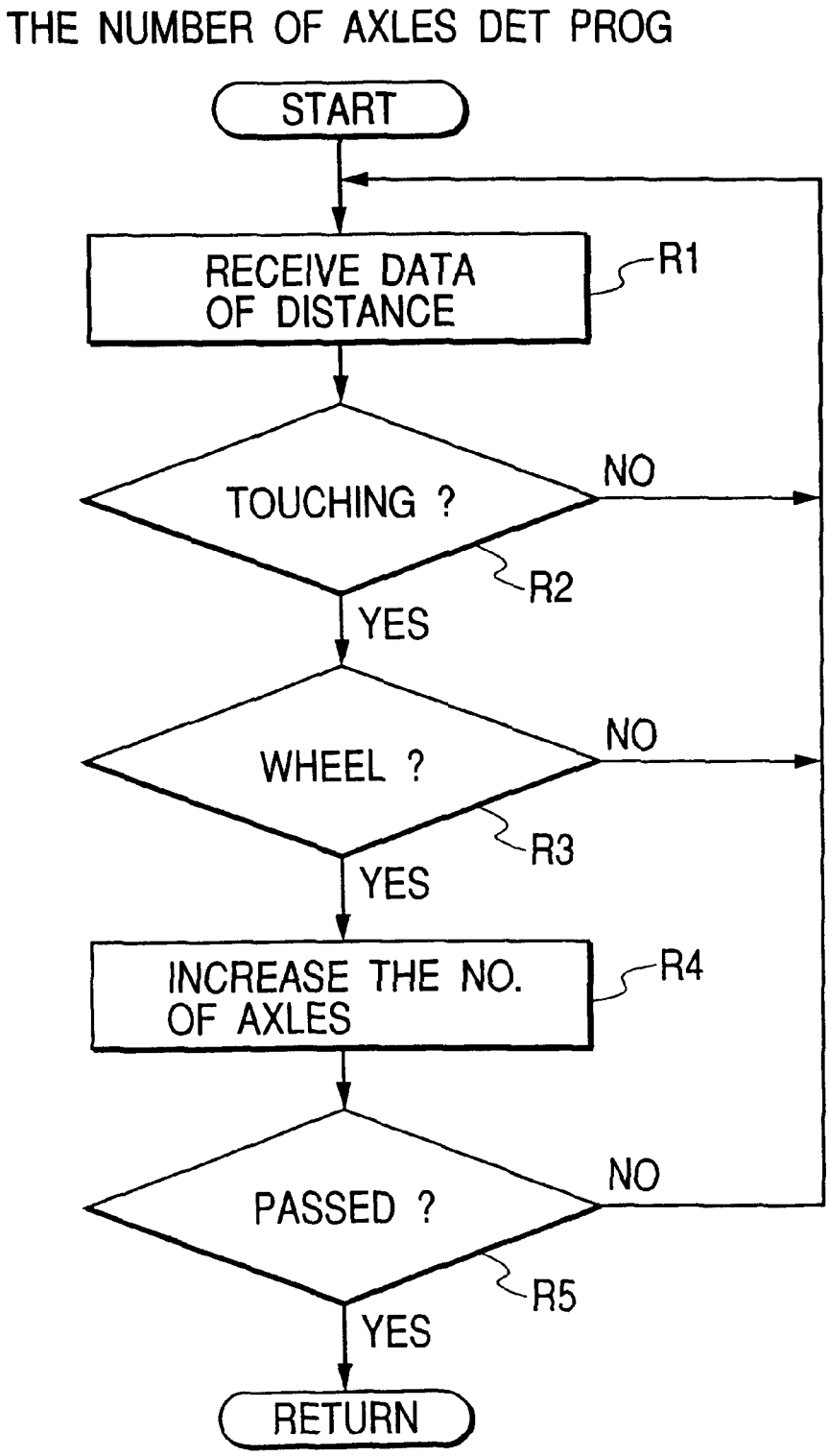
FIG. 16 depicts a flow chart of the third embodiment showing an operation for detecting the number of axles of a vehicle.
Figure 17A:
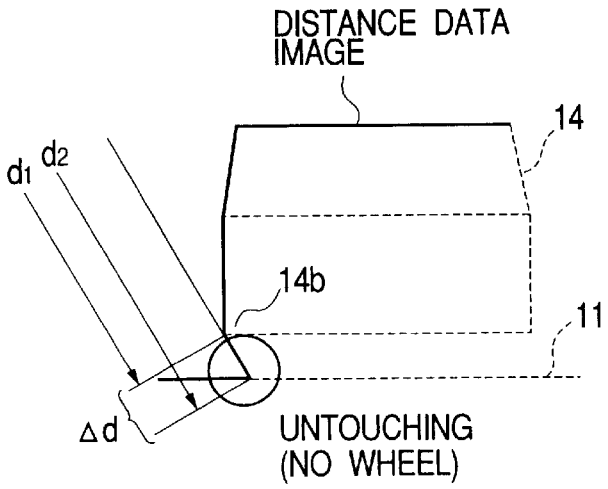
FIGS. 17A and 17B are illustrations for illustrating the operation of the third embodiment.
Figure 17B:
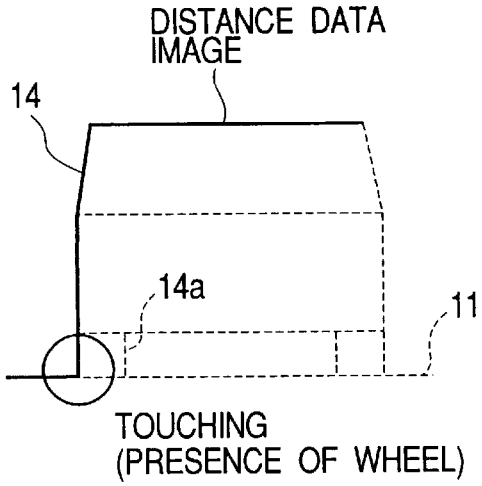
Figure 18:
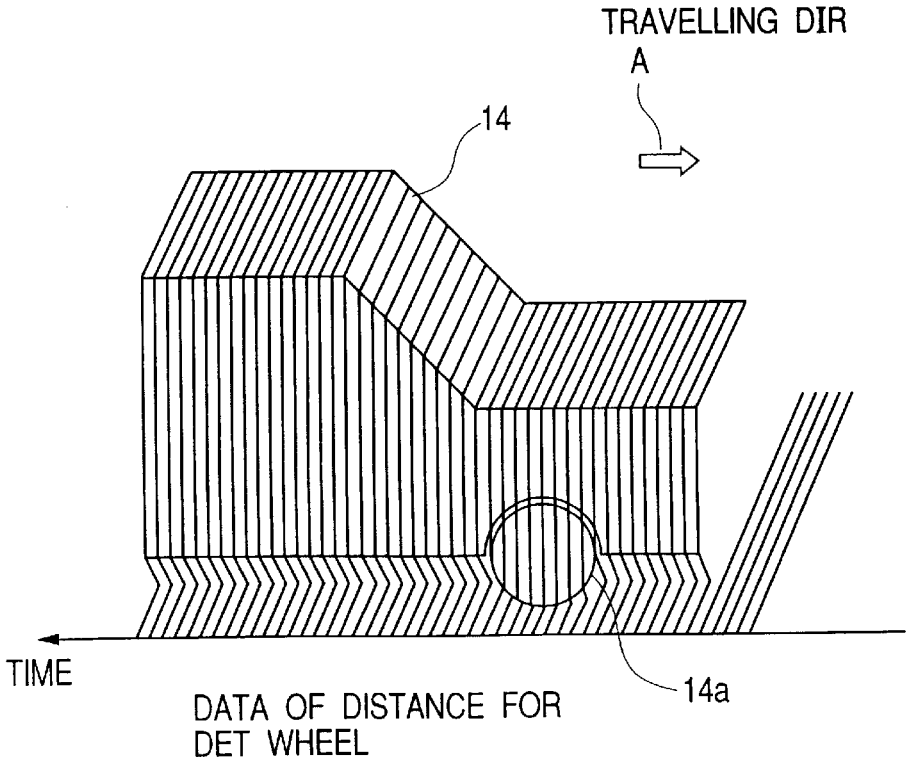
FIG. 18 is a graphical diagram of the third embodiment showing the operation of detecting the number of the axles.

FIG. 14A is a front view of a vehicle classifying apparatus of the third embodiment. FIG. 14B is a block diagram of the vehicle classifying apparatus of the third embodiment. FIG. 15 is a perspective view of the vehicle classifying apparatus of the third embodiment. FIG. 16 depicts a flow chart of the third embodiment showing an operation for detecting the number of axles of the vehicle 14. FIGS. 17A and 17B are illustration for illustrating the operation of the third embodiment. FIG. 18 is graphical diagram of the third embodiment showing the operation of detecting the number of axles of the vehicle 14.

The structure of the vehicle classifying unit 26 of the third embodiment is substantially the same as that of the first embodiment. The difference is that a distance detection unit 27 for obtaining data for judging the number of axles is further provided and the judging circuit 24 further judges the number of the axles from the data from the distance detection unit 27.

The distance detection unit 27 is fixed to a gantry 30 at the position a predetermined length apart in the width direction from the vehicle classifying unit 12 and the laser beam 31 is diagonally radiated to the lane 11 to form a scanning line 32 in the width direction to obtain distance images including the side of the vehicle 14. The scanning line 32 partially agrees with the scanning line 17.

The gantry 30 stradlingly stands the lane 11, a separating zone 29, and a neighbour lane 28 and the distance detection unit 27 is fixed to the gantry 30 above the boundary between the neighbour lane 28 and the separating zone 29. The separating zone 29 is provided to prevent the laser beam 31 from being obstructed by another vehicle travelling on the neighbour lane 28.

The distance detection unit 27 for judging the number of the axles (wheels on either side) of the vehicle 14 has the same structure as the distance detection units 51 and 52 and emits the laser beam 31 and receives the reflected light 31*a*, and supplies the data of distance d indicating a distance data image to the control circuit 24 as shown in FIG. 14B.

The control circuit 24 receives the distance data from the distance detection unit 27 in step R1. In the following step R2, the control unit 24 judges that the distance data indicates a portion of the vehicle 14 touches the lane 11. If the answer is no, processing returns to step R1. If a portion of the vehicle 14 touches the lane 11, the control circuit 24 judges whether the portion is a wheel in step R3. If the portion is a wheel, the control portion 24 increases the number of the axles by one in step R4. In the following step R5, the control circuit 24 judges whether the vehicle 14 has passed the scanning line 32. If the answer is no, processing returns to step R1 until the vehicle has passed the scanning line 32. If the vehicle 14 has passed the scanning line 32, processing returns to other program such as the vehicle classifying program shown in FIG. 5.

FIG. 17A shows distance data at a cross-section of a vehicle 14 in the width direction where there is no tire. On the other hand, FIG. 17B shows distance data at a cross-section of the vehicle 14 in the longitudinal direction where there is a tire. If there is a tire 14*a*, the distance proportionally increases along the side of the vehicle 14 toward the lane 11 substantially as shown in FIG. 17B. On the other hand, if there is no tire, at first, the distance proportionally increases along the side of the vehicle 14 toward the lane 11 and then, at the edge 14*b* of the side of the vehicle 14, the distance suddenly increases from d1 to d2. This change Δ d indirectly represents a height of the edge 14*b* from the lane 11 and the degree of untouching the lane 11. FIG. 18 shows this operation more specifically. Then, if a total of values of degrees of the untouching the lane 11 during several times scanning is less than a threshold level, the control circuit 24 judges that there is a tire.

The control circuit 24 judges the type of the vehicle 14, i.e., classifies the vehicle 14, in accordance with the number of the axles in addition to the detected length, the height, and the width of the vehicle.

Fourth Embodiment

Figure 19:
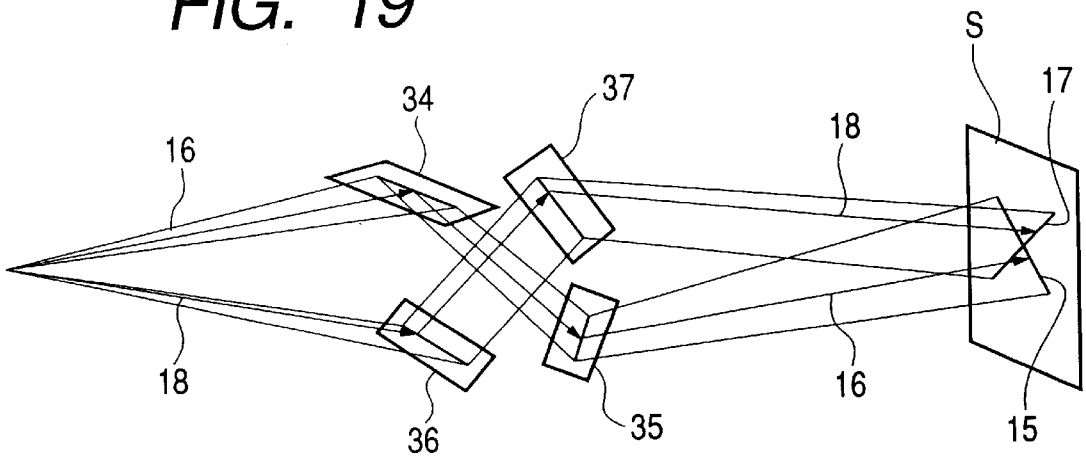
FIG. 19 is an illustration of an optical system of a fourth embodiment for the laser beams and reflected light.
Figure 20A:
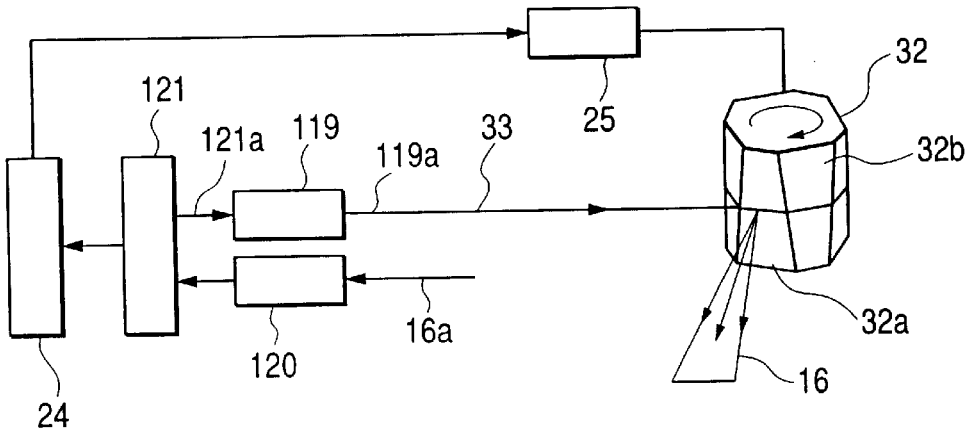
FIGS. 20A to 20C are perspective view of a polygon mirror of the fourth embodiment.
Figure 20B:
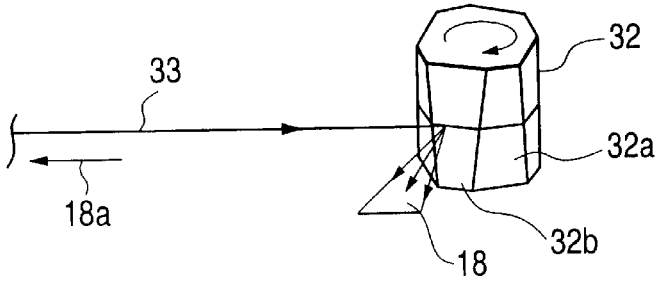
Figure 20C:
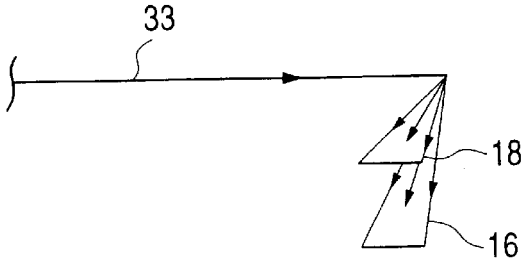

FIG. 19 is an illustration of an optical system of the fourth embodiment for the laser beams 16 and 18 and reflected light 16*a* and 18*a*. FIGS. 20A to 20C are perspective views of a polygon mirror 32 of the fourth embodiment.

The structure of the vehicle classifying unit 12 is substantially the same as that of the first embodiment. The difference is that the laser light source 119, the polygon mirror unit 32 of the distance detection unit 51, the light receiving unit 120, and the distance detection circuit 121 are commonly used between the distance detection in the travelling direction and the width direction.

The polygon mirror unit 32 of this embodiment includes even number of mirrors arranged circumferentially, that is, mirrors 32*a* and mirrors 32*b*. The normal of the mirror 32*a* is slightly inclined to the axis of the polygon mirror unit 32 in one direction along the axis as shown in FIG. 20A and the normal of the mirror 32*b* is slightly inclined to the axis of the polygon mirror unit 32 in the opposite direction along the axis as shown in FIG. 20B, so that the laser beam 16 is reflected slightly downward (in the drawings) and the laser beam 18 is reflected slightly upward (in the drawings) as shown in FIG. 20C. The laser beam 16 and the laser beam 18 are alternately generated from the laser light 119*a* from the laser light source 119 in a time division manner. The distance detection circuit 121 generates the drive signal 121*a* indicative of alternately generating the laser beams 16 and 19. The light receiving unit 120 receives the reflected light 16*a* and 18*a* alternately. The distance measurement circuit 121 executes the processing for obtaining the distance data in the travelling direction and the width direction. The control circuit 24 controls the driving unit 25 and executes the vehicle classifying processing as similar to the first embodiment.

The laser beam 16 is reflected by mirrors 34 and 35 to form the scanning line 15 on the detection zone S and the laser beam 18 is reflected by mirrors 36 and 37 to form the scanning line 17 on the detection zone S with the scanning line 15 intersecting the scanning line 17 perpendicularly.

Fifth Embodiment

Figure 21:
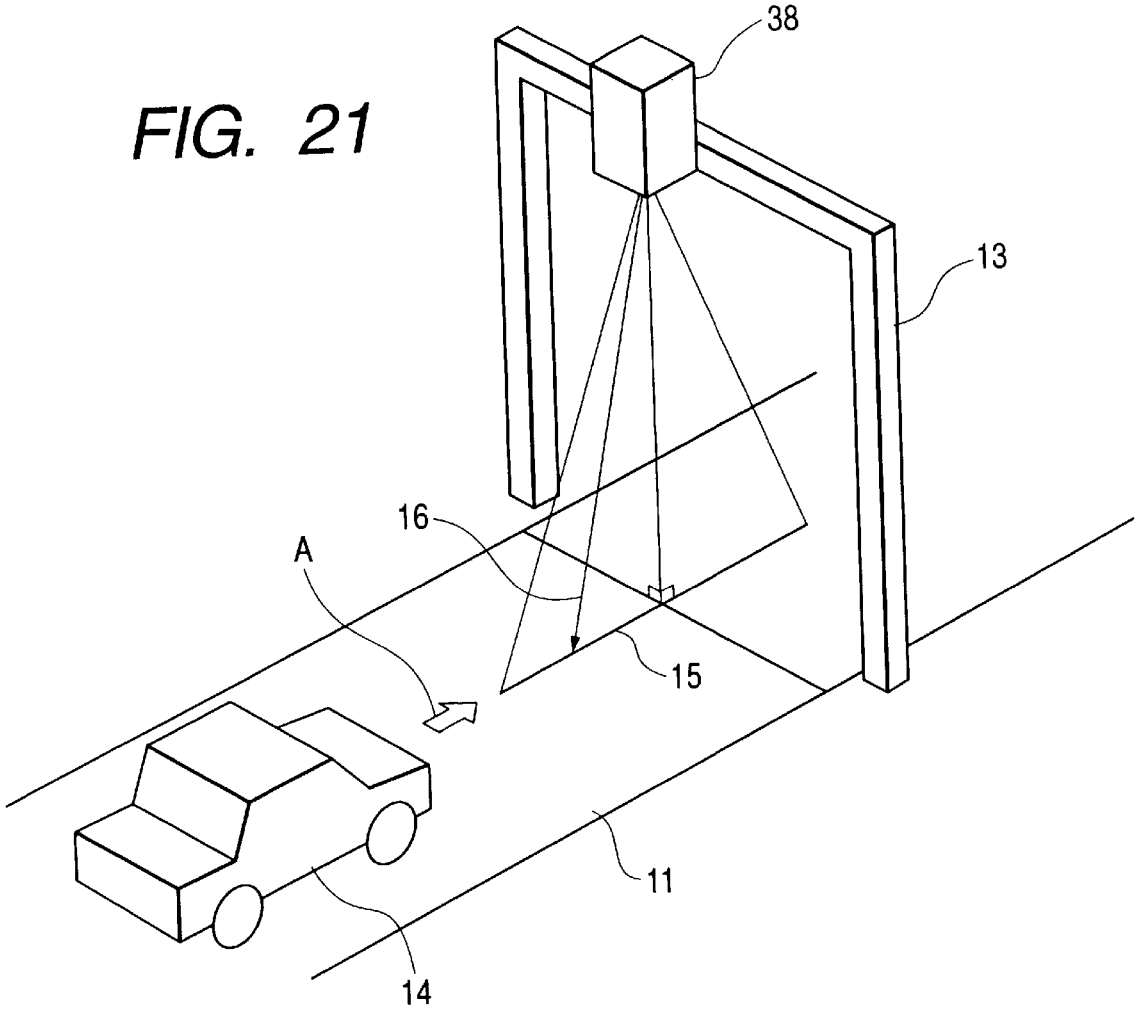
FIG. 21 is a perspective view of the vehicle classifying apparatus of a fifth embodiment.

FIG. 21 is a perspective view of the vehicle classifying apparatus of the fifth embodiment. The vehicle classifying unit 38 is arranged above the lane 11 by the gantry 13 such that laser beam 16 is directed to the lane 11 to provide a detection zone S. It is assumed that the vehicle 14 to be detected travels on the lane 11 in a travelling direction A. The lane 11 has a width to allow only one vehicle having four wheels to pass therethrough except a motorcycle.

The vehicle classifying unit 38 scans the laser beam 16 on the detection zone S along the scanning line 15 along the travelling (longitudinal) direction A. That is, the structure of the vehicle classifying apparatus of the fifth embodiment is substantially the same as that of the first embodiment and the difference is that the type of the vehicle is judged only from the distance data in the travelling direction, that is, the distance detection unit 52 for obtaining the distance data in the width direction is omitted.

The class of the vehicle 14 is judged from only the length of the vehicle or characteristic points in the travelling direction.

In this embodiment, if the length of the vehicle is larger than the size of the detection zone S in the traveling direction, the outline L3 is obtained by combining partially detected outlines. This operation will be described.

Figure 22:
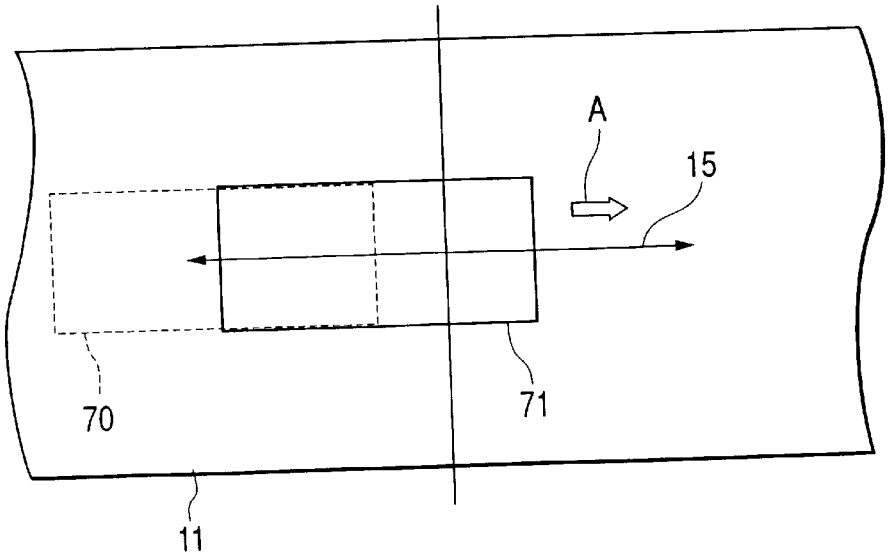
FIG. 22 is an illustrating of the fifth embodiment showing the condition that the vehicle travels on the lane.
Figure 23:
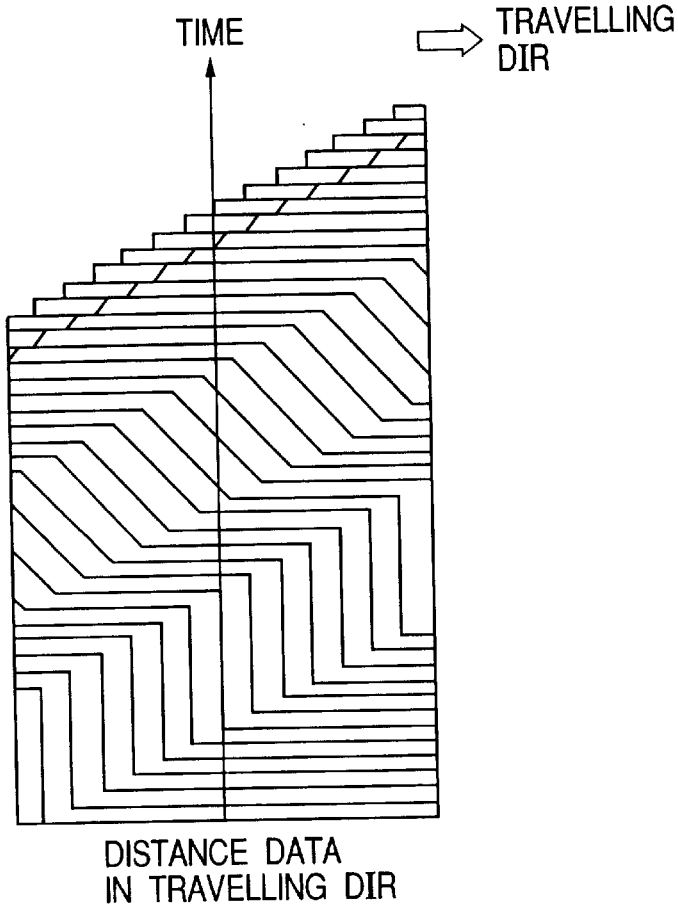
FIG. 23 is a graphical drawing of the fifth embodiment showing the condition of distance data while the vehicle travels.
Figure 24:
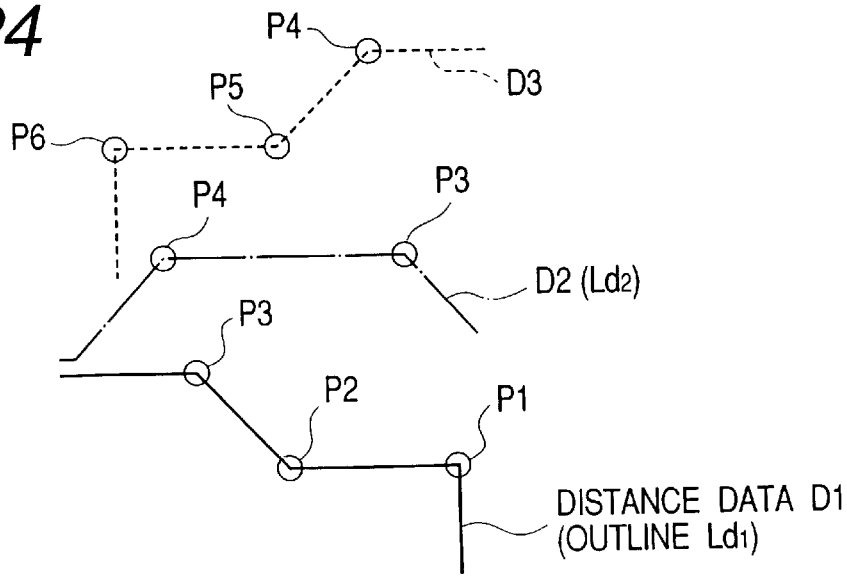
FIG. 24 is an illustration of the fifth embodiment showing an operation obtaining correspondence of characteristic points.
Figure 25A:
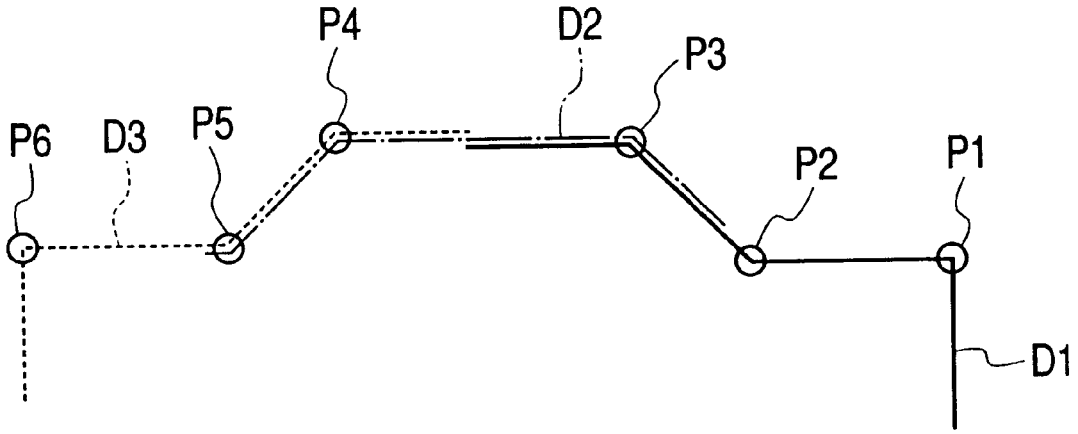
FIGS. 25A and 25B are illustrations of the fifth embodiment showing the data combining process and combining result.
Figure 25B:
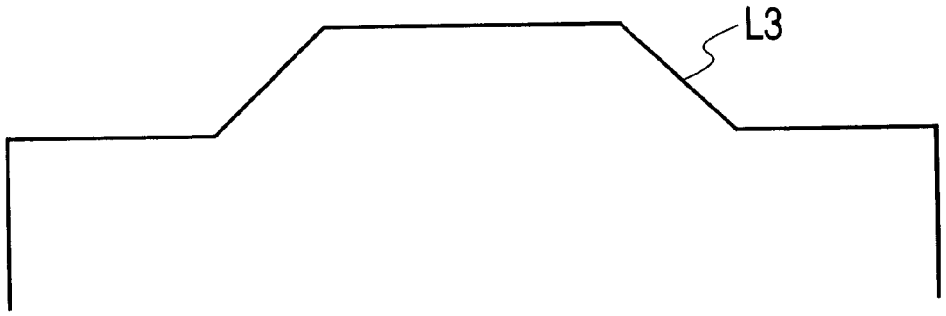

FIG. 22 is an illustrating of the fifth embodiment showing the condition that the vehicle 14 travels on the lane. FIG. 23 is a graphical drawing of the fifth embodiment showing the condition of the distance data while the vehicle travels. FIG. 24 is an illustration of the fifth embodiment showing a data combining process. FIGS. 25A and 25B are illustrations of the fifth embodiment showing the data combining process and combined result.

It is assumed that, as shown in FIG. 22, the vehicle 14 is travelling along the lane 11 from the position 70 to the position 71, the distance data in the travelling direction varies as shown in FIG. 23, wherein the distance data of every scanning shows a portion of the vehicle 14 and the distance data of successive scanning shows successive movements of the vehicle 14. The characteristic points P can be obtained from the distance data of every scanning and some of them at one scanning period correspondingly exist in the distance data of the next or neighbour scanning cycle. Then, corresponding characteristic points P can be overlapped each other. That is, correspondence of the characteristic points P commonly existing in the distance data sets of two scanning cycles is obtained and the characteristic points in the distance data of every scanning cycle can be combined with common characteristic points overlapped each other to obtain the combined outline L3 as shown in FIGS. 24 and 25. That is, the partial outlines are combined.

More specifically, in FIG. 24, there are distance data sets D1 to D3 of neighbour scanning cycles. Regarding characteristic points P1 to P3 in the distance data set D1, it can be judged that one characteristic point in the distance data set D2 corresponds to the characteristic point P3 in the distance data set D1 by checking the adjacent partial outlines. Then, this characteristic points can be overlapped each other at this position regarding the vehicle 14, so that the position of the characteristic point P4 regarding the vehicle 14 in the distance data set D2 can be determined. Then, the outline Ld2 from the distance data set D2 is combined with the outline Ld1 from the distance data D1. This operation is repeated, so that the combined outline L3 is obtains. The combined outline L3 provides the length of the vehicle 14.

In the fifth embodiment, though the distance data is obtained in only the travelling direction for making the structure simple, the length of the vehicle 14 can be provided by combining the detected partial outlines with the corresponding characteristic points overlapped each other.

Sixth Embodiment

Figure 26:
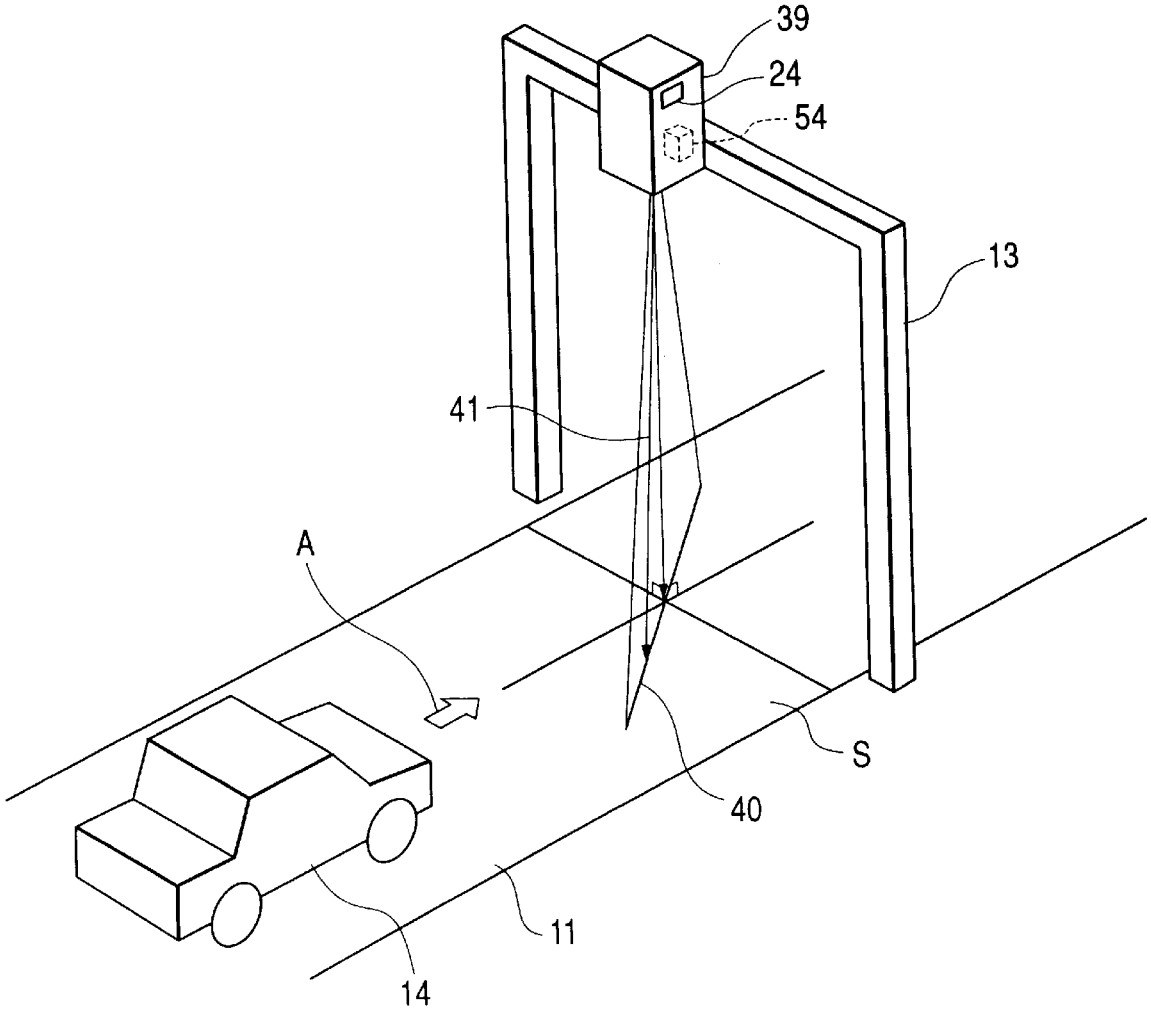
FIG. 26 is a perspective view of the vehicle classifying apparatus of a sixth embodiment.
Figure 27:
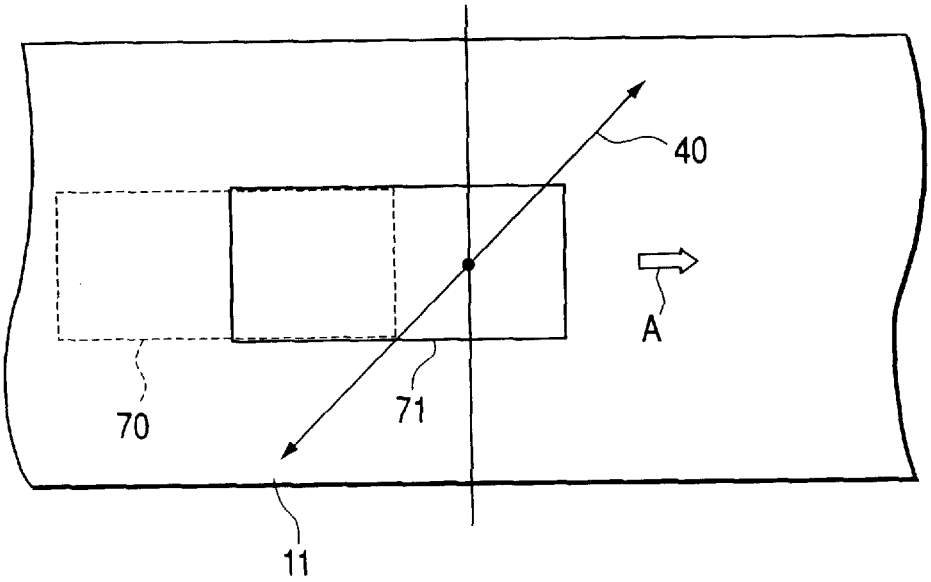
FIG. 27 is an illustration of the sixth embodiment showing distance data obtaining operation.
Figure 28:
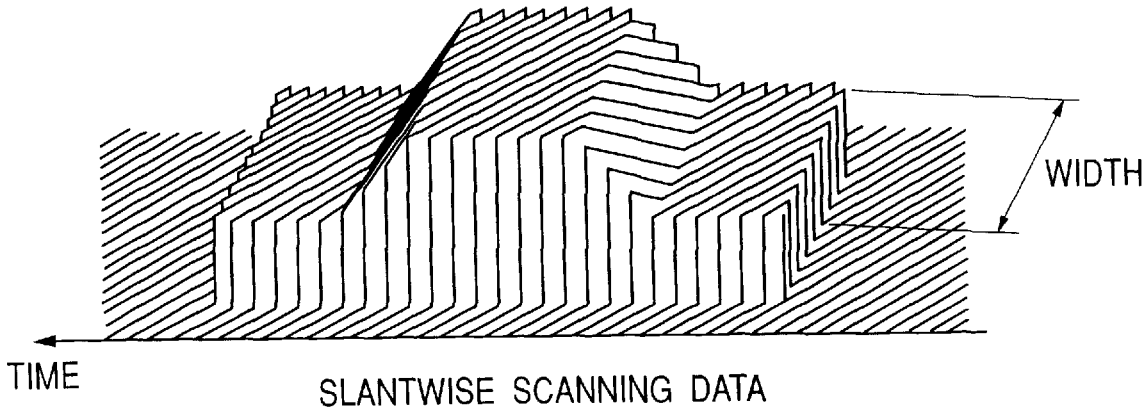
FIG. 28 is a graphical drawing of the sixth embodiment showing distance data by slantwise scanning.

FIG. 26 is a perspective view of the vehicle classifying apparatus of the sixth embodiment. FIG. 27 is an illustration of the sixth embodiment showing distance data obtaining operation. FIG. 28 is a graphical drawing of the sixth embodiment showing distance data by slantwise scanning. The basic structure of the vehicle classifying apparatus of the sixth embodiment is substantially the same as that of the first embodiment. The difference is that only one distance detection unit 54 for slantwise scanning and the controlling unit 24 for processing the distance data obtained by slantwise scanning is provided.

The vehicle classifying unit 39 is provided above the lane 11 of the highway with the gantry 13. The vehicle classifying unit 39 is arranged above the lane 11 by the gantry 13 such that a laser beam 41 is directed to the lane 11 to form a scanning line 40 which is inclined to the travelling direction A with an inclined angle of 45°.

It is assumed that, as shown in FIG. 27, the vehicle 14 is travelling along the lane 11 from the position 70 to the position 71, the distance data in the slantwise direction varies as shown in FIG. 28, which shows a three-dimensional image of the vehicle 14. Generally, it is assumed that the shape of the vehicle in the plan view is substantially a rectangular. Then, though the speed of the vehicle 14 varies within the detection zone S, the shape of the vehicle 14 can be operated with the speed change successively corrected.

Moreover, the outline in the width direction can be obtained also, so that the width of the vehicle is obtained by extracting components in the width direction (orthogonal components). Further, though the positions of characteristic points of the vehicle 14 in every distance data set varies with the variation of the speed of the vehicle, the variation of the portions of characteristic points of the vehicle 14 in every distance data set can be compensated by an operation such that a recutangular shape is provided.

In the above-mentioned embodiments, there are modifications.

For example, scanning for the width direction measurement may be effected prior to that for the longitudinal measurement. Moreover, the laser beam pulses of the width direction measurement and the longitudinal direction are alternatively emitted in a time division manner to provide substantially the same time processing. In this case, separation between the reflection light can be provided with different detection timings of the reflected light. Moreover, laser light sources with different wavelengths provides separation of the reflected light to be received, so that both laser beams are emitted at the same time substantially.

The speed, the length, and the height of the vehicle are judged with a batch processing at the vehicle classifying. Alternatively, determination of the speed, the length, and the height of the vehicle may be successively effected to the possible extent to provide earliest result.

Scanning in the width direction and the longitudinal direction may be effected alternatively or either of scanning in the width direction or the longitudinal direction may be successively effected several times in consideration of detection accuracy and the scanning speed.

The mirrors 34 to 37 may be provided with prisms.

The polygon mirror 32 may be provided with a galvano mirror. In this case, the width direction and the longitudinal direction measurements are provided with two galvano mirrors having different axles to provide scanning lines 15 and 17. Scanning may be provided with a holograpic scanner.

Seventh Embodiment

Figure 29:
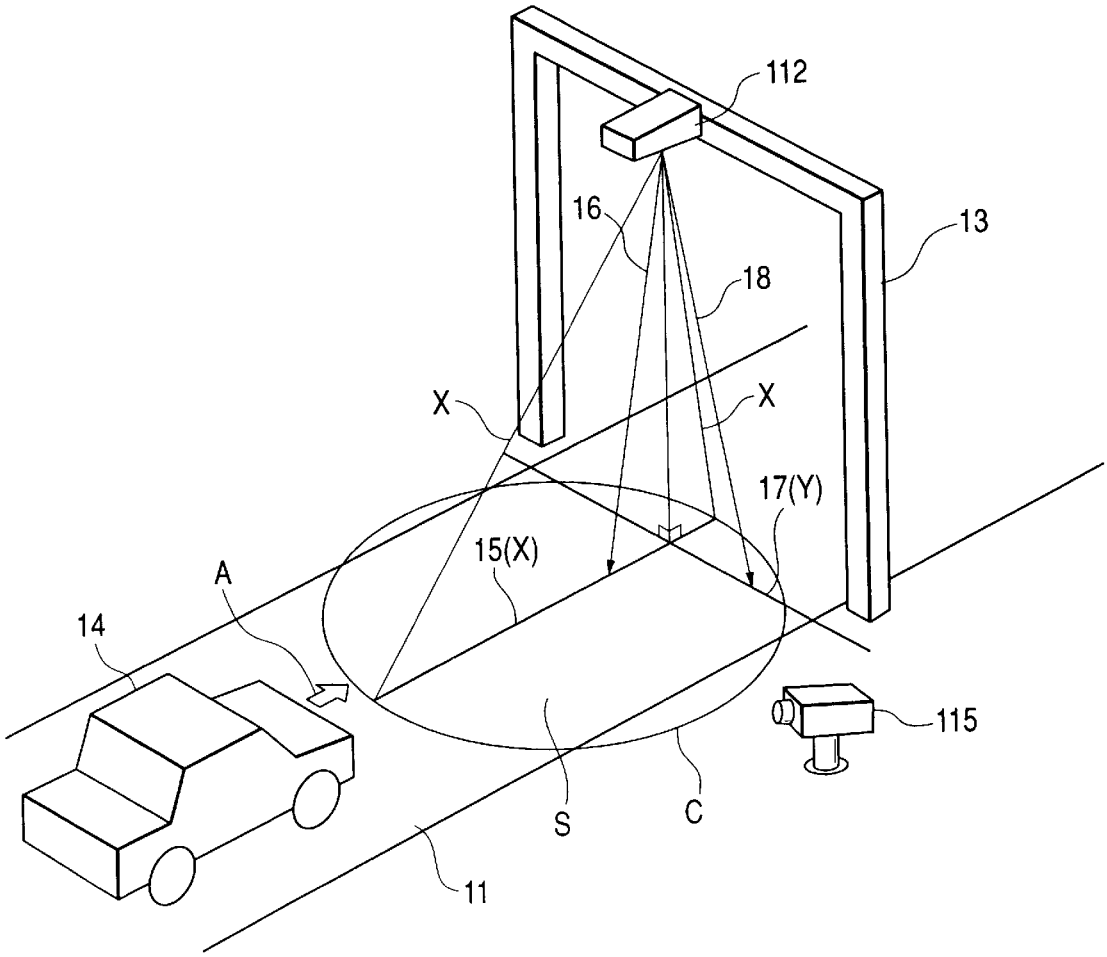
FIG. 29 is a perspective view illustrating a vehicle classifying apparatus in a seventh embodiment.
Figure 30:
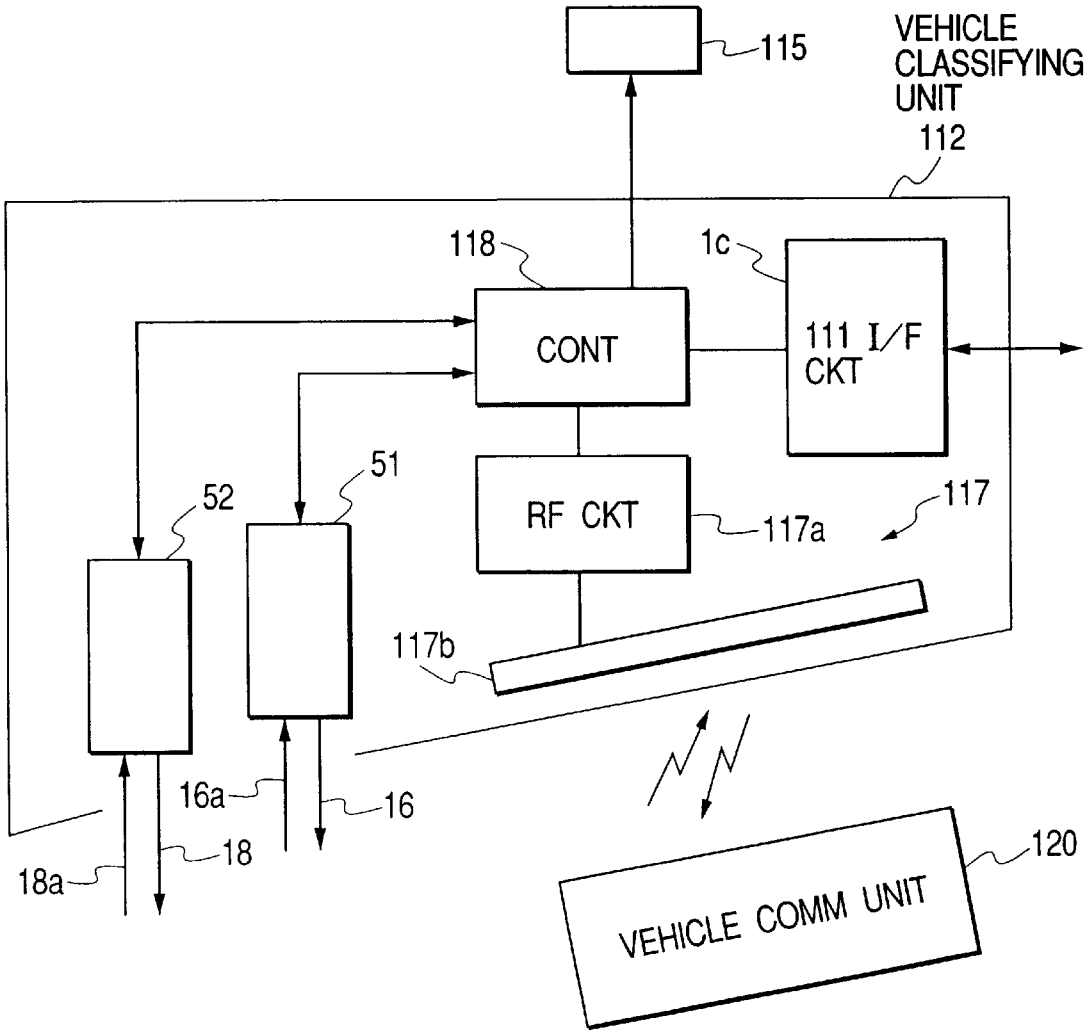
FIG. 30 is a block diagram of the vehicle classifying unit of the seventh embodiment.

FIG. 29 is a perspective view illustrating the vehicle classifying apparatus in a seventh embodiment. FIG. 30 is a block diagram of the vehicle classifying unit 112 of the seventh embodiment.

The vehicle classifying apparatus of the seven embodiment is substantially the same as the first embodiment. The difference is that a communication unit 117 for communicating with a vehicle communication unit mounted on the vehicle 14 passing therethrough, an interface circuit 118 for communicating with a lane controller 119 to supply data obtained by the vehicle classifying appratus to the toll gate computer 121, a video camera 115 for receiving and storing an image of the vehicle are further provided and the control circuit 118 which further judges unrighteous travelling of the vehicle and controls the communication unit 117 and the interface circuit 111.

The distance detection circuits 51 and 52 are provided as similar to the first embodiment, so that the scanning line 15 with laser beam 16 in the longitudinal direction and the scanning line 17 with laser beam 18 in the width direction are provided. The width of the lane 11 is determined to allow only one vehicle to pass therethrough except a motor cycle.

Figure 32:
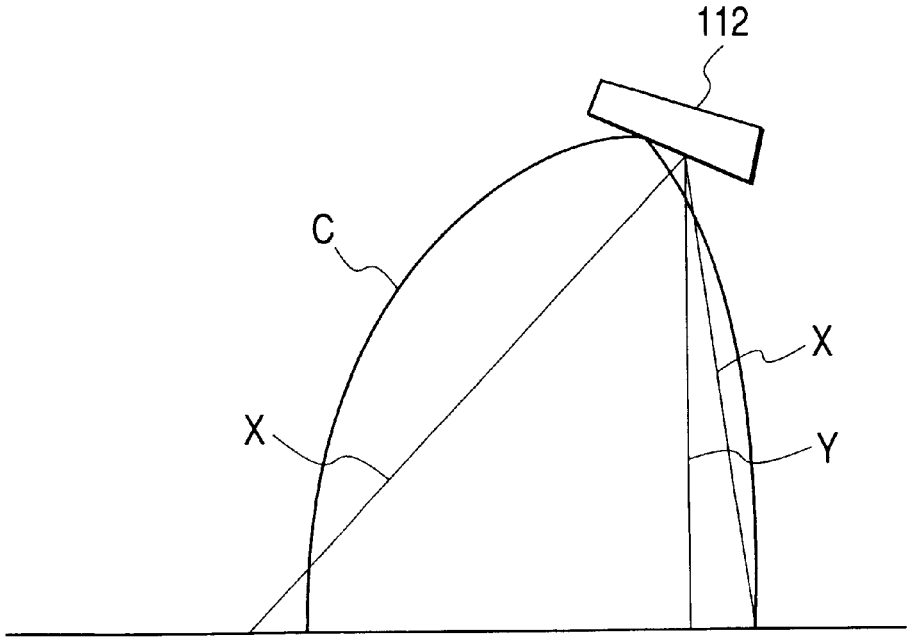

The communication unit 117 includes an RF circuit 117*a* and a plane antenna 117*b* to transmit a microwave signal to a vehicle communication unit 120 and receive another microwave signal from the vehicle communication unit 120 with directivity. A communication zone C of the communication unit 117 provided by the directivity of the microwave signal is provided on the lane 11 such that the communication zone C substantialy includes the scanning line 15 and 17. That is, the detection zone S and the communication zone C are substantially overlapped each other, wherein the scanning line 17 positions at the far end of the communication zone C in the travelling direction A. In FIG. 32, the scanning zone (traiangle) X provided by the laser beam 15 substantially agrees with the communication zone C. Similarly, the scanning zone (traiangle) Y provided by the laser beam 17 substantially agrees with the communication zone C.

The video camera 115 is arranged adjacent to the lane 11 and directed to the vehicle 14 travelling the lane 11 to shoot an image of the number plate (not shown) of the vehicle 14 and an image of the driver (not shown) of the vehicle 14 at need.

The control circuit 118 operates the distance detection circuits 51 and 52 to obtain the distance data image of the vehicle 14 in the longitudinal direction and the width direction and to classify the vehicle 14 as similar to the first embodiment, operates the communication unit 117 to obtain data from the vehicle communication unit 120, judges the position at which the vehicle communication unit 120 is to be mounted in accordance with the detected profile of the vehicle from the distance image data, detects whether a first timing correspondent to the position of the vehicle communication unit 120 to be mounted agrees with the commounication start timing with the vehicle communication unit 120, judges unrighteous (illegal) travelling of the vehicle in accordance with disagreement between the first timing and the communication start timing and with disagreement between the detected class and the class data obtained from the recieved data, operates the interface circuit 111 to request the toll of the vehicle 14 via the lane controller 119 and a toll gate computer 121, and operates the video camera 115.

The communication unit 117 transmits the microwave signal requesting communication through the flat antenna 117*b* in response to detection of the vehicle 14 by the distance detection circuit 51. In response to this, the vehicle communication unit 120 transmits data of the registered identification code, class data, and other various data regarding the vehicle communication unit 120 and the vehicle 14 which is to be correspondence with the communication unit 120. Then, the control circuit 118 confirms that the class data agrees with the class judged in accordance with the distance data image from the distance detection circuits 51 and 52. This is because the vehicle communication unit 120 is removable from the vehicle 14, so that if this vehicle communication unit 120 is mounted on another vehicle of a higher class regarding the toll, the requested toll will be lower than that for the actual class. Therefore, through the class data has been received from the vehicle communication unit 120, if the class data disagrees with the judged class, it is judged that the vehicle 14 unrighteneusly (illegally) travels on the lane 11.

The vehicle communication unit 120 can be bought by the driver with an account for payment of tolls provided in a bank 123 and the identification stored in the vehicle communication unit 120 provides identification of the owner of the vehicle communication unit 120.

The control circuit 118 predicts the position of the vehicle communication unit 120 in the vehicle 14 from the distance data image from the distance detection circuits 51 and 52 in addition to judging the class of the vehicle 14. That is, the vehicle communication unit 120 should be mounted inside of the front shield glass. Then, it is possible to predict a front shield glass position FP, that is, the control circuit 118 judges the class of the vehicle 14 into a small passenger car, a large passenger car, a bus, a large truck, or the like from the distance data image. Then, the front shield glass position FP is detected by detecting characteristic points and a partial outline corresponding to the front shield glass.

Moreover, the control circuit 118 detects the front shield glass entrance timing when the front shield glass position enters the detection zone S and the communication start timing when the communication unit 120 starts communicating with the communication unit 117 and judges that the vehicle communication unit 120 is mounted on the vehicle 14 on which the vehicle communication unit 120 is to be mounted, i.e., judges correspondence between the vehicle 14 and the communication unit 120, when difference between the front shield glass entrance timing and the communication start timing is less than a predetermined interval.

Figure 31:
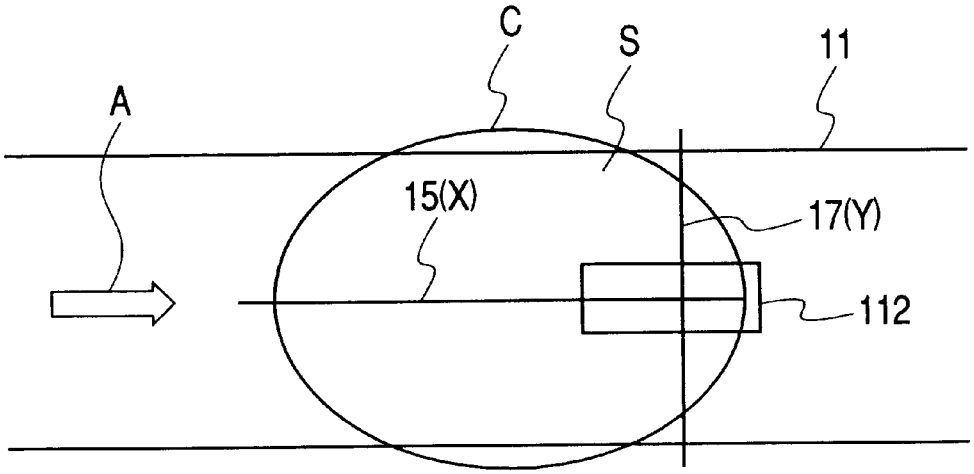
FIGS. 31 and 32 are plan and side views of the seventh embodiment illustrating the positional relation between the detection zone and the communication zone.

FIGS. 31 and 32 are plan and side views of the seventh embodiment illustrating the positional relation between the detection zone S and the communication zone C.

The communication zone C is provided to include the scanning line 15 defining the detection zone S because the microwave signal and the laser beam scanning have high directivity, so that the start timing of communication between the vehicle classifying unit 112 with the vehicle communication unit 120, that is, the timing when the vehicle communication unit 120 enters the communication zone C substantially agrees with the front shield glass position FP enters the detection zone S. Then, the predicted timing when the front shield glass position FP from the distance data image from the distance detection circuit 51 should be agree with the communication start timing.

Figure 33:
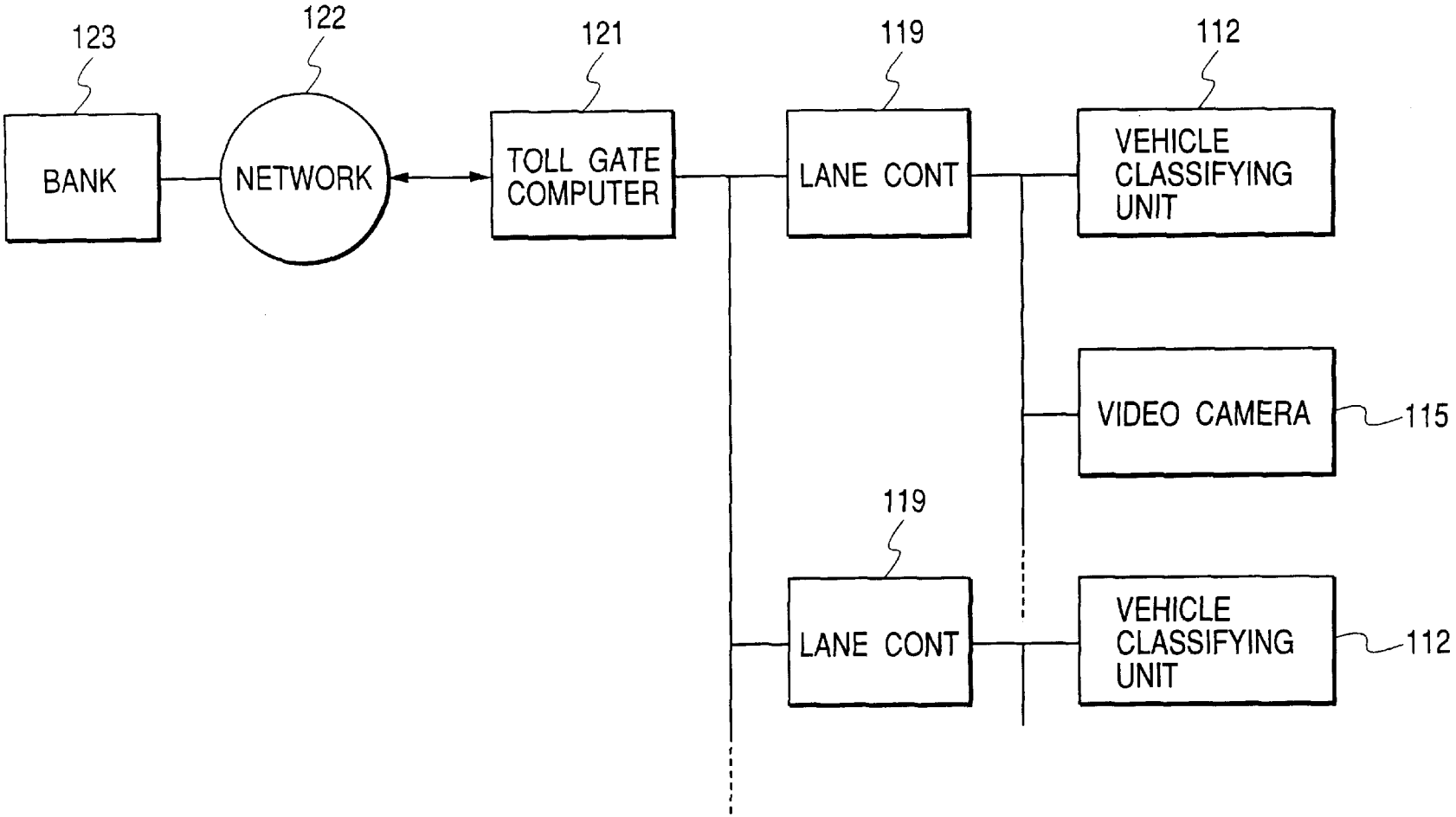
FIG. 33 is a block diagram of a toll system of the seventh embodiment including the vehicle classifying unit.

FIG. 33 is a block diagram of a toll system of the seventh embodiment including the vehicle classifying unit 112.

The toll gate system includes the toll gate computer 121 and a plurality of sets of the vehicle classifying units 112, the video cameras 115, and the lane controllers 119.

In response to detection of entrance of the vehicle 14 into the detection zone S, the vehicle classifying unit 112 operates the video camera 115 to store the image of the number plate of the vehicle 14 or the driver and stops the video camera 15 when the vehicle exits the detection zone S and finally stores the data of the image of the number plate of the vehicle 14 or the driver from the video camera 14 when it is judged that the vehicle unrighteously travels on the lane 11.

Figure 34:
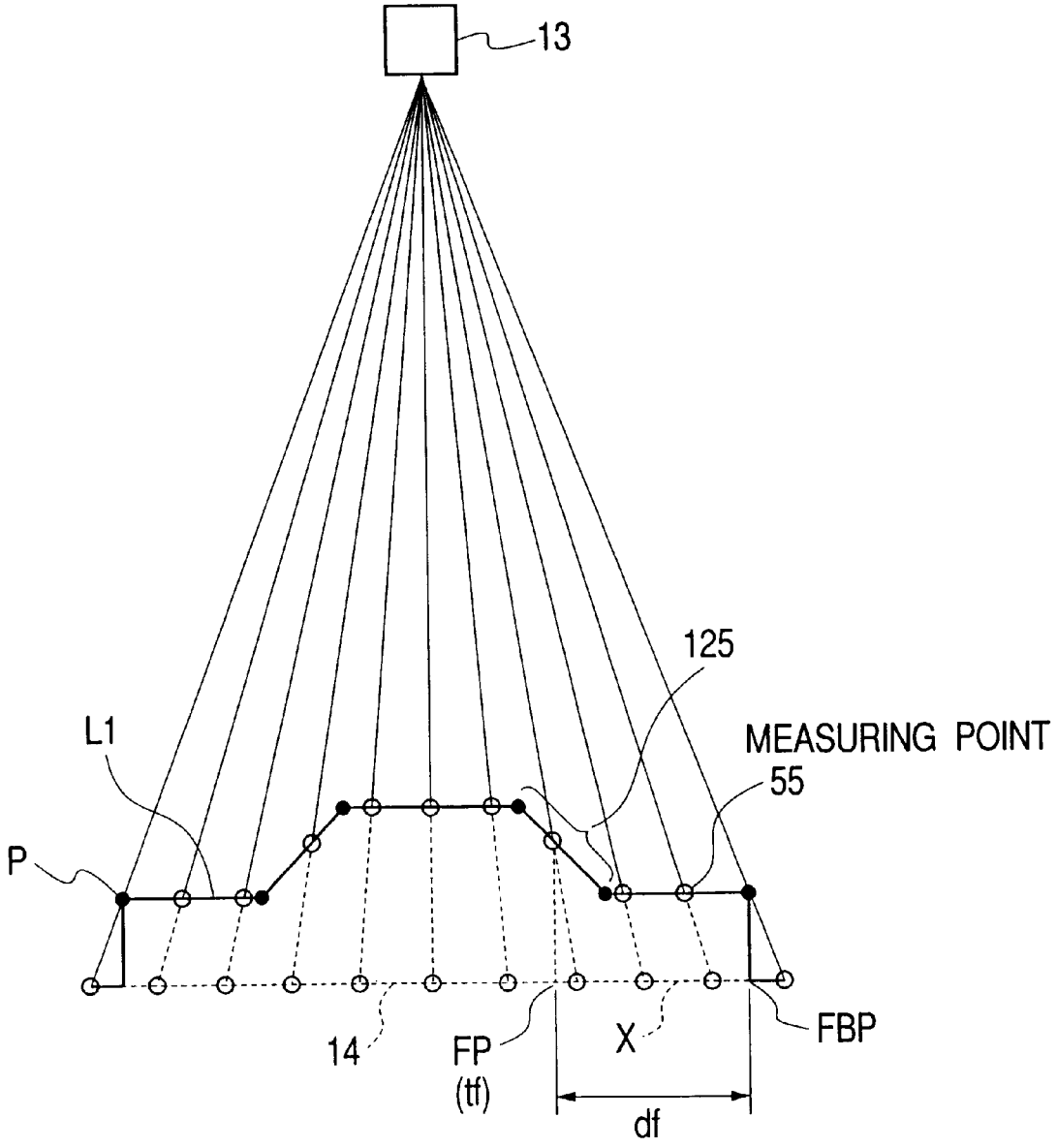
FIG. 34 is a graphical drawing of the seventh embodiment which corresponds to FIG. 4A.

Moreover, the vehicle classifying unit 112 supplies data of the unrighteously travelling vehicle through the lane controller 119 when the unrighteously traveling is judged. The toll gate computer 121 requests payment of the toll to the owner (bank 123) of the vehicle communication unit 120 in accordance with the judged and confirmed class of the vehicle 14, when the vehicle 14 righteously traveled. When the unrighteously travelling is judged, a necessary operation is executed. For example, an operator of the toll gate is alarmed of occurrence of the unrighteous travelling and the operator takes a necessary countermeasure in accordance with the class data, date and time data, the video image stored in the video camera 115. FIG. 34 is a graphical drawing of the seventh embodiment which corresponds to FIG. 4A.

The control circuit 118 obtains the distance data image as shown in FIG. 34 in the longitudinal direction as similar to the first embodiment using the distance detection circuit 51. That is, the control circuit 118 obtains an outline L1 for the characteristic points P (denoted with solid dots) which is obtained from the distance data at measuring points 55. The control circuit 118 determines the front shied glass out line 125 and determines the front shield glass position FP and determines the front shield glass entrance timing tf. The front shield glass entrance timing tf may be detected by detecting a distance df between the front glass position FP and the front bumper position FBP and the speed of the vehicle 14.

Figure 35:
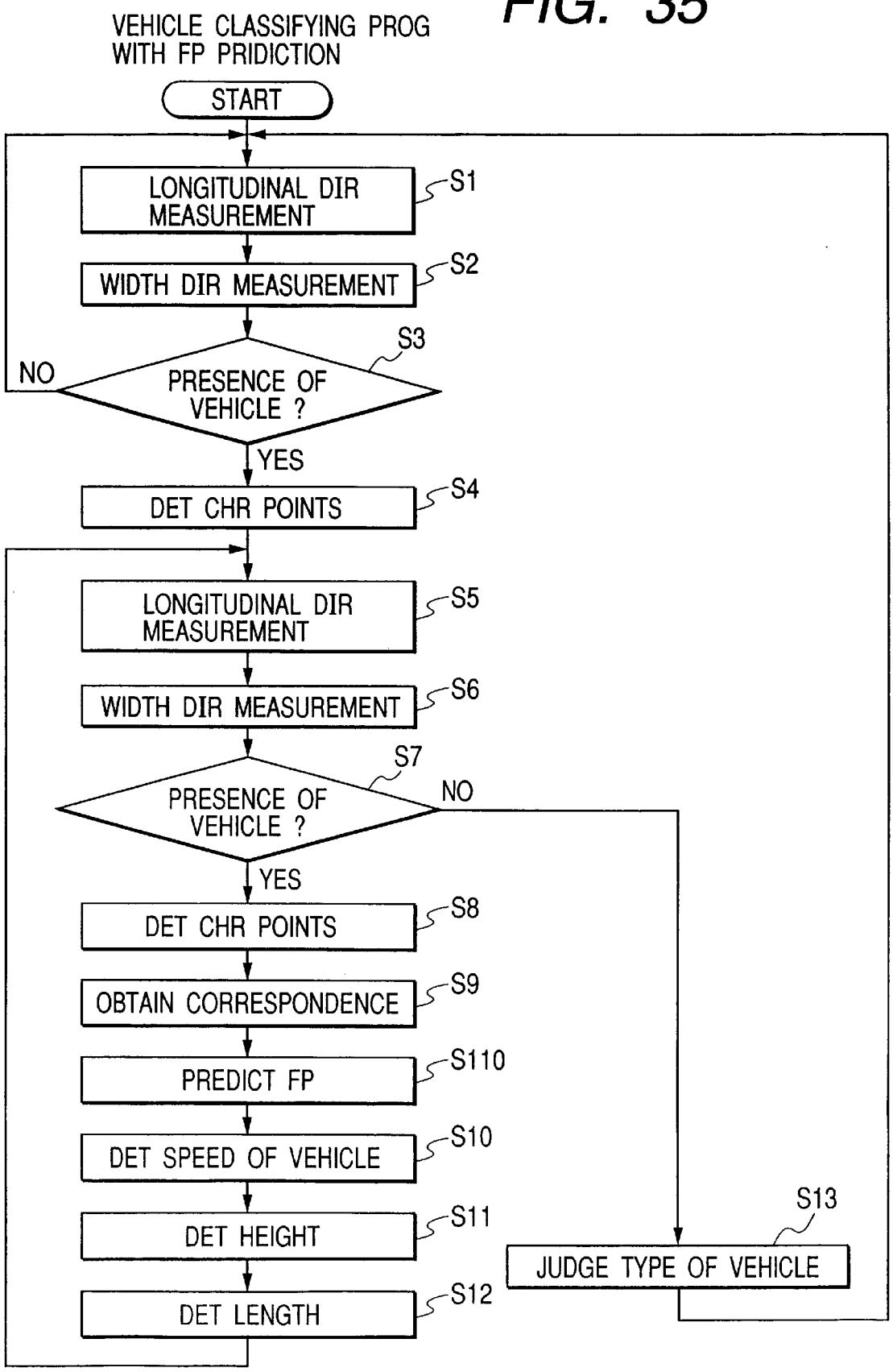
FIG. 35 depicts a flow chart of the seventh embodiment showing the classifying operation and front glass position prediction operation.

FIG. 35 depicts a flow chart of the seventh embodiment showing the classifying operation and front shield position prediction operation.

The control circuit 118 executes the vehicle classifying program as shown in FIG. 35.

At first, the control circuit 118 effects the longitudinal direction measurement in step S1. The control circuit 118 effects the width direction measurement in the following step S2 and judges whether the vehicle 14 to be detected is present within the detection zone S in step S3. In the absence of the vehicle 14, processing loops around steps S1 to S3 until the vehicle 14 is detected. In the presence of the vehicle 14 in step S3, the control circuit 118 obtains an outline L1 along the scanning line 15 to determine characteristic positions P from the distance data D1 at measuring points and obtains characteristic points P along the scanning line 17 to determine an outline L2 along the scanning line 17 in step S4. This provides positions of the characteristic points P as shown in FIG. 34 and FIG. 4B. In step S3, in the presence of the vehicle 14, the control circuit 118 sets an entrance flag and the presence flag which are commonly used in other programs.

Then, the control circuit 118 effects the longitudinal (travelling) direction measurement in step S5 and the width direction measurement in step S6 again. The control circuit 118 detects whether the vehicle is present. In the presence of the vehicle 14, the control circuit 14 obtains characteristic points P and their positions in the detection zone S in step S8. In the following step S9, the control circuit 118 obtains correspondence between the characteristic points P and the characteristic points P obtained in the previous longitudinal direction measurement and width direction measurement. In the following step S110, the control circuit 118 obtains the front shied glass outline 125 from the outline L1 which corresponds to the front shield glass and determines the front shield glass position FP and obtains the distance df from the front bumper position FBP to the front shield glass position FP.

Then, the control circuit 118 obtains a travelling distance TD from the characteristic points P and the characteristic points P obtained in the previous longitudinal direction measurement and width direction measurement and calculates a speed of vehicle 14 in step S10. Then, the control circuit 118 obtains a height of the vehicle in step S11, a length of the vehicle 14 in step S12 from the data of the outlines L1 and L2.

FIG. 8 is also referred in the seventh embodiment which has been referred in the first embodiment showing the operation of obtaining the correspondence and the travelling distance TD.

In obtaining the length of the vehicle 14, there is a possibility that the whole length of the vehicle 14 cannot be obtained from the measurement for one scanning cycle. However, it is possible to combine characteristic points Pn of the present scanning cycle with characteristic point Pn−1 of the previous scanning cycle to obtain the whole of the outlines L1 because portions of the characteristic points Pn and Pn−1 has the correspondence which have been obtained in step S9.

Processing from the step S5 to S12 is repeated until the control circuit 118 detects the absence of the vehicle 14 in step S7. Moreover, in step S7, in the absent of the vehicle 14, the control circuit 118 resets the entrance flag and the presence flag and sets an exit flag.

In the absence of the vehicle 14 in step S7 (the answer is NO), the control circuit 118 classifies the vehicle 124 in accordance with the data obtained in this classifying program and reference vehicle class data in step S13 and then, processing returns to step S1.

In classifying vehicle, the length of the vehicle 14 can be obtained. However, if a trailer is trailed by a trailer track with a coupler and if only the longitudinal direction is effected, there is a possibility that the control circuit 118 erroneously judges that there are two vehicle because the coupler may not be detected. However, in this embodiment, both the longitudinal direction measurement and the width direction measurement are effected, so that it is possible to detect the coupler and to judge that there are the trailing track and the trailer.

The control circuit 118 further executes other programs, such as a shooting program, a communicating program, a vehicle communication unit identification program, a communication program, and an unrighteous travelling processing program, in parallel in the multi-task operation, wherein information is transferred to another program through flags or data in a memory (not shown). Alternatively, multiprocessors sharing the common memory can be used. Moreover, these programs and the vehicle classifying program are shown with assumption that there is only one vehicle 14 in the detection zone S or the communication zone C. If there are more than one vehicle in the detection zone S or the communication zone. These processes and the process for classifying shown in FIG. 35 are effected to respective vehicles in parallel.

FIGS. 36 to 39 depicts flow charts of the seventh embodiment showing the shooting program, the vehicle communication unit identification program, the communication control program, and the unrighteous travelling processing program, respectively.

Figure 36:
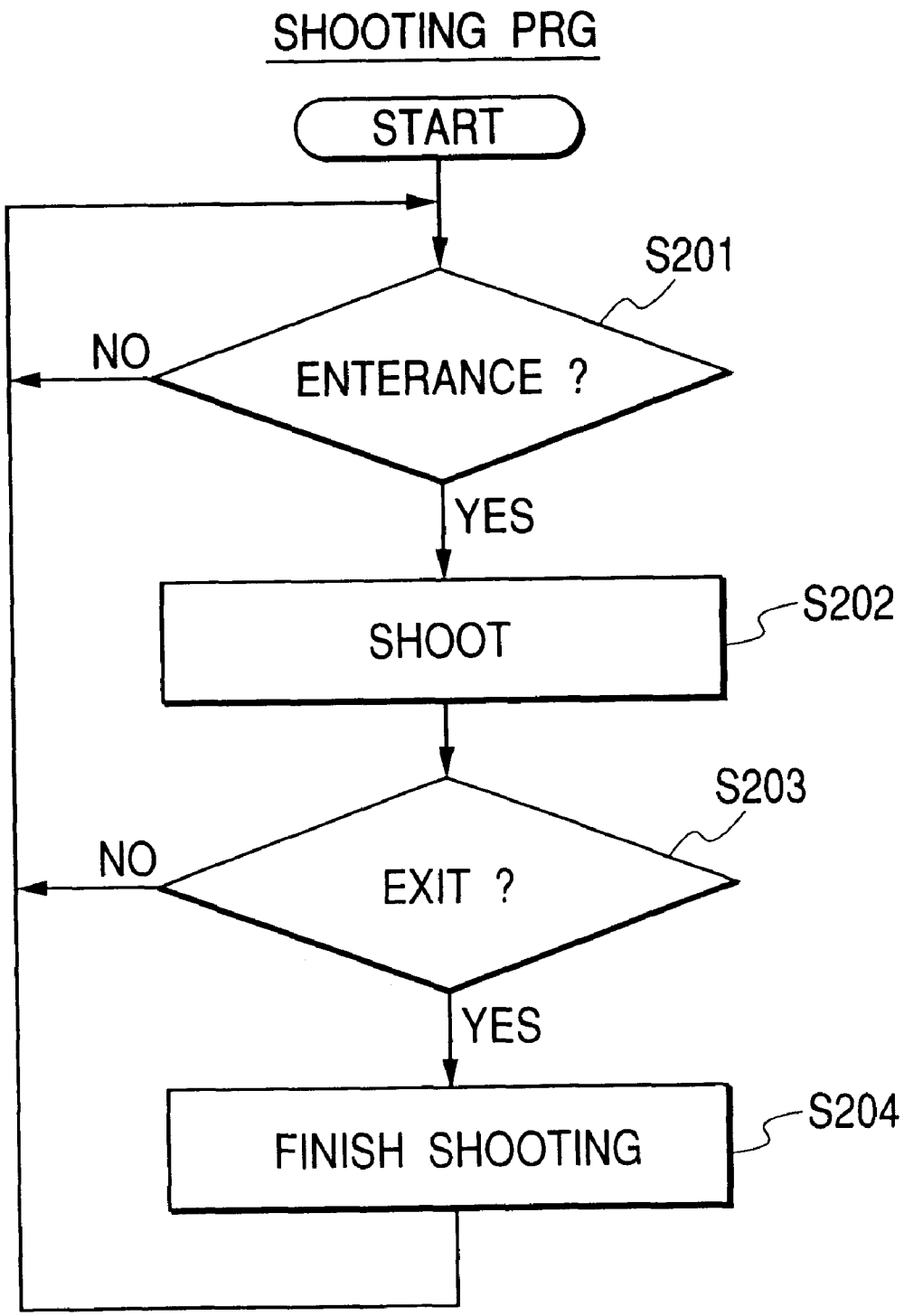
FIGS. 36 to 39 depict flow charts of the seventh embodiment showing the shooting program, the vehicle communication unit identification program, the communication control program, and the unrighteous travelling processing program, respectively.

At first the shooting program will be described. In FIG. 36, in step S201, the control circuit 118 checks whether the vehicle enters the detection zone S by checking the entrance flag set in the step S3 in FIG. 35. If the vehicle does not enter the detection zone S, processing waits the entrance of the vehicle in step S201. If the vehicle enters the detection zone S, the control circuit 118 operates the video camera 115 to shoot the number plate of the vehicle or the driver in step S202.

In the following step S203, the control circuit 118 checks whether the vehicle 14 exits at the detection zone S by checking the exit flag set in the step S7 in FIG. 35. If the vehicle 14 does not exit the detection zone S, processing waits the exit of the vehicle in step S203. If the vehicle exits the detection zone S, the control circuit 118 stops shooting in step S203 and processing returns to step S201.

The vehicle communication unit identification program will be described with reference to FIG. 37.

As mentioned above, the detection zone S and the communication zone C are arranged to overlap each other. However, there may be timing difference between the communication start timing tcs and the front shield glass position entrance timing tf, so that it is necessary to confirm that there is correspondence between the position of the vehicle communication unit 120 determined by the communication start timing tcs and an entrance timing of the position of the vehicle communication unit 120, that is, the front shield glass position entrance timing tf. Then, the timing difference between the communication start timing tcs and the detected shield glass position timing tf should be within the predetermine interval.

The control circuit 118, in step S301, compensates a predetermined interval in accordance with the speed of the vehicle 14 obtained in step S10 because the timing difference inverse-proportinally varied with the speed of the vehicle 14. In the following step S302, the control circuit 118 checks whether the front shield glass position FP and the front glass shield entrance timining tf have been obtained. If the front shield glass position FP and the front glass shield entrance timinig tf have been obtained, the control circuit 118 checks whether communication with the vehicle communication unit 120 has been effected within the predetermined interval in step S305. If the communication with the vehicle communication unit 120 has been possible within the predetermined interval from the detection (prediction) of the front shield glass position FP in step S305, the control circuit 118, in step S306, identifies the vehicle communication unit 120 which communicates with the communication unit 117 as that the vehicle 14 detected by the distance measurement detection. In the following step S307, the control circuit 118 transmits the data obtained from the distance data and from the vehicle communication unit 120 and the correspondence result obtained in step S305 and S306 to the toll gate computer 121 though the lane controller 119. The toll gate computer 121 communicates with the bank 123 through the network 122 to request payment of the toll.

In step S305, if the communication with the vehicle communication unit 120 is impossible within the predetermined interval from the front shield glass entrance timinig tf, processing returns to step S301.

In step S302, if the front shield glass position FP has not been obtained, the control circuit 118 checks whether communication with the vehicle communication unit 120 has been effected in step S303. If communication has been effected, the control circuit 118 checks whether the front shield glass position FP enters the detection zone S within the predetermined interval in step S308. If the front shield glass position FP enthers the detection zone S within the predetermined interval, the control circuit 118 executes the steps S306 and S307 similarly.

In step S308 if the front shield glass position FP does not enter the detection zone S within the predetermined interval, processing proceeds to step S301 without identification.

In step S303, if communication with the vehicle communication unit 120 has not been effected in step S303, the control circuit 118 checks whether the vehicle 14 exits the detection zone S in step S304. If the vehicle 14 does not exit the detection zone S, processing returns to step S302. If the vehicle 14 excites the detection zone S, processing returns to step S301 without identification.

As mentioned, though there may be a slight timing difference regarding the position of the vehicle communication unit 120 between the distance measurement by scanning the laser beams 15 and 17 and the communication with the microwave, corespondence between the vehicle communication unit 120 and the vehicle 14 can be provided by the distance measurement by scanning the laser beams 15 and 17 and the communication with the microwave signal.

The communication control program will be described with reference to FIG. 38.

The control circuit 118 checks whether the vehicle 14 enters the detection zone S in step S401. If the vehicle 14 does not enter the detection zone S, processing waits the entrance of the vehicle in step S401. If the vehicle 14 enters the detection zone S, the control circuit 118 operates the communication unit 117 to communicate with the vehicle communication unit 120 in step S402. Then, the control circuit 118 checks whether the communication is effected in step S403. If the communication is effected in step S403, the control circuit 118 stores the communication historic data indicative of the communication start timing tcs and the identification data in step S406. In the following step S405, the control circuit 118 stops the communication in step S405.

In step S403, if the communication is not effected in step S403, the control circuit 118 checks whether the vehicle 14 exits at the detection zone S in step 404. If the vehicle 14 exits the detection zone S in step S404, the control circuit 118 stops the communication by the communication unit 117*a* in step S405. If the vehicle 14 does not exit the detection zone S in step S404, processing returns to step S403.

Figure 39:
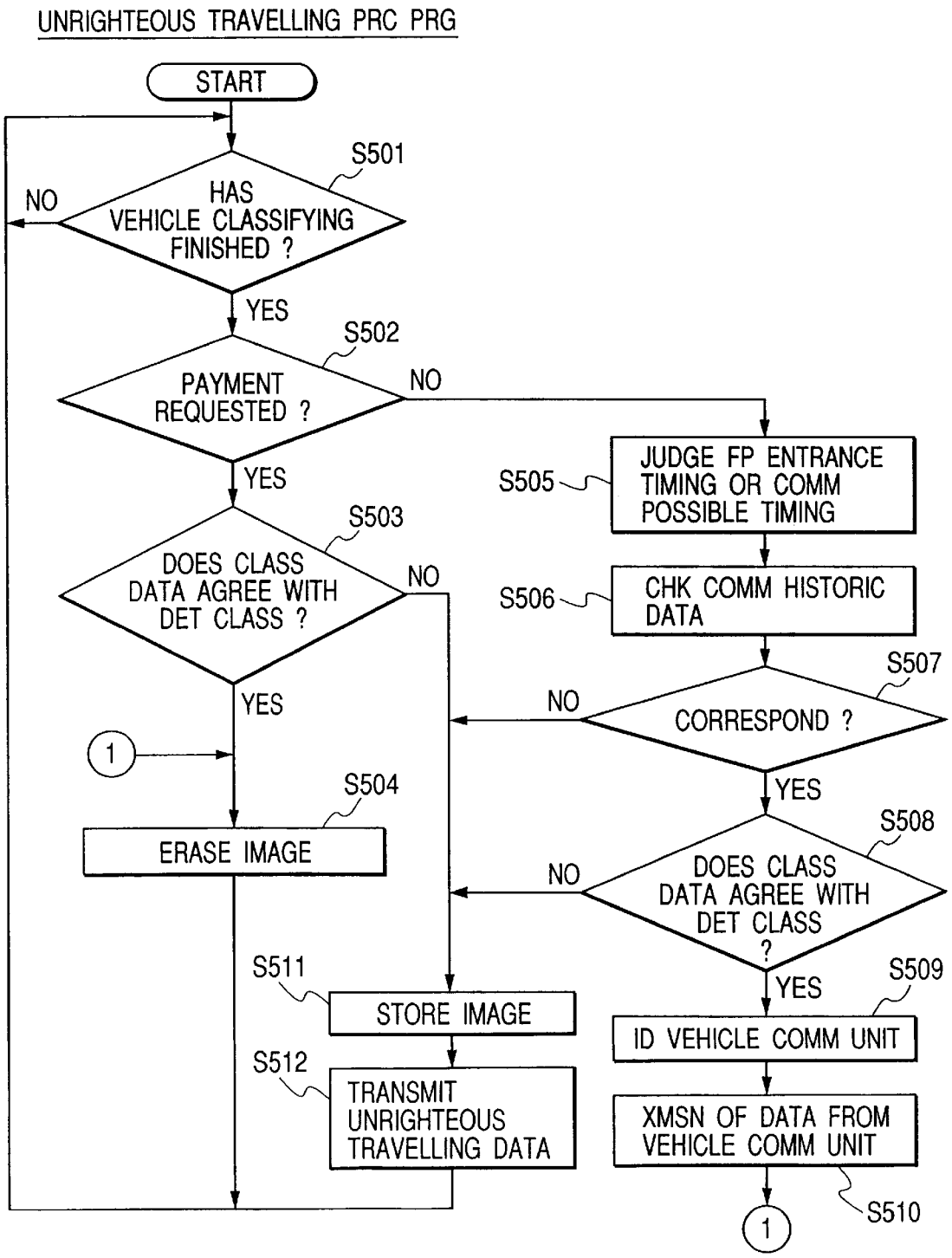

The unrighteous travelling processing program will be described with reference to FIG. 39.

The control circuit 118 checks whether the vehicle classifying process has been finished in step S501. If the vehicle classifying process has finished in step S501, the control circuit 118 checks whether a request for payment of the toll has been finished. If the request for payment of the toll has finished, the control circuit 118 checks whether the class data obtained from the vehicle communication unit 120 agrees with the classifying result using the distance data. If the class data obtained from the vehicle communication unit 120 agrees with the classifying result using the distance data, the control circuit 118 operates the video camera 115 to erase the image of the number plate of the vehicle 14 in step S504 and processing returns to step S501.

In step S503, if the class data disagrees with the class detected from the distance data, the control circuit 118 judges that the vehicle 14 unrighteously travels the lane 11, so that the control circuit 118 operates the video camera 115 to store the image of the number plate or the driver in step S511 and transmits unrighteous travelling data to the toll gate computer 120 in step S512. Then, processing returns to step S501. Then, the operator in the toll gate is informed of unrighteous travelling and can know the unrighteously travelling vehicle in accordance with the stored image of the number plate or the driver.

On the other hand, in step S502, the request for the payment of toll has not been effected, the control circuit 118 judges the front shield position FP as the position of the vehicle communication unit 120 from the class of the vehicle 14 and judges the front shield glass entrance timing tf or a communication possible timing in step S505. In the following step S506, the control circuit 118 checks the communication historic data in step S506. If the detected front shield glass entrance timing tf or the communication possible timing tcp agrees with the detected communication start timing tcs in the historic data with the identification data referred in step S507, the control circuit 118 checks whether the class data agrees with the detected class in step S508. If the class data from the vehicle communication unit 120 agrees with the detected class in step S508, the control circuit 118 identifies the vehicle communication 120 and the vehicle 14 as the registered vehicle. That is, the control circuit 118 judges that there is correspondence between the vehicle communication unit 120 and the vehicle 14 in step S509. In the following step S510, the control circuit 118 transmits the class data to the toll gate computer to request payment of toll. Then, processing proceeds to step S504 and returns to step S501.

In step S507, if the answer is NO and in step S508, the answer is NO, the control circuit 118 stores the image of the number plate or the driver in step S511 and transmits the unrighteous travelling data to the toll gate computer 121.

Examples of processing mentioned above will be described.

Figure 40A:
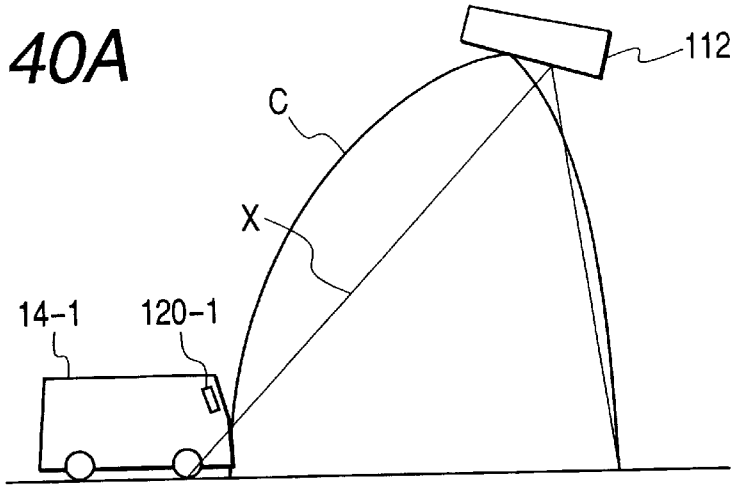
FIGS. 40A to 40C are side views of the seventh embodiment showing a first example of processing.
Figure 40B:
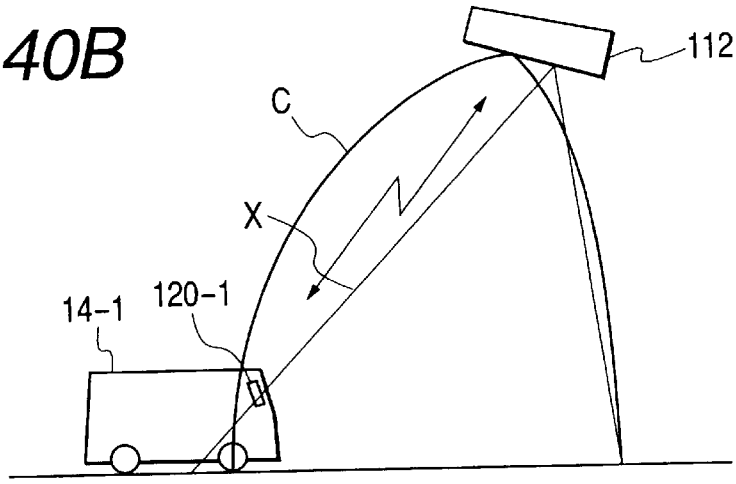
Figure 40C:
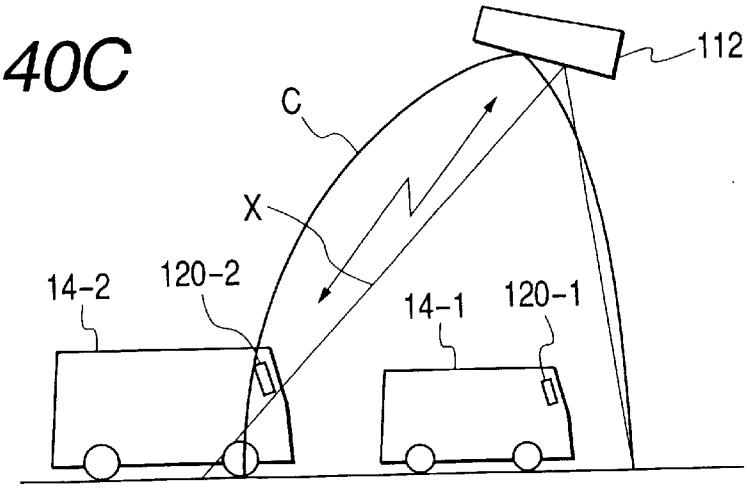
Figure 41A:
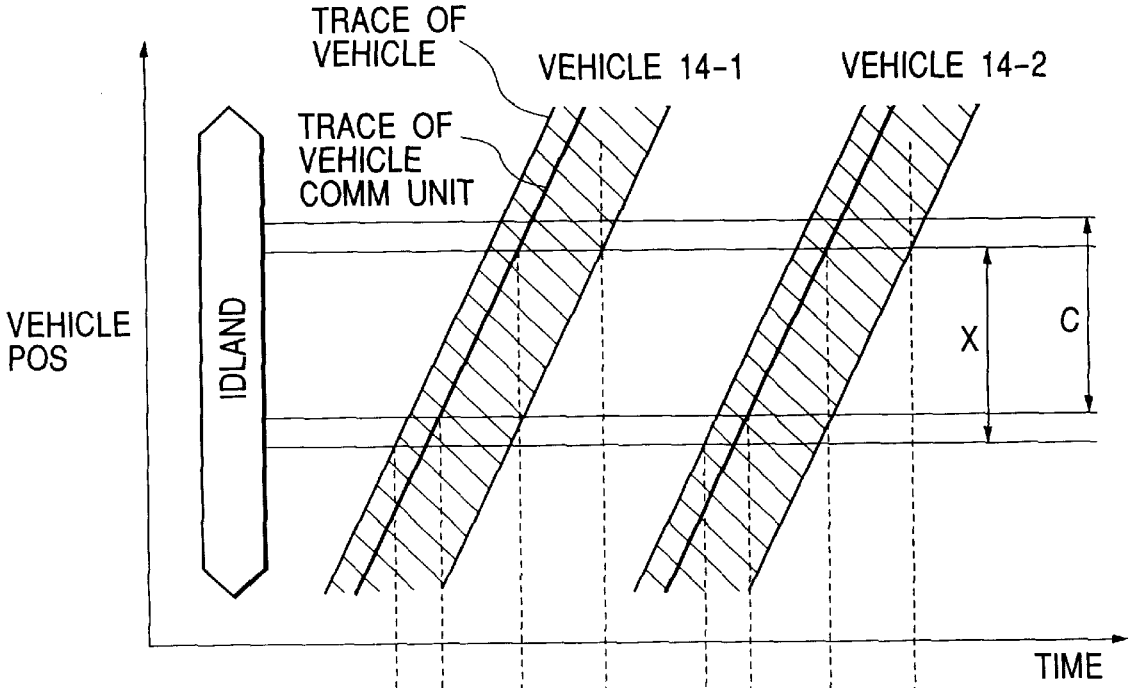
FIG. 41A is a graphical drawing of the seventh embodiment showing positional relation of the first example in time base.
Figure 41B:
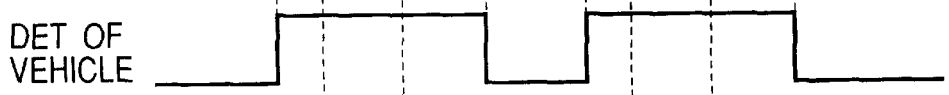
FIGS. 41B is a timing chart of the seventh embodiment showing detection of the vehicle in the first example.
Figure 41C:
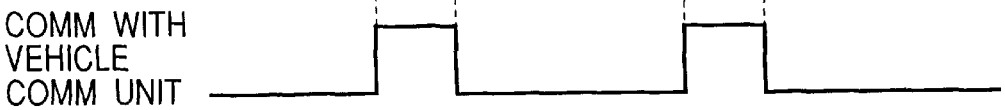
FIG. 41C is a timing chart of the seventh embodiment showing communication with the vehicle communication unit in the first example.

FIGS. 40A to 40C are side views of the seventh embodiment showing a first example of processing. FIG. 41A is a graphical drawing of the seventh embodiment showing positional relation of the first example in time base. FIG. 41B is a timing chart of the seventh embodiment showing detection of the vehicle 14-1 in the first example and FIG. 41C is a timing chart of the seventh embodiment showing communication with the vehicle communication unit 120-1 in the first example.

A first vehicle 14-1 which mounts the vehicle communication unit 120-1 enters the communication zone C and the scanning zone X (detection zone S) and then, a second vehicle 14-2 which mounts the vehicle communication unit 120-2 successively enters the communication zone C and the scanning zone X with a relatively long interval. Therefore, detection of the vehicles 14-1 and 14-2 are successively effected without overlapped timing as shown in FIGS. 41A to 41C, so that identification of the vehicle communication units 120-1 and classifying the first vehicle 14-1 and accounting has been completed and then, identification of the vehicle communication units 120-2 and classifying the second vehicle 14-2 and accounting is successively effected, so that the processing is simple.

Figure 42A:
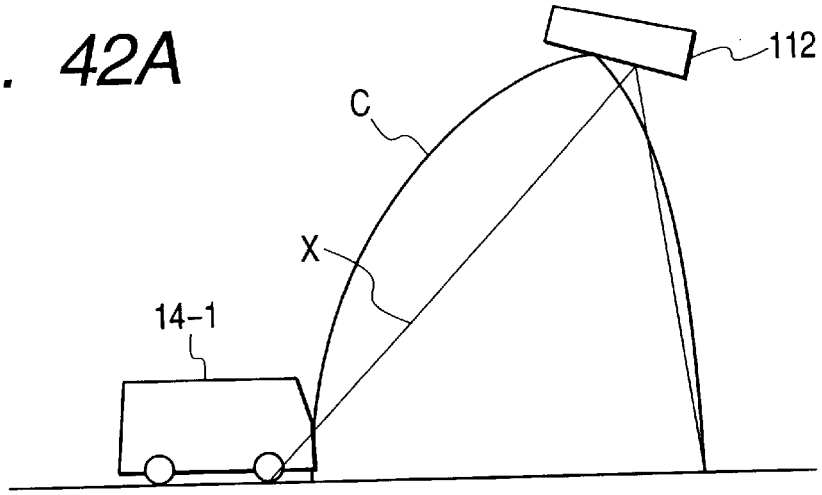
FIGS. 42A to 42C are side views of the seventh embodiment showing a second example of processing.
Figure 42B:
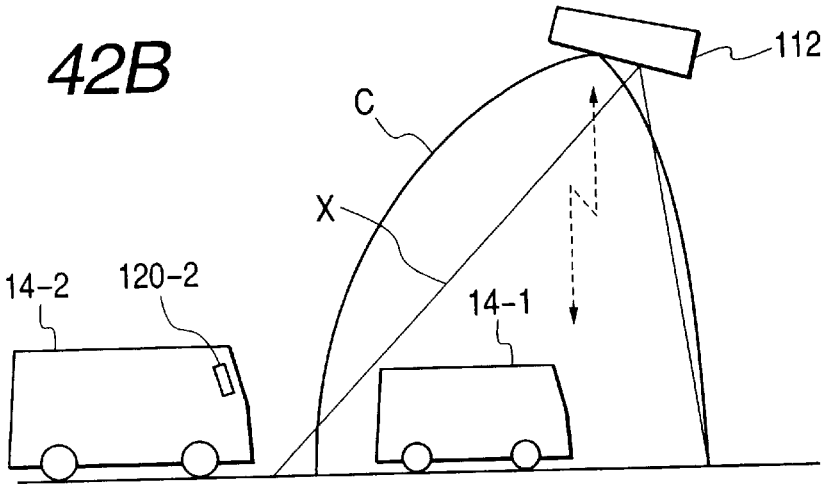
Figure 42C:
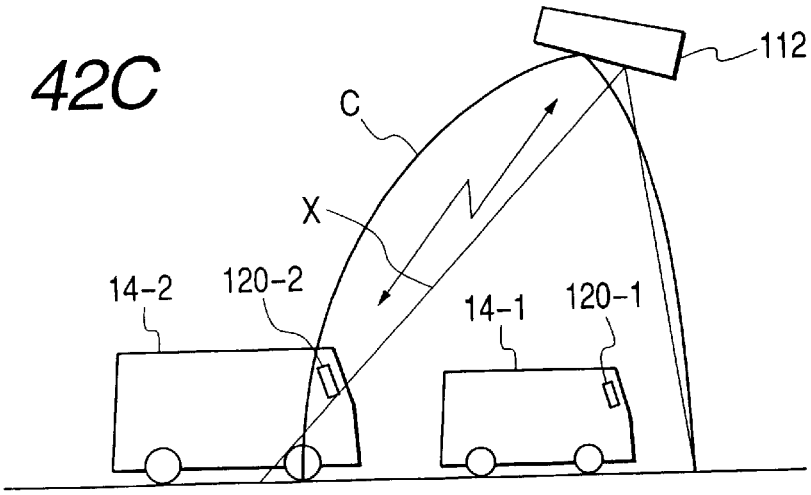
Figure 43A:
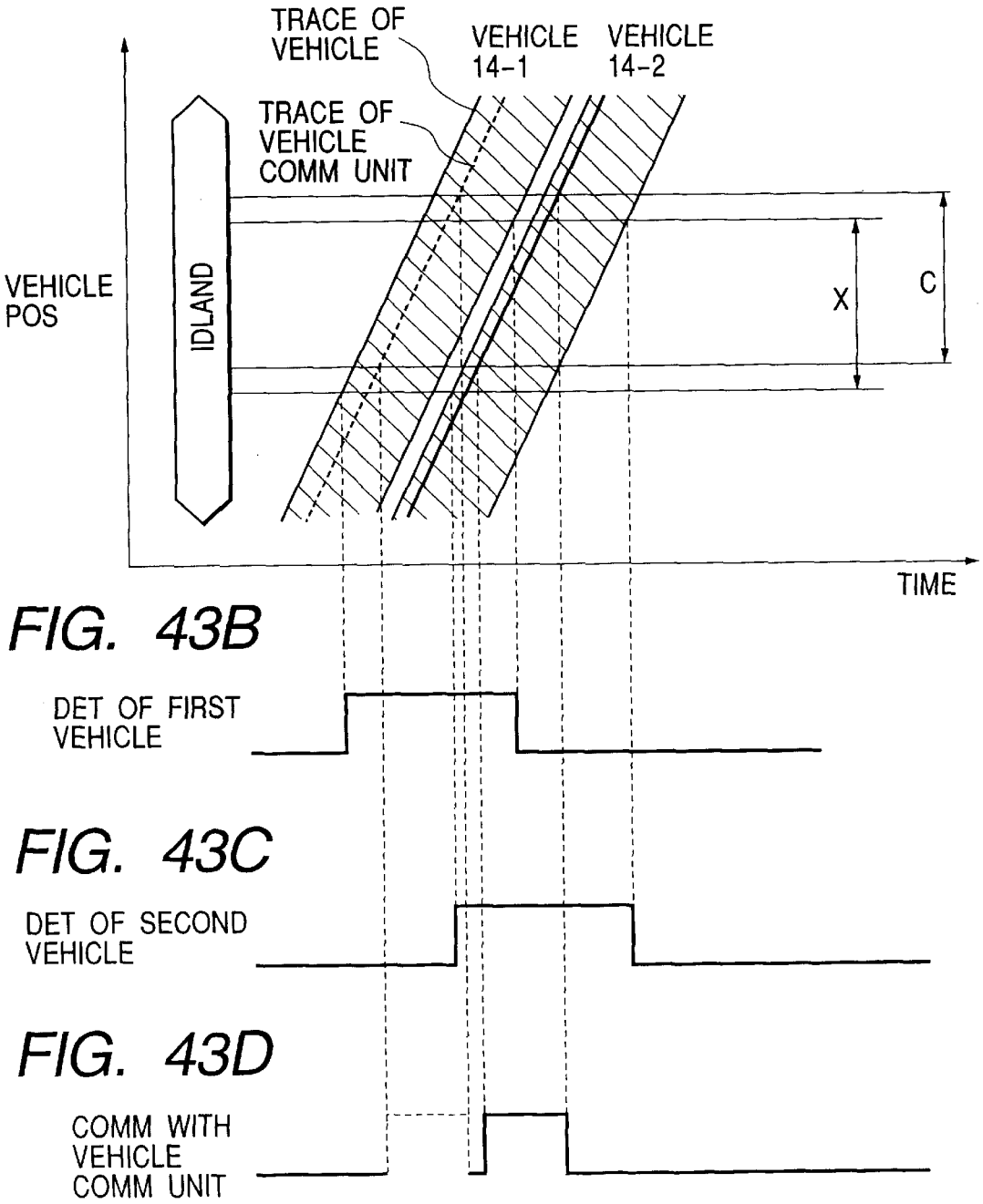
FIG. 43A is a graphical drawing of the seventh embodiment showing positional relation of the second example in time base.

FIGS. 42A to 42C are side views of the seventh embodiment showing a second example of processing. FIG. 43A is a graphical drawing of the seventh embodiment showing positional relation of the second example in time base. FIG. 43B is a timing chart of the seventh embodiment showing detection of the vehicle 14-2 in the second example and FIG. 43C is a timing chart of the seventh embodiment showing detection of the vehicle 14-2 in the second example. FIG. 43C is a timing chart of the seventh embodiment showing communication with the vehicle communication units 120-1 and 120-2 in the second example.

A first vehicle 14-1 which mounts no vehicle communication unit 120 enters the communication zone C and the scanning zone X and then, a second vehicle 14-2 which mounts a vehicle communication unit 120-2 successively enters the communication zone C and the scanning zone X with a short interval. Therefore, detection of the first vehicle 14-1 detection of the second vehicle 14-2 partially overlap each other. That is, two vehicle 14-1 and 14-2 are detected at the same time, so that it appears that the vehicle communication unit 120-2 is recognized as the vehicle communication unit 120 mounted on the first vehicle 14-1. In fact, the vehicle communication unit 120-2 is recognized as that mounted on the second vehicle 14-2 by the vehicle communication unit identification program shown in FIG. 37 by comparing the time difference between the detection of the front shield glass entrance timing and communication start timing. Therefore, accounting is correctly effected.

If there is no dead angle condition, the communication possible timing is measured from the entrance timing as mentioned above.

On the other hand, there is the possibility that the front shield glass position FP of the second vehicle 14-2 is not detected when the front shield glass position FP enters the detection zone X and the front shield glass position FP may be predicted after the second vehicle 14-2 has passed the detection zone X. In-this case, correspondence between the actual communication start timing and the-and the communication possible timing is confirmed with the historic data also. Therefore, the actual communication start timing is stored with the identification data as the historic data for later using.

Figure 44A:
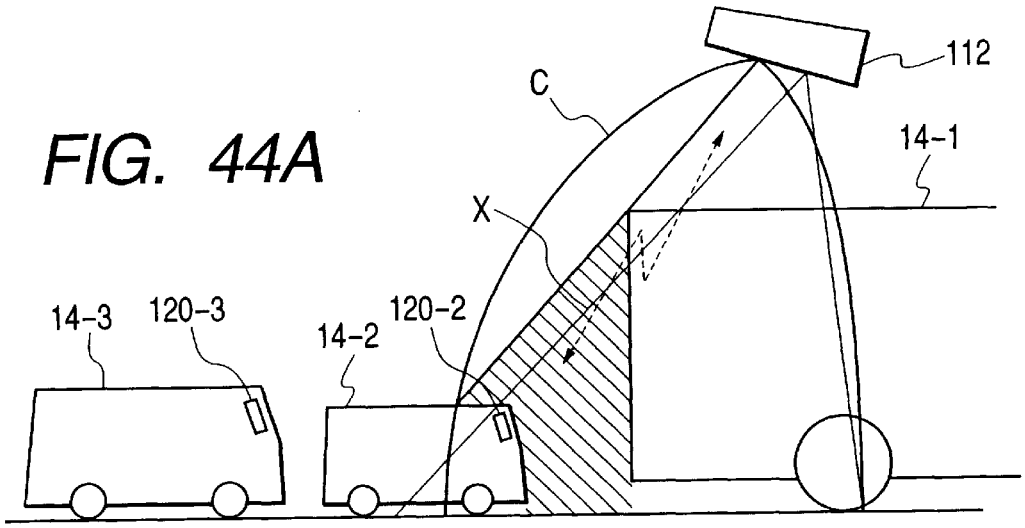
FIGS. 44A to 44C are side views of the seventh embodiment showing a third example of processing.
Figure 44B:
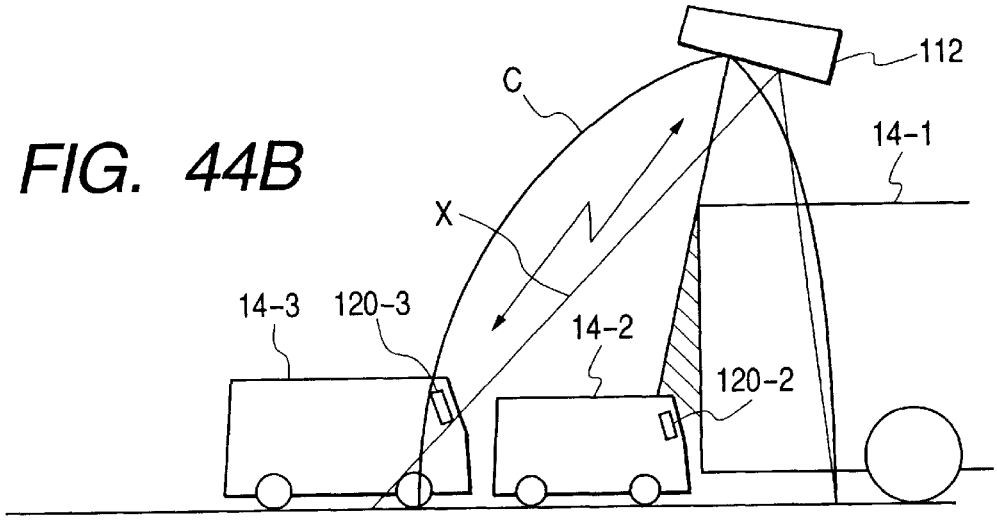
Figure 44C:
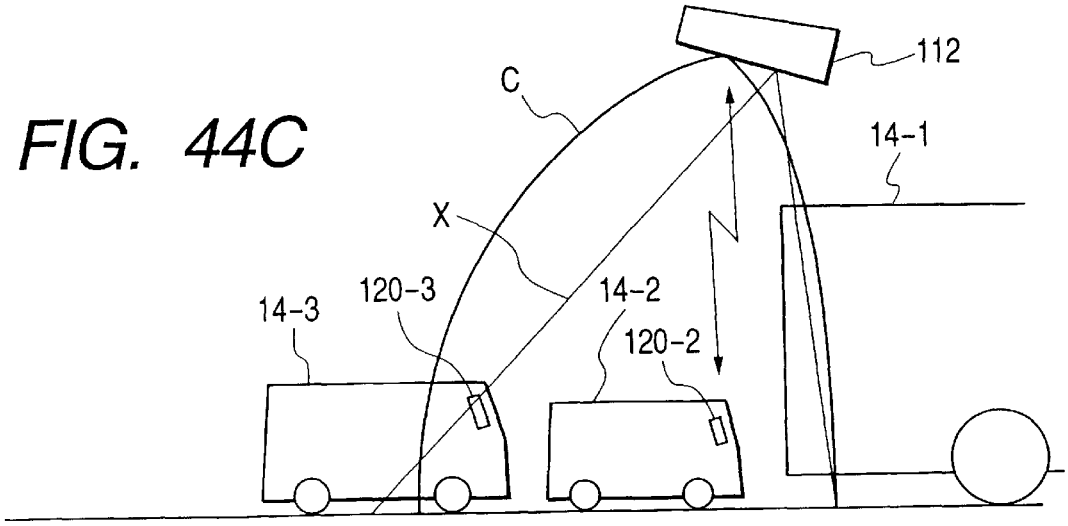

FIGS. 44A to 44C are side views of the seventh embodiment showing a third example of processing.

In FIG. 44A. a first vehicle 14-1 is travelling under the vehicle classifying unit 112 which is a truck having a tall wagon. A second vehicle 14-2, i.e., a small size passenger car, which mounts a vehicle communication unit 120-2 successively enters the communication zone C and the scanning zone X with a short interval. Therefore, the vehicle classifying unit 112 cannot detect the presence of the vehicle 14-2 until the condition shown in FIG. 44C, that is, the vehicle classifying unit 112 recognized the second vehicle 14-2 as a portion of the first vehicle 14-1 because the distance data images of the first and second vehicles 14-1 and 14-2 are connected each other and the communication with the vehicle communication unit 120-2 is impossible in the condition shown in FIGS. 44A and 44B. This condition is referred as a dead angle condition denoted by hatching in FIGS. 44A and 44B. In FIG. 44B, the third vehicle 14-3 having the vehicle communication unit 120-3 further enters the detection zone S and the vehicle classifying unit 112 communicates with the vehicle communication unit 120-3 of the third vehicle 14-3 before the second vehicle communication unit 120-2 communicates with the vehicle classifying unit 112. Then, the vehicle classifying unit 112 obtains the front shield glass entrance timing tf and the communication start timing tcs, wherein the timing difference therebetween is lower than the predetermined interval, so that the vehicle communication unit 120-3 can be identified as that mounted on the third vehicle 14-3.

In FIG. 44C, the first vehicle 14-1 is exiting the detection zone X and the second vehicle faces to the vehicle classifying unit 112. At this timing, the vehicle classifying unit 112 can communicate with the vehicle communication unit 120-2 and obtains the actual communication start timing of the vehicle communication unit 120-2 and the identification data which are stored as historic data. Then, the vehicle classifying unit 112 detects separation of the second vehicle 14-2 from the first vehicle 14-1. Then, the vehicle classifying unit 112 judges the communication possible timing tcp instead the front shield glass entrance timining tf in step S505 and checks the communication historic data in step S506 and checks whether the actual communication start timing in the historic data corresponds to the communication possible (to be communicated with) timing tcp in step S507 as mentioned above.

Eighth Embodiment

Figure 45:
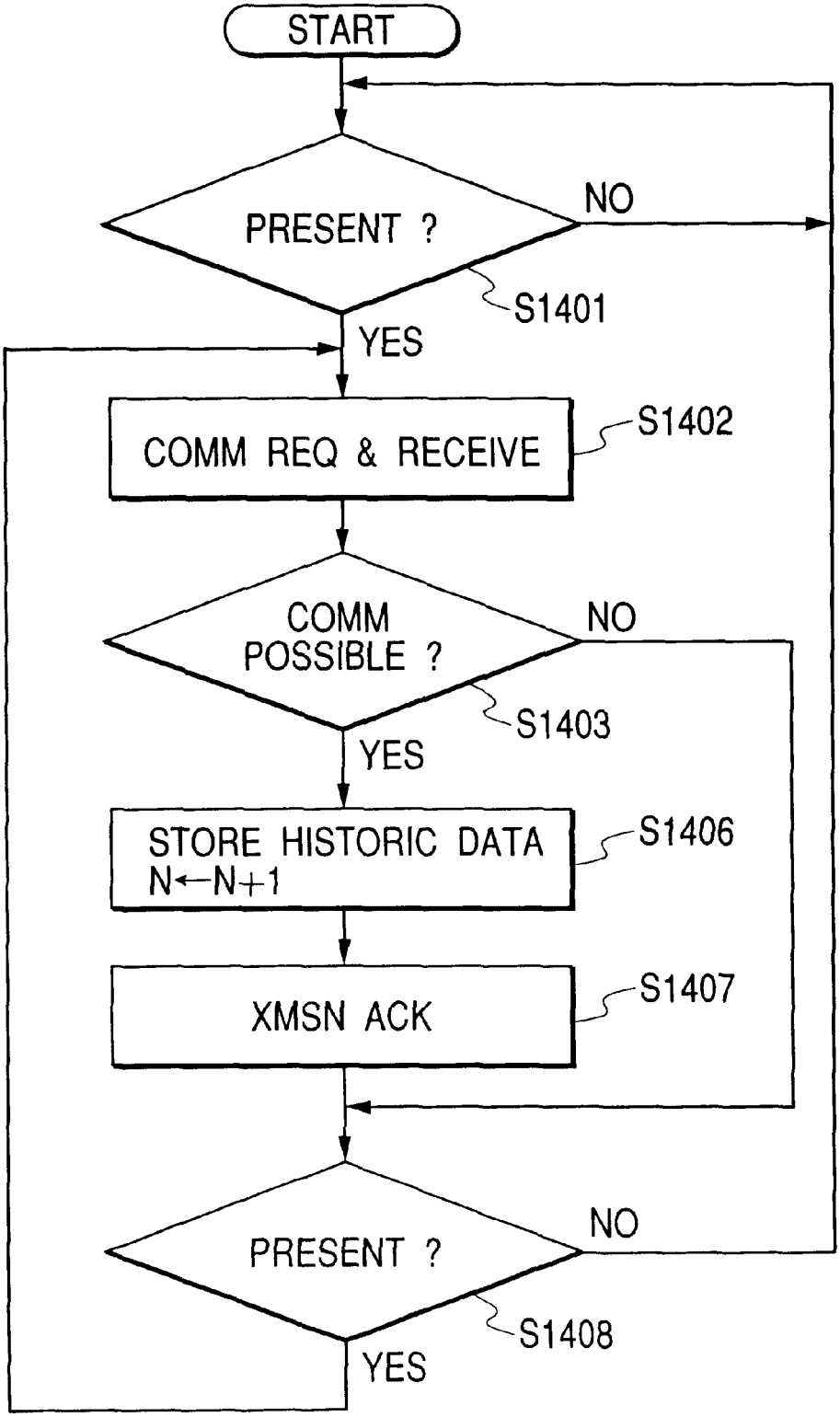
FIG. 45 depicts a flow chart of an eighth embodiment showing a communication operation.
Figure 46:
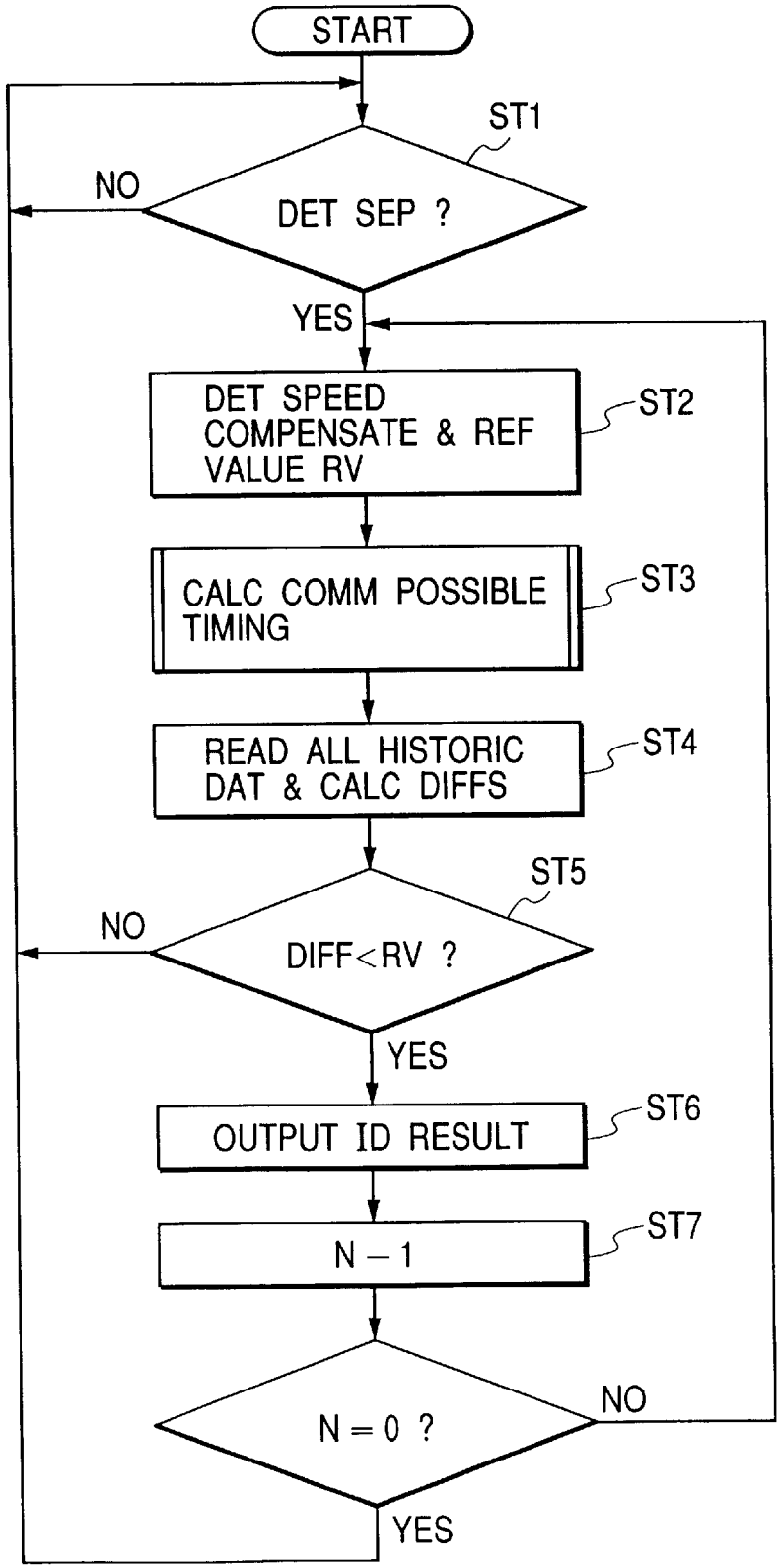
FIG. 46 depicts a flow chart of the eighth embodiment showing an identification operation.
Figure 47:
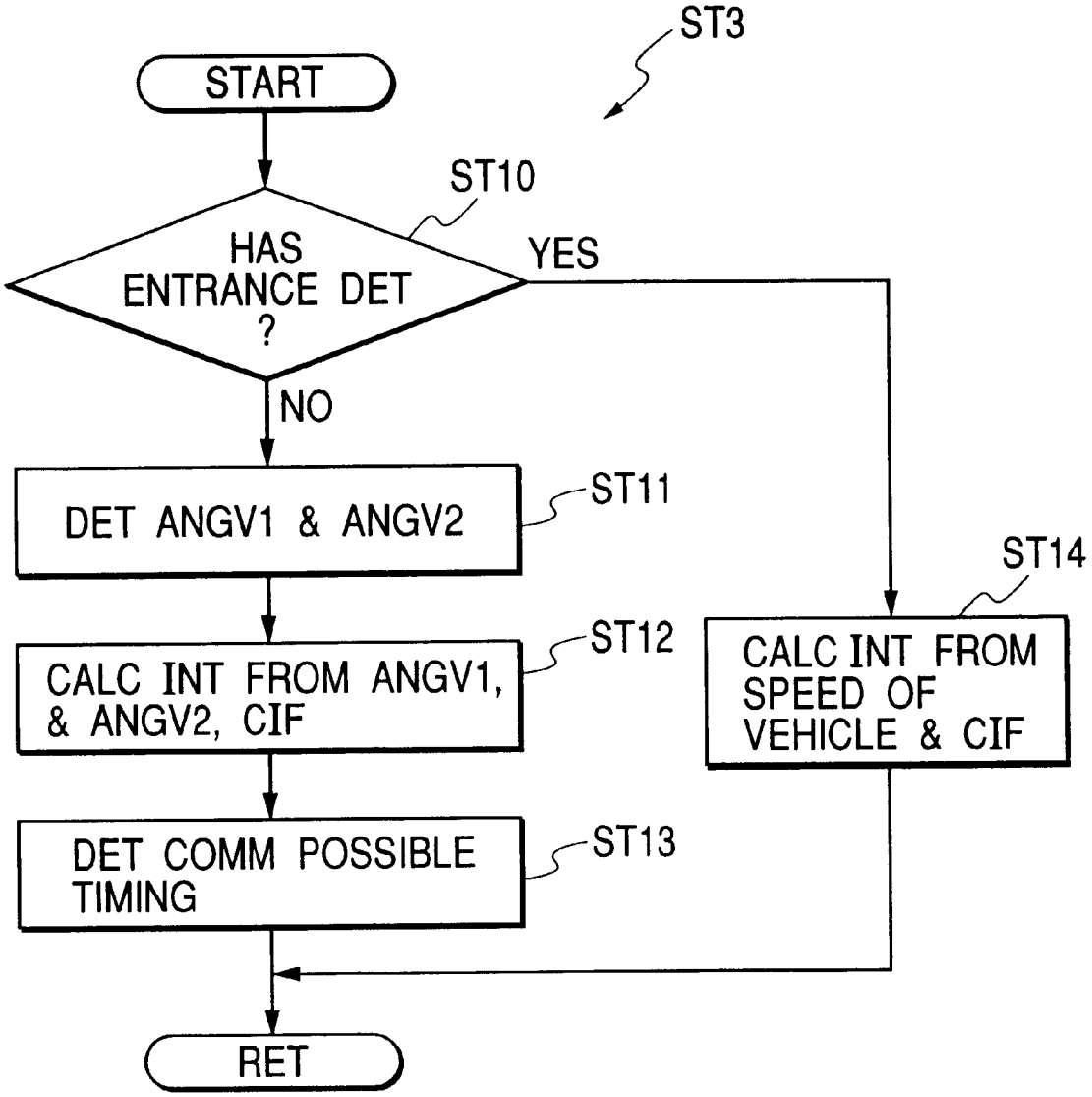
FIG. 47 depicts a flow chart of the eighth embodiment showing a subroutine shown in FIG. 46.

FIG. 45 depicts a flow chart of an eighth embodiment showing a communication operation. FIG. 46 depicts a flow chart of the eighth embodiment showing an identification operation. FIG. 47 depicts a flow chart of the eighth embodiment showing a subroutine shown in FIG. 46. FIGS. 48A to 48D are side views of the eighth embodiment showing an example of the identification operation.

The structure of the eighth embodiment is substantially the same as that of the seventh embodiment. The difference is that the identification of the mobile communication unit 120-2 is more accurately provided by the identification programs shown in FIGS. 45 to 47.

Figure 48A:
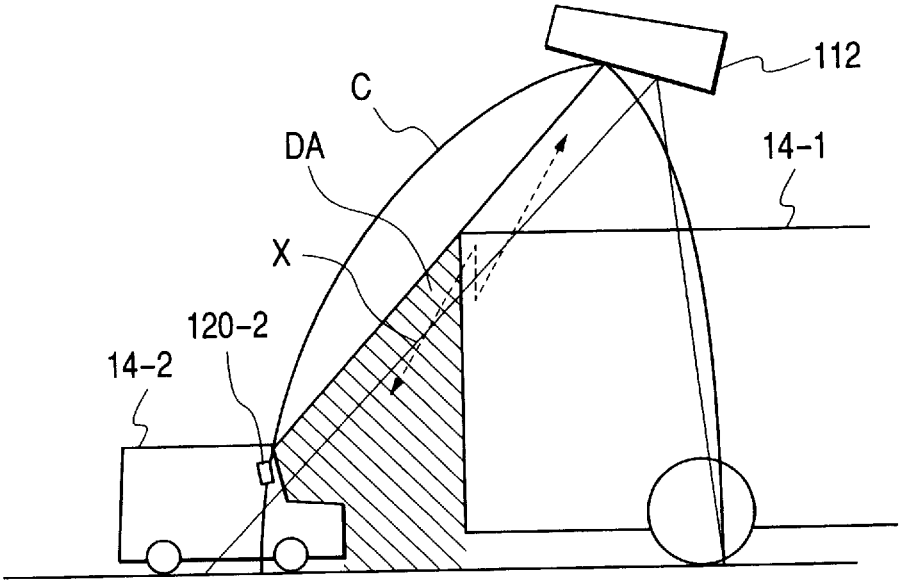
FIGS. 48A to 48D are side views of the eighth embodiment showing the identification operation.
Figure 48B:
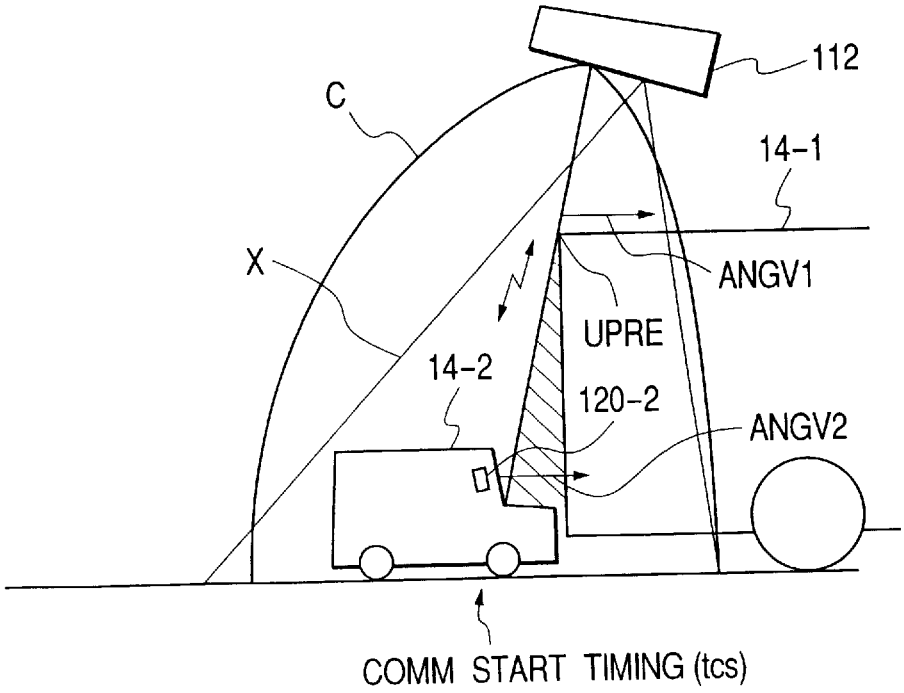
Figure 48C:
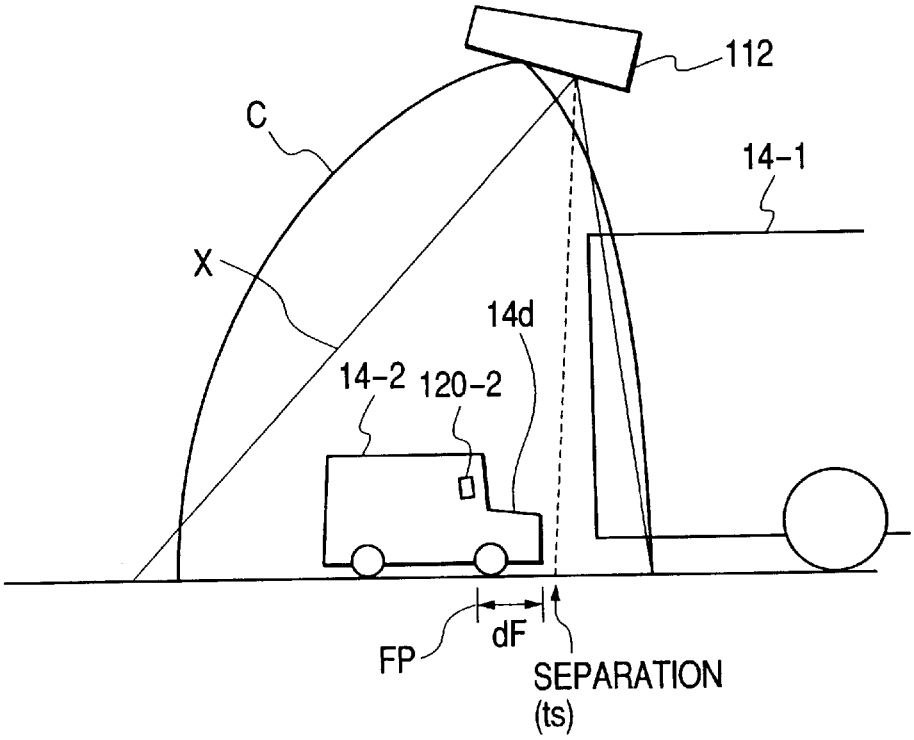

As similarly to the seventh embodiment the second vehicle 120-2 enters the detection zone S but cannot communicate with the vehicle classifying unit 112 because there is a dead angle DA as shown in FIG. 48A. Then, the second vehicle 120-2 faces the vehicle classifying apparatus 112 as shown in FIG. 48B and, at communication start timing tcs, the second vehicle 120-2 receives the communication request from the vehicle classifying unit 112 and transmits the identification data and class data which is received as the historic data because the vehicle classifying unit 112 repeatedly transmits the communication request in the presence of vehicle 14-1 or 14-2 (not responsive to entrance). Then, the vehicle classifying unit 112 detects separation of the vehicle 14-1 and the vehicle 14-2 in the distance measurement at separation timing ts as shown in FIG. 48C.

The communication possible timing tcp is calculated from an angular velocity ANGV1 of the upper rear edge UPRE of the first vehicle 14-1, an angular velocity ANGV2 of the front shield glass position FP of the second vehicle 14-2, and the front shield glass distance dF (between the front bumper position FBP and front shield glass position FP of the second vehicle 14-2. Therefore, the communication possible timing tcp is given by:

$$tcp=ts-dF/(ANGV1-ANGV2)$$

Figure 38:
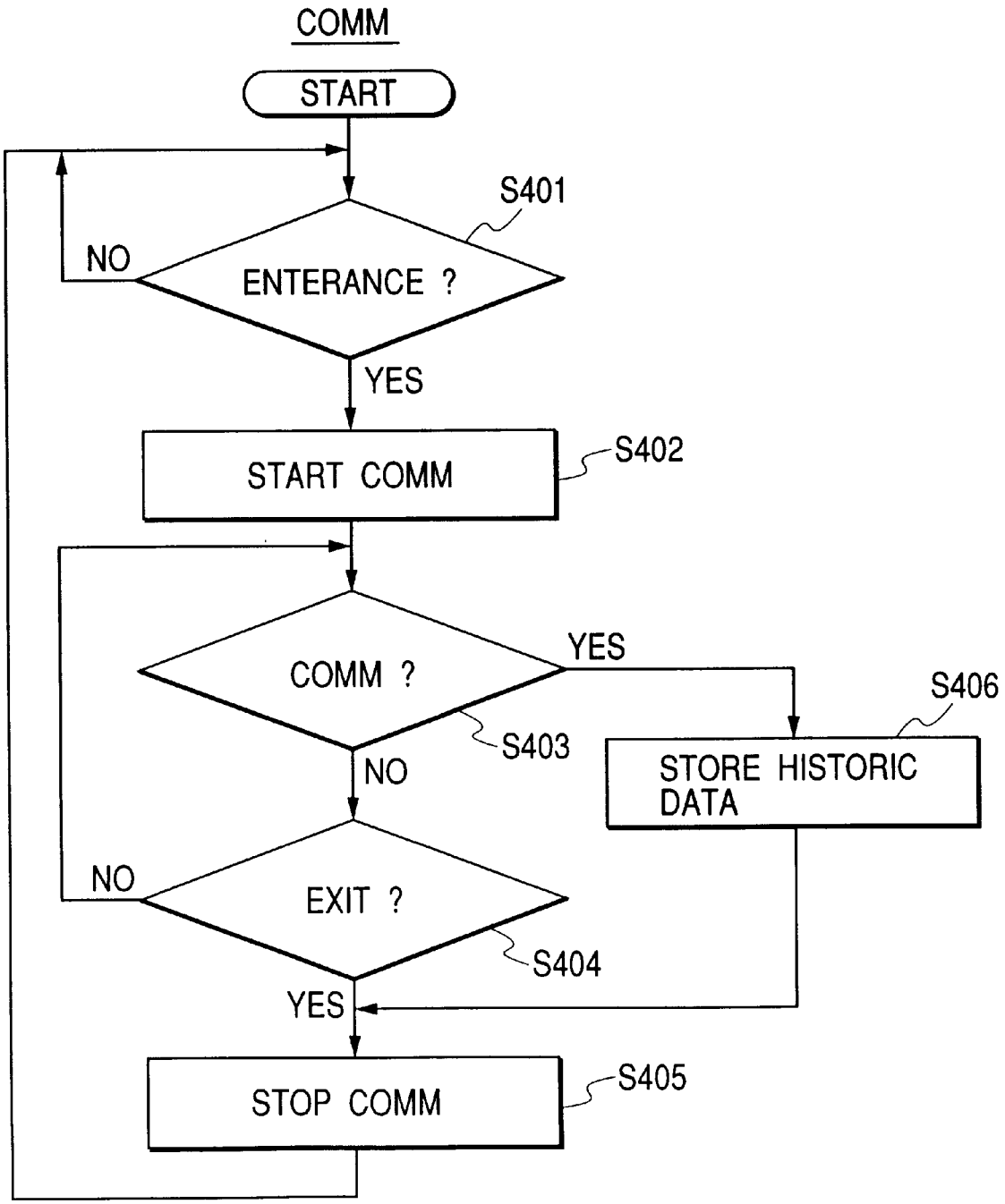

The vehicle classifying unit 112 executes the communication program as shown in FIG. 45 instead the communication program shown in FIG. 38. The communication program shown in FIG. 45 is substantially the same as that shown in FIG. 38. The difference is that the vehicle classifying unit 112 transmits a communication request repeatedly if there is at least a vehicle 14. Then, the vehicle 14-2 communicates with the vehicle classifying unit 112 as shown in FIG. 48. However, once acknowledge of receiving the class data and identification data is transmitted to the vehicle communication unit 120 which transmitted the class data and identification data, the vehicle communication unit 120 does not respond to a further communication request to this vehicle classifying apparatus using a timer (not shown). That is, when the vehicle classifying unit 112 detects the presence of the vehicle 14 in step S1401, the vehicle classifying unit transmits a communication request and receives the class data and the identification data in step S1402. If communication is possible in step S1403, the vehicle communication unit 112 stores the communication start timing tcs as historic data and increases the numbers of historic data N=N+1 in step S1406. Then, the vehicle classifying unit 112 transmits acknowledge including the identification data in step S1407 to make the vehicle communication unit 120 which transmitted the identification data silent. If the vehicle is present in the detection zone S in step S1408, processing returns to step S1402. If the vehicle is absent, processing returns to step S1401. Then, finally all vehicle communication units 120 within the detection zone S will respond.

Figure 37:
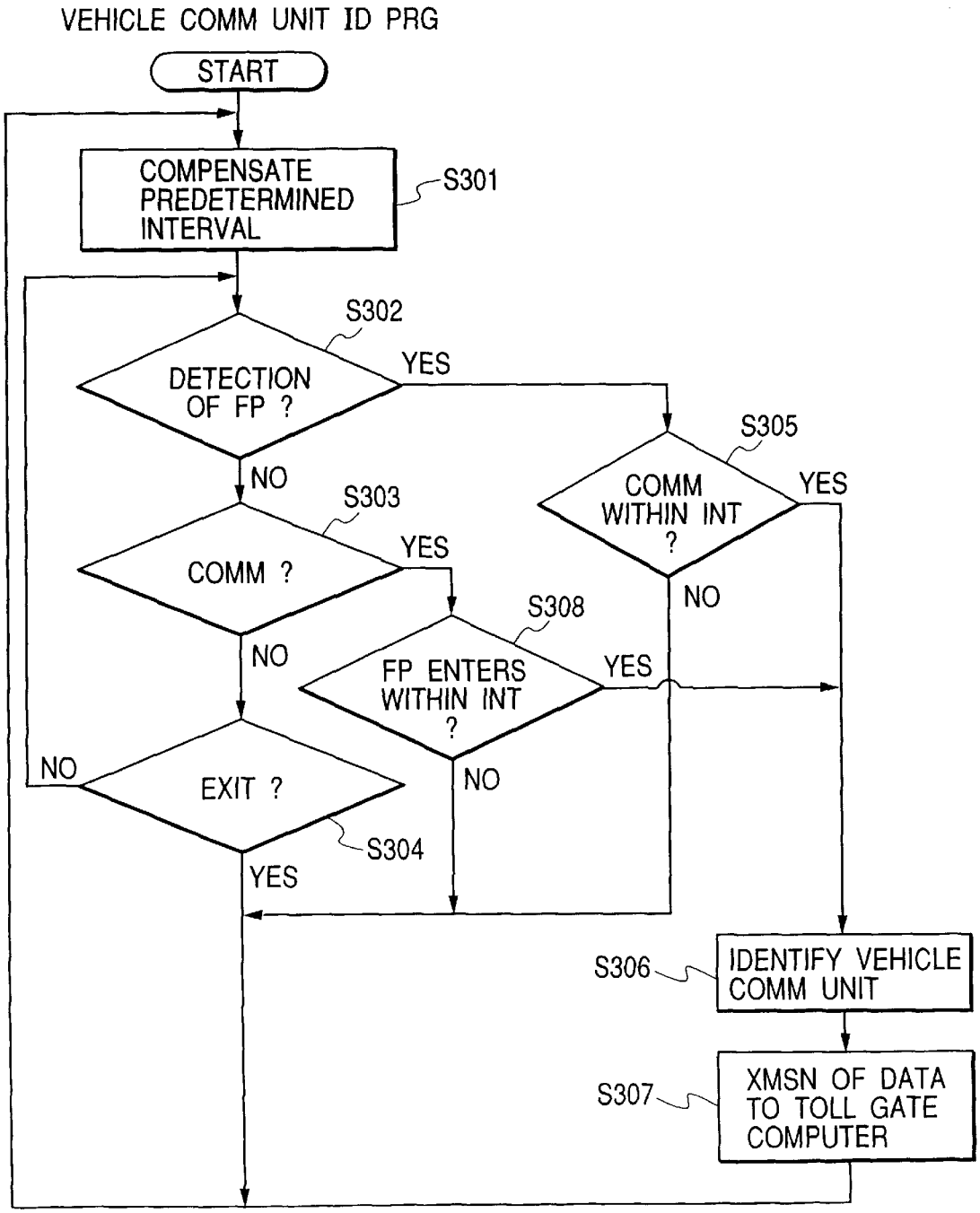

The vehicle classifying unit 112 executes the identification operation as shown in FIG. 46 instead the vehicle communication unit identification program shown in FIG. 37. In response to detection of separation of the vehicle 14-2 from the vehicle 14-1 in step ST1 as shown in FIG. 48C, the vehicle classifying unit 112 detects the speed of the vehicle 14-2 and compensates the predetermined interval (RV) in step ST2 and calculates the communication possible timing tcp in step ST3. In the following step ST4, the vehicle classifying unit 112 reads the historic data and calculates the differences between the communication start timings tsc in the historic data and the communication possible timing tcp. If the difference between the communication start timing tcs and the communication possible timing tcp is lower than the predetermined interval compensated in step ST2, the vehicle classifying unit 112 judges that the communication unit 120-2 is mounted in the second vehicle 14-2 and outputs the identification result in step ST6. The vehicle classifying unit 112 decreases the number of the historic data by one in step ST7 and if the number N is not zero, processing returns to step ST2. If the number N is zero processing returns step ST1.

The step ST3 is executed as follows:

As shown in FIG. 47, the vehicle classifying unit 120-2 checks whether entrance of the vehicle 14 has been detected. If entrance of the vehicle 14 has not been detected, the vehicle classifying unit 112 detects the angular velocity ANGV1 of the upper rear end UPRE of the first vehicle 14-1 and the angular velocity ANGV2 of the front shield glass position FP of the second vehicle 14-2 with respect to the vehicle classifying unit 112 In step ST12 to determine a front portion moving interval dF/(ANGV1-ANGV2). Then, the vehicle classifying unit 112 determines the communication possible timing tcp of the second vehicle 14-2 from the angular velocities ANGV1 and ANGV2, and the front shield distance dF.

Figure 48D:
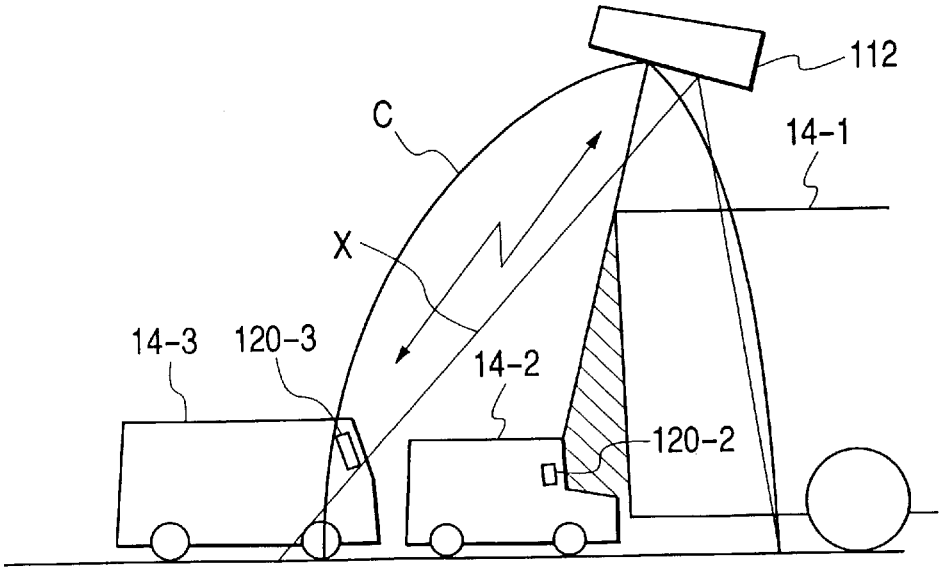
Figure 49:
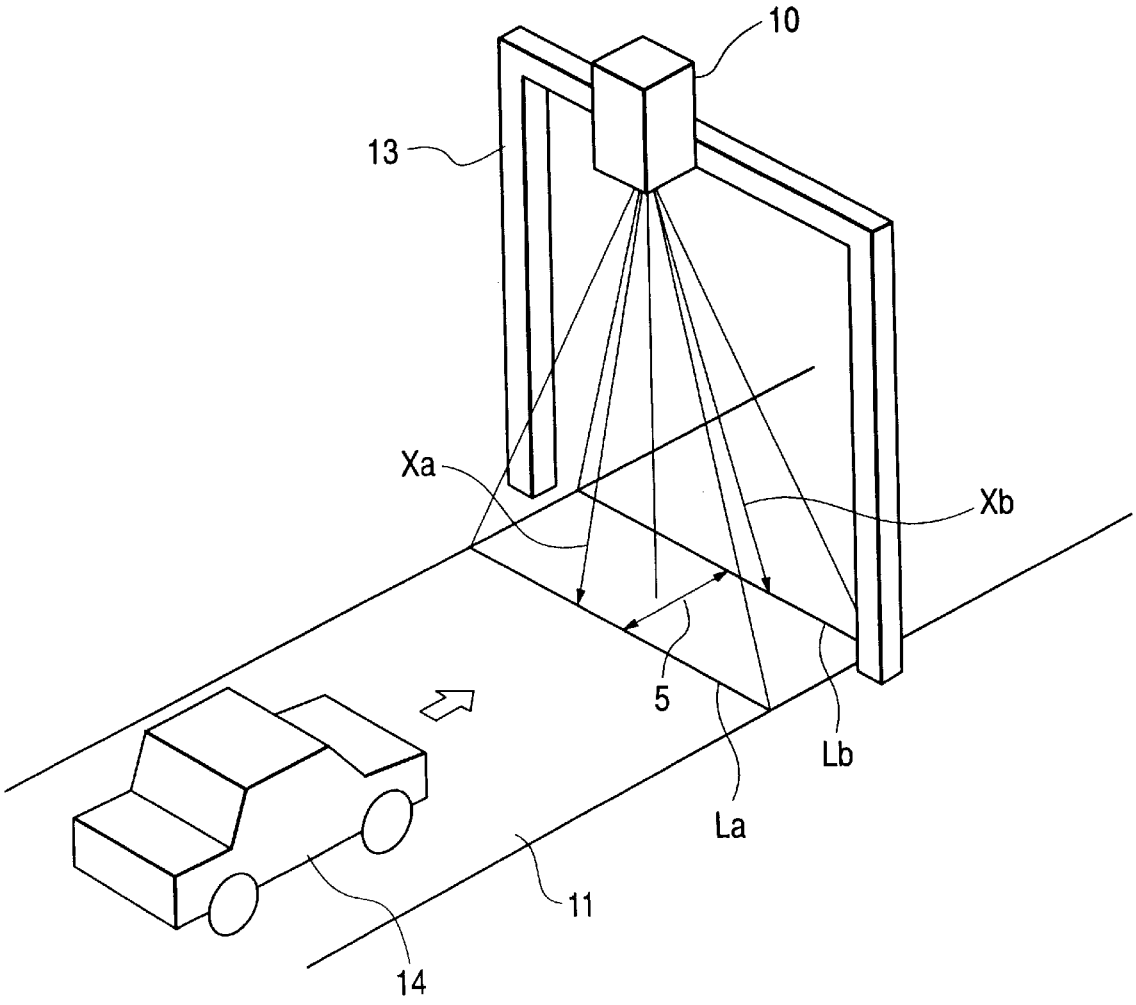
FIG. 49 PRIOR ART
FIG. 49 is a perspective view of a prior art vehicle classifying apparatus.

As shown in FIG. 48D, if there is the third vehicle 14-3 which communicates with the vehicle classifying unit 120 earlier than the second vehicle 14-2, process proceeds to step ST14 from ST10 and the vehicle communication unit 120 calculates the front portion moving interval dF/(speed of vehicle 14-3). After steps ST13 and ST14, processing returns to step ST4. Therefore, the communication possible timing of the second and third vehicles 14-2 and 14-3 can be obtained.

The angular velocity was provided for making the operation simple. Moreover, the front portion moving interval is obtained more accurately. That is, a shadow of the upper rear end UPRE of the first vehicle 14-1 projected on the bonnet. (hood) 14*d* of the second vehicle 14-2 (at the level of the bonnet 14*d* or the height of the vehicle communication unit 120-2) from the vehicle classifying unit 112 moves at a velocity VL1 and the bonnet 14*d* moves at the detected speed VL2 at the level of the bonnet 14*d*. Then, the communication possible timing is given by:

$$tcp=ts-dF/(VL1-VL2).$$

What is claimed is:

1. A vehicle classifying apparatus comprising:

generation means configured for emitting a light beam;

scanning means arranged at a predetermined position above a predetermined detection zone, wherein the predetermined detection zone includes a vehicle travel lane, the scanning means being configured for (i) deflecting the emitted light beam and (ii) directing the deflected light beam on a first scanning line formed along a longitudinal direction of the lane in order to illuminate a vehicle traveling in the lane, the deflected light beam and the first scanning line forming at least one predetermined angle;

receiving means configured for receiving a reflected light beam, the reflected light beam being produced by the deflected light beam illuminating the vehicle;

distance detection means including storing means, the distance detection means being responsive to the receiving means and configured for (i) detecting a time delay between a first timing and a second timing, the first timing defining a time of emission of the light beam and the second timing defining a time of reception of the reflected light beam, (ii) determining a distance between the scanning means and the vehicle based upon the time delay, and (iii) producing distance data indicative of the distance; and classifying means responsive to the distance detection means, the classifying means being configured for (i) classifying the vehicle in accordance with the distance data and (ii) producing a classification result representative of the classified vehicle;

wherein the at least one predetermined angle is an intermediate angle between the longitudinal direction and a width direction of the lane.

2. The vehicle classifying apparatus as claimed in claim 1, further comprising orthogonal component detection means for detecting characteristic points in a width direction perpendicular to said lane and width detection means for detecting a width of said vehicle from the detected characteristic points in said width direction.

3. A vehicle classifying apparatus comprising:

communication means for communicating with a vehicle communication unit configured for mounting on a vehicle travelling on a lane and receiving data associated with the communication unit within a predetermined communication zone, the data including identification data;

timing detection means for detecting a first timing when the vehicle communication unit starts communicating with the communication means;

generation means responsive to the timing detection means and configured for emitting a light beam;

scanning means arranged at a predetermined position above a predetermined detection zone, wherein the predetermined detection zone includes a vehicle travel lane, the scanning means being configured for (i) deflecting the emitted light beam and (ii) directing the deflected light beam on a first scanning line formed along a longitudinal direction of the lane in order to illuminate a vehicle traveling in the lane;

receiving means configured for receiving a reflected light beam, the reflected light beam being produced when the deflected light beam illuminates the vehicle the vehicle;

distance data image detection means for detecting a distance data image on the lane within a detection zone substantially agreeing with the predetermined communication zone to detect the distance data image of the vehicle in accordance with an output of the receiving means and detecting a speed of the vehicle;

position judging means for judging a position of the communication unit in accordance with the distance data image of the vehicle;

timing operation means for determining a second timing when the communication means communicates with the communication unit the speed and position of the vehicle; and judging means for judging whether the vehicle communication unit corresponds to the vehicle in accordance with the first and second timings and outputting the judging result.

4. The vehicle classifying apparatus as claimed in claim 3, wherein said judging means comprises difference operating means for operating a difference between said first and second timings and comparing means for comparing the difference with a reference and judges that said vehicle communication unit corresponds to said vehicles as that said vehicle communication unit is mounted on said vehicle in accordance with the comparing result.

5. The vehicle classifying apparatus as claimed in claim 3, further comprising reference varying means for varying said reference in inverse proportion to said speed.

6. The vehicle classifying apparatus as claimed in claim 3, wherein said communication means communicates with said vehicle with a microwave signal within said communication zone, said distance data image detection means optically detects said distance data image on said lane within said detection zone, and said communication zone three-dimensionally agrees with said detection zone.

7. The vehicle classifying apparatus as claimed in claim 3, wherein said distance data detection means comprises laser scanning means for emitting a laser beam for scanning and receiving the reflected laser light and obtaining distance data image from the delay of emitting said laser beam and receiving the reflected laser light.

8. The vehicle classifying apparatus as claimed in claim 3, further comprising historic data storing means for storing data of said first timing as historic data of said vehicle communication unit and said judging means judges that said vehicle communication unit corresponds to said vehicle in accordance with said first timing and said historic data as said second timing.

9. The vehicle classifying apparatus as claimed in claim 3, further comprising unrighteous judging means for judging unrighteous travelling of said vehicle on said lane in accordance with the judging result of said judging means when said vehicle communication unit does not correspond to said vehicle and outputting the unrighteous judging result.

10. The vehicle classifying apparatus as claimed in claim 9, further comprising vehicle classifying means for classifying said vehicle from said distance data image, wherein said data further includes class data which is to be correspondent to said vehicle and said unrighteous judging means further judges said unrighteous travelling when the class of said vehicle classified by said vehicle classifying means disagrees with said class data from said communication means.

11. The vehicle classifying apparatus as claimed in claim 3, wherein said position judging means judges a front shield position of said vehicle from the detected distance data image and judges said position of said communication unit adjacent to said front shield position.

12. A toll system comprising:

vehicle classifying apparatus means including:

communication means for communicating with a vehicle communication unit configured for mounting on a vehicle travelling on a lane and receiving data from the communication unit within a predetermined communication zone, the data including identification data;

timing detection means for detecting a first timing when the vehicle communication unit begins to communicate with the communication means;

generation means configured for emitting a light beam;

scanning means arranged at a predetermined position above a predetermined detection zone, wherein the predetermined detection zone includes a vehicle travel lane, the scanning means being configured for (i) deflecting the emitted light beam and (ii) directing the deflected light beam on a first scanning line formed along a longitudinal direction of the lane in order to illuminate a vehicle traveling in the lane;

receiving means configured for receiving a reflected light beam, the reflected light beam being produced when the deflected light beam illuminates the vehicle;

distance data image detection means for detecting a distance data image on the lane within detection zone substantially agreeing with the communication zone to detect the distance data image of the vehicle in accordance with an output of the receiving means and detecting a speed of the vehicle;

outline detection means responsive to the distance data image detection means and configured for directly detecting an outline of the vehicle in accordance with the distance data image;

position judging means for judging a position of the communication unit in accordance with the outline;

timing operation means for operating a second timing when the communication means communicates with the communication unit the speed and position of the vehicle; and judging means for judging whether the vehicle communication unit corresponds to the vehicle in accordance with the first and second timings and outputting the judging result;

determining means for determining a toll of the vehicle; and demanding means for demanding payment of the toll from a person.

13. A vehicle classifying apparatus comprising:

generation means configured for emitting a light beam;

scanning means arranged at a predetermined position above a predetermined detection zone, wherein the predetermined detection zone includes a vehicle travel lane, the scanning means being configured for (i) deflecting the emitted light beam and (ii) directing the deflected light beam on a first scanning line formed along a longitudinal direction of the lane to illuminate a vehicle traveling in the lane;

receiving means configured for receiving a reflected light beam, the reflected light beam being produced when the deflected light beam illuminates the vehicle the vehicle;

distance detection means including storing means, the distance detection means being responsive to the receiving means and configured for (i) detecting a time delay between a first timing and a second timing, the first timing defining a time of emission of the light beam and the second timing defining a time of reception of the reflected light beam, (ii) determining a distance between the scanning means and the vehicle based upon the time delay, and (iii) producing distance data indicative of the distance;

outline detection means responsive to the distance detection means and configured for directly detecting an outline of the vehicle in accordance with the distance data; and classifying means responsive to the outline detection means, the classifying means being configured for (i) classifying the vehicle in accordance with the outline and (ii) producing a classification result representative of the classified vehicle.

14. The vehicle classifying apparatus as claimed in claim 13, further comprising:

characteristic point detection means for detecting characteristic points of the outline of said vehicle from said distance data;

correspondence detection means for detecting correspondence between previously detected first characteristic points and presently detected second characteristic points including a part of said first characteristic points; and characteristic point combining means for combining said first characteristic points with said second characteristic points in accordance with said correspondence.

15. The vehicle classifying apparatus as claimed in claim 13, wherein said classifying means detects a shape of the outline of said vehicle in said longitudinal direction.

16. The vehicle classifying apparatus as claimed in claim 13, further comprising:

characteristic point detection means for detecting characteristic points of the outline of said vehicle from said distance data;

vehicle speed detection means responsive to said characteristic point detection means for detecting movement of said characteristic points, determining an instantaneous speed of said vehicle in accordance the detected movement, and outputting data of said instantaneous speed.

17. The vehicle classifying apparatus as claimed in claim 16, wherein said vehicle speed variation detection means detects a travelling speed of said vehicle within said predetermined detection zone in accordance with the detected movement.

18. The vehicle classifying apparatus as claimed in claim 16, further comprising:

vehicle speed variation detection means for detecting a moving speed of said characteristic points, detecting a variation of said travelling speed within said predetermined detection zone in accordance with the detected movement, and outputting data of said variation.

19. The vehicle classifying apparatus as claimed in claim 18, wherein said vehicle speed detection means detects an interval for which said movement of said characteristic points cannot be continuously detected;

said vehicle classifying apparatus further comprising speed estimation means configured for estimating said traveling speed of said vehicle in accordance with (i) said traveling speed and said variation detected before said interval and (ii) said traveling speed and said variation after said interval.

20. The vehicle classifying apparatus as claimed in claim 18, wherein said classifying means detects a shape of the outline of said vehicle in said longitudinal direction, said vehicle speed detection means detects an interval for which said movement of said characteristic point cannot be continuously detected; said vehicle classifying apparatus further comprising speed estimation means for estimating said travelling speed of said vehicle in accordance with said travelling speed and said variation detected before said interval and in accordance with said travelling speed and said variation after said interval with assumption that the travelling speed varies successively.

21. The vehicle classifying apparatus according to claim 13, further comprising:

second generation means configured for emitting a second light beam;

second scanning means arranged at a second predetermined position above a detection zone, wherein the detection zone includes a vehicle travel lane, the second scanning means being configured for (i) deflecting the second emitted light beam and (ii) directing the second deflected light beam on a second scanning line formed along a longitudinal direction of the lane in order to illuminate a vehicle traveling in the lane;

second receiving means configured for receiving a second reflected light beam, the second reflected light beam being produced when the second deflected light beam illuminates the vehicle the vehicle;

second distance detection means including second storing means, the second distance detection means being responsive to the second receiving means and configured for (i) detecting a second time delay between a third timing and a fourth timing, the third timing defining a time of emission of the second light beam and the fourth timing defining a time of reception of the second reflected light beam, (ii) determining a second distance between the second scanning means and the vehicle based upon the second time delay, and (iii) producing second distance data indicative of the second distance;

second outline detection means responsive to the second distance detection means and configured for directly detecting a second outline of the vehicle in accordance with the second distance data; and second classifying means responsive to the second outline detection means, the second classifying means being configured for (i) classifying the vehicle in accordance with the second outline and (ii) producing a second classification result representative of the classified vehicle.

22. The vehicle classifying apparatus as claimed in claim 21, wherein the direction of said second scanning line is different from the direction of said scanning line.

23. The vehicle classifying apparatus as claimed in claim 22, wherein said second scanning line is perpendicular to said longitudinal direction.

24. The vehicle classifying apparatus as claimed in claim 23, wherein said predetermined angle is zero.

25. The vehicle classifying apparatus as claimed in claim 23, wherein said angle is zero, the vehicle classifying apparatus further comprises vehicle position judging means responsive to said second distance detection means for judging a position of said vehicle along said second scanning line, a case for supporting said generation means, scanning means, and receiving means, and swing means for swing said case in accordance with said detected position.

26. The vehicle classifying apparatus as claimed in claim 21, wherein said generation means comprises a first laser light source emitting a first laser light as said light beam and said second generation means comprises a second laser light source emitting a second laser light as said second light beam.

27. The vehicle classifying apparatus as claimed in claim 21, wherein said generation means comprises a laser light source emitting a laser light and said second generation means further comprises beam splitting means for splitting said laser light into said light beam and said second light beam.

28. The vehicle classifying apparatus as claimed in claim 27, wherein said beam splitting means splits said laser light such that said light beam and said second light beam are alternately outputted every scanning of each of said first and second light beams.

29. The vehicle classifying apparatus as claimed in claim 27, further comprising a polygon mirror unit as said scanning means and said beam splitting means, wherein said polygon mirror unit including first and second mirrors, and rotating means rotating said first and second mirrors, said second mirror which is inclined to said first mirror to split said laser light into said light beam and said second light beam.

30. The vehicle classifying apparatus according to claim 13, further comprising:

second generation means configured for emitting a second light beam;

second scanning means arranged at a second predetermined position above a detection zone, wherein the detection zone includes a vehicle travel lane, the second scanning means being configured for (i) deflecting the second emitted light beam and (ii) directing the second deflected light beam on a second scanning line perpendicular to said longitudinal direction;

second receiving means configured for receiving a second reflected light beam, the second reflected light beam being produced when the second deflected light beam illuminates the vehicle the vehicle;

second distance detection means including second storing means, the second distance detection means being responsive to the second receiving means and configured for (i) detecting a second time delay between a third timing and a fourth timing, the third timing defining a time of emission of the second light beam and the fourth timing defining a time of reception of the second reflected light, (ii) determining a second distance between the second scanning means and the vehicle based upon the second time delay, and (iii) producing second distance data indicative of the second distance; and tire detection means for detecting a tire of the vehicle in accordance with the second data.

31. The vehicle classifying apparatus as claimed in claim 30, further comprising the number of axles detection means for detecting the number of axles of said vehicle in accordance with a result of said tire detection means.

32. The vehicle classifying apparatus as claimed in claim 30, further comprising separation means for separating said lane from the other lane such that said any of said first and second beam signals are obstructed by another vehicle on said a other lane.

33. The vehicle classifying apparatus as claimed in claim 13, wherein said beam signal generation means comprises a laser light source emitting a laser light as said signal beam.

34. The vehicle classifying apparatus as claimed in claim 33, further comprising pulse driving means for driving said laser light source to periodically emit a pulse of said light beam, wherein said distance detection means detects said time delay.

35. The vehicle classifying apparatus as claimed in claims 29, further comprising directing means for directing said light beam toward said predetermined detection zone along said first scanning line and directing said second beam signal toward said predetermined detection zone along said second scanning line.

36. The vehicle classifying apparatus as claimed in claim 35, wherein said directing means comprises first and second sets of mirrors.

37. A vehicle classifying apparatus comprising:

first and second scanning means, arranged at a predetermined position above a predetermined detection zone on a lane on which a vehicle to be classified travels, for emitting first and second light beams with the first and second light beams scanned toward the predetermined detection zone on first and scanning lines and receiving the first and second light beams reflected by the vehicle at the predetermined detection zone, respectively, the first and second scanning lines extending along a longitudinal direction and a width direction of the lane, respectively;

first and second distance detection means for detecting first and second time delays between emission and receiving timings of the first and second light beams in response to the first and second scanning means and determining first and second distance data in accordance with the detected first and second time delays, respectively;

first and second outline detection means for directly detecting first and second outlines of the vehicle on first and second scanning lines defined by the first and second scanning means in accordance with the first and second distance data, respectively; and classifying means for classifying the vehicle in accordance with the first and second outlines and outputting a classification result.

38. The vehicle classifying apparatus according to claim 37, wherein the first and second scanning means alternately emit the first and second light beams.

* * * * *

UNITED STATES PATENT AND TRADEMARK OFFICE

CERTIFICATE OF CORRECTION

PATENT NO. : 6,195,019 B1
DATED : February 27, 2001
INVENTOR(S) : Nagura

It is certified that error appears in the above-identified patent and that said Letters Patent is hereby corrected as shown below:

Title page,
Please correct to read as follows:

-- Item [30] Foreign Application Priority Data
Jan. 20, 1998 [JP] ..... 10-8695

Jun. 23, 1998 [JP] ..... 10-175780 --

Signed and Sealed this

Sixteenth Day of October, 2001

*Attest:*

Nicholas P. Godici

*Attesting Officer*

NICHOLAS P. GODICI
*Acting Director of the United States Patent and Trademark Office*